US006820975B2

(12) United States Patent
Sugaya et al.

(10) Patent No.: US 6,820,975 B2
(45) Date of Patent: Nov. 23, 2004

(54) INKJET RECORDING APPARATUS AND INKJET RECORDING METHOD

(75) Inventors: Toyoaki Sugaya, Hachioji (JP); Fujio Miyamoto, Hino (JP); Makoto Kaga, Hachioji (JP); Shuji Kida, Iruma (JP); Takashi Tsutsumi, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/941,409

(22) Filed: Aug. 28, 2001

(65) Prior Publication Data

US 2002/0027587 A1 Mar. 7, 2002

(30) Foreign Application Priority Data

Sep. 1, 2000 (JP) ..... 2000-265947
Mar. 29, 2001 (JP) ..... 2001-095411

(51) Int. Cl.[7] ..... B41J 2/01
(52) U.S. Cl. ..... 347/104; 347/102; 347/103
(58) Field of Search ..... 347/102, 104, 347/103, 101; 214/216

(56) References Cited

U.S. PATENT DOCUMENTS 4,597,794 A * 7/1986 Ahta et al. ..... 106/20
4,832,984 A 5/1989 Hasegawa et al. ..... 427/161
5,502,475 A * 3/1996 Kaburagi et al. ..... 347/102
5,618,338 A 4/1997 Kurabayashi et al. ..... 106/26
5,815,173 A * 9/1998 Silverbrook ..... 347/15
6,012,794 A * 1/2000 Nakano et al. ..... 347/7
6,120,199 A * 9/2000 Takekoshi ..... 400/611
6,390,617 B1 * 5/2002 Iwao ..... 347/102
6,550,909 B2 * 4/2003 Ichinose et al. ..... 347/105

FOREIGN PATENT DOCUMENTS

| | | |
|---|---|---|
| DE | 196 28 342 | 1/1998 |
| EP | 0564420 | * 10/1993 |
| EP | 0 858 905 | 8/1998 |
| EP | 0 908 324 | 4/1999 |
| EP | 1 101 627 | 5/2001 |
| JP | 05-112000 | * 5/1993 |
| JP | 06046854 | 9/1995 |
| JP | 10031225 | 11/1998 |

* cited by examiner

*Primary Examiner*—Stephen D. Meler
*Assistant Examiner*—Ly T Tran
(74) *Attorney, Agent, or Firm*—Squire, Sanders & Dempsey

(57) ABSTRACT

An inkjet recording apparatus is provided with a recording head to conduct recording by jetting an ink onto a recording medium having an ink receiving layer containing thermoplastic in particles on a surface thereof and a pigment ink solvent absorbing layer adjoining to an inner side of the ink receiving layer; a heating and pressing device to heat and press the recording medium so as to make the ink receiving layer of the recording medium to be transparent; a conveyor to convey the recording medium to the recording head and further to the heating and pressing device; and a temperature controller to control a heating temperature by the heating and pressing device within a range of $T_0 \pm \Delta T°$ C., where $T_0$ is 50 to 150° C. and $\Delta T$ is not larger than 10° C.

37 Claims, 31 Drawing Sheets

FIG. 4 ( a )
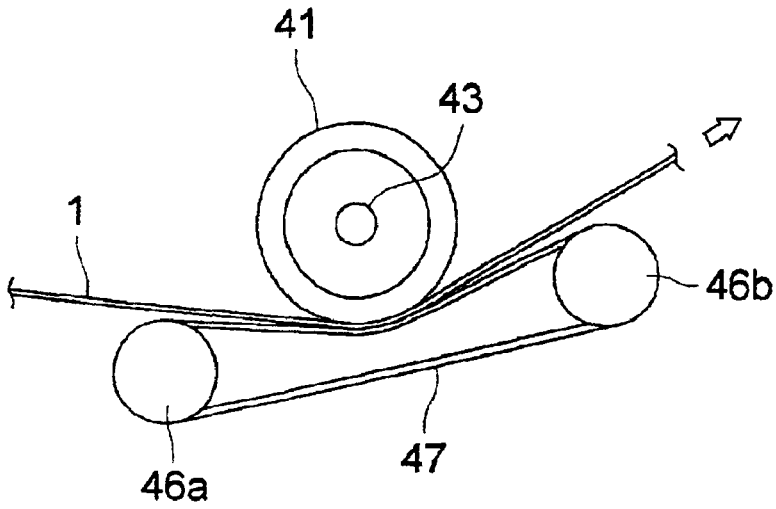
FIG. 4 ( b )
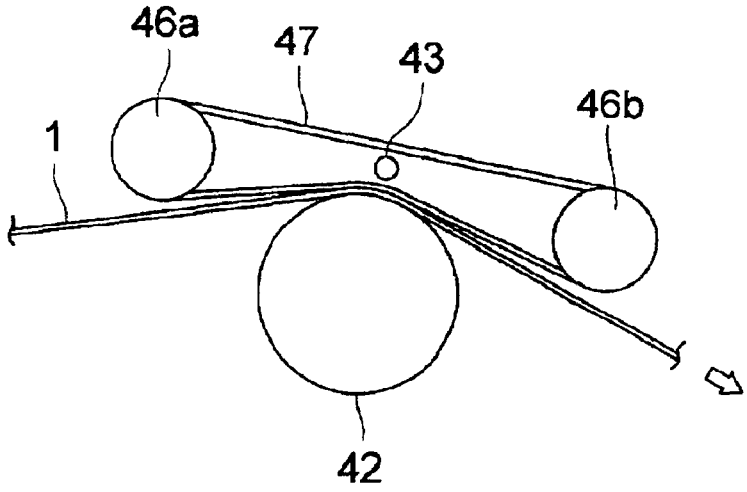

FIG. 34 ( a )
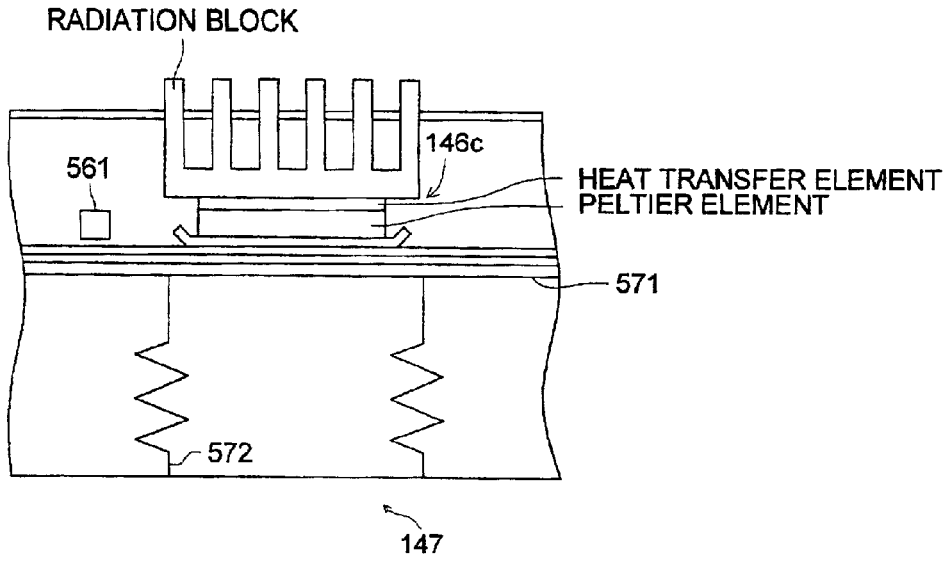
FIG. 34 ( b )
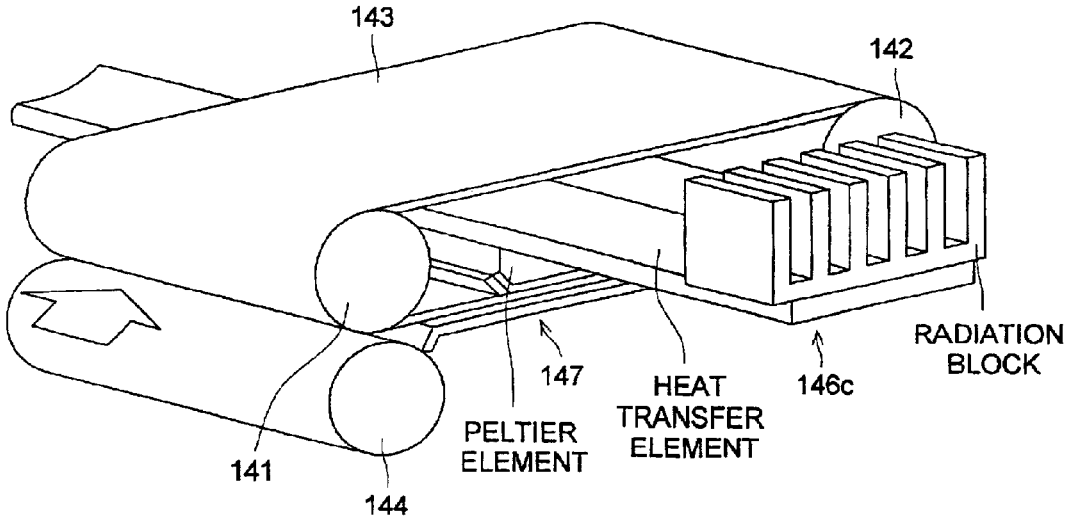

FIG. 35 ( a )
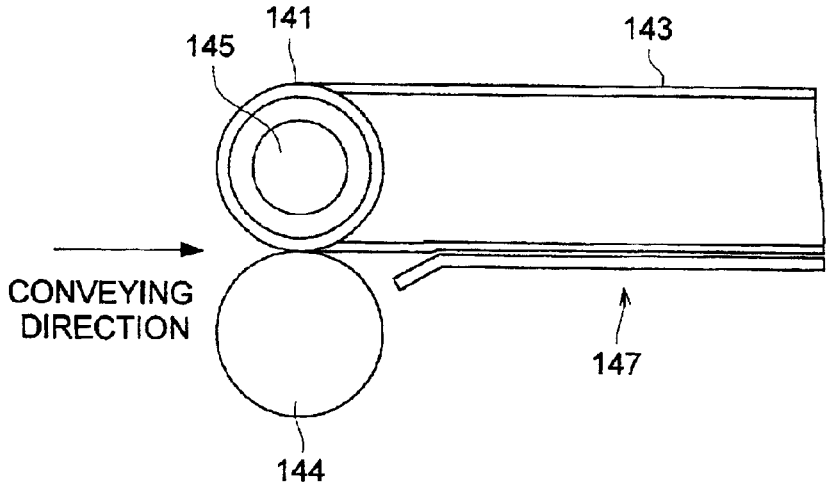
FIG. 35 ( b )
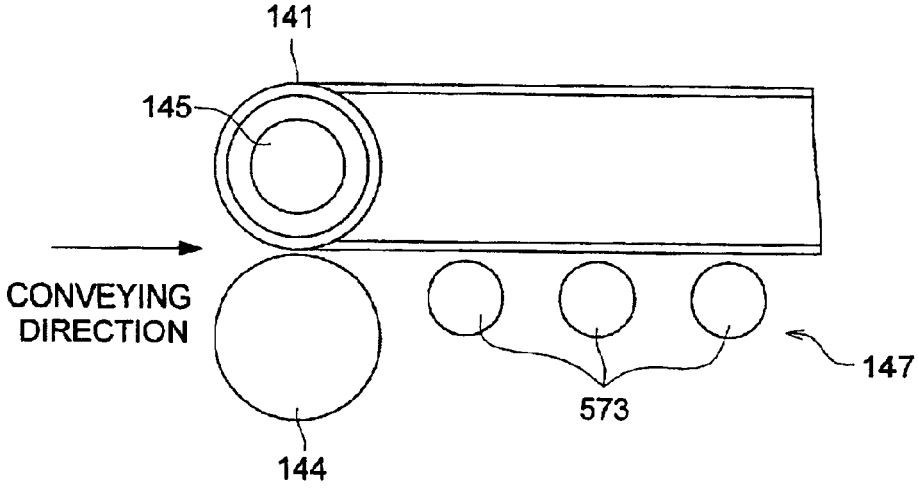

INKJET RECORDING APPARATUS AND INKJET RECORDING METHOD

BACKGROUND OF THE INVENTION

The present invention relates to an ink jet recording apparatus, and in more detail, to an ink jet recording apparatus by which, after an ink is jetted and recorded onto a recording medium having an ink receiving layer including thermoplastic resin particles on the surface layer, the recording medium is heated and pressurized by a heating and pressing means.

The ink jet recording to jet the minute liquid drop of the ink onto the recording surface of the recording medium and conduct the image recording, advances so that the increase of the high image quality and reduction of the apparatus cost are possible so far as almost equal to the silver halide photography by the recent technical advances, and rapidly spreads.

The ink used in such the ink jet recording is largely divided into the dye ink and the pigment ink. The dye ink is soluble in a solvent, and has high purity and shows clear coloring, and it has no grainness and because the scattered light and the reflected light are not generated, the transparentness is high and the color hue is sharp and on the one hand, when the dyestuff molecule is destroyed by the photochemical reaction, because the decrease of the number of molecules influences on the coloring density as it is, there is a problem that the light resistance is poor. In contrast to this, the pigment ink is insoluble in the solvent, and dyestuff molecules form the particles and contribute to the coloring under the condition that they are dispersed in the solvent, and even when the molecule on the surface is destroyed by the photochemical reaction, because a new dyestuff molecule layer exists in the lower portion of it, the apparent lowering of the tinting strength is small, and there is an advantage that the image conservation is excellent to the dye ink.

However, there is a problem that the pigment ink is inferior in the glossiness due to the influence of the scattered light and the reflected light due to particles. Therefore, in order to provide the glossiness onto the recording medium surface on which an image is formed by using the pigment ink including the dispersing agent, and further to prevent the bleeding due to the contact of the image with water, and to increase the friction resistance, the technology by which the image is recorded and formed by using the recording medium having the ink receiving layer including the thermoplastic resin particle on the surface layer, and the pigment ink solvent absorbing layer adjoining the inside of the ink receiving layer, and after that, by heating and pressing the recording medium, the thermoplastic resin particle in the ink receiving layer is fused and smoothed, and the ink receiving layer is made transparent, is proposed (Japanese Tokugan No. 2000-164386).

However, if the process of heating and pressing the recording medium is not conducted with a proper heating temperature, various problems may be raised. In particular, when the recording medium is a resin coated paper in which a paper substrate is coated with a resin, if the heating process is conducted with a temperature higher than the heat resistance of the resin, there is a problem that the resin coated paper may deform or may be damaged. In contrast, if the heating process is conducted with an excessively low temperature, thermoplastic resin particles are not made to be sufficiently transparent or it may take a long time to make the thermoplastic resin particles to be sufficiently transparent.

In such the technology, the recording medium on which the image is recorded and formed by the recording head, is conveyed to the heating and pressing means by the conveying means in order to make the ink receiving layer transparent, and heated and pressurized and the ink receiving layer is made transparent, however, in order to form the high quality image print, it is required that, making the ink receiving layer transparent, is adequately conducted with a proper heating temperature.

SUMMARY OF THE INVENTION

Accordingly, the object of the present invention is to provide an ink jet recording apparatus by which, when the recording medium having the ink receiving layer including the thermoplastic resin particle on the surface layer, and the pigment ink solvent absorbing layer adjoining the inside of the ink receiving layer, is heated and pressured and its ink receiving layer is made transparent, the making transparent is adequately conducted and the high quality image print can be formed.

The above object can be attained by the following structures.

(1-1) An inkjet recording apparatus, comprises:

a recording head to conduct recording by jetting an ink onto a recording medium having an ink receiving layer containing thermoplastic resin particles on a surface thereof and a pigment ink solvent absorbing layer adjoining to an inner side of the ink receiving layer;

a heating and pressing device to heat and press the recording medium so as to make the ink receiving layer of the recording medium to be transparent;

a conveyor to convey the recording medium to the recording head and further to the heating and pressing device; and a temperature controller to control a heating temperature by the heating and pressing device within a range of $T_0 \pm \Delta T$° C., where $T_0$ is 50 to 150° C. and $\Delta T$ is not larger than 10° C.

(1-2) In the inkjet recording apparatus of (1-1), $T_0$ is 80 to 130° C.

(1-3) In the inkjet recording apparatus of (1-1), the inkjet recording apparatus is adapted to record an image on one of plural kinds of recording medium and the heating and pressing device changes a heating and pressing time period in accordance with the kind of the recording medium.

(1-4) In the inkjet recording apparatus of (1-1), the inkjet recording apparatus is adapted to record an image on one of plural kinds of recording medium and the temperature controller changes the heating temperature in accordance with the kind of the recording medium.

(1-5) In the inkjet recording apparatus of (1-1), the heating and pressing device comprises a belt member stretched around at least two rollers and a roller coming in contact with the belt member so as to form a nip section therebetween where the recording medium passes through.

(1-6) In the inkjet recording apparatus of (1-1), the heating and pressing device comprises two belt members each stretched around at least two rollers and the two belt members come in contact with each other so as to form a nip section therebetween where the recording medium passes through.

(1-7) In the inkjet recording apparatus of (1-1), the heating and pressing device presses the recording medium with a pressing force of $9.8\times10^4$ to $4.9\times10^6$ Pa.

(1-8) In the inkjet recording apparatus of (1-1), the heating and pressing device has a recording medium contacting surface to contact the recording medium and comprises a cleaning member to clean the recording medium contacting surface.

(1-9) In the inkjet recording apparatus of (1-1), the heating and pressing device has a recording medium contacting surface to contact the recording medium and comprises a transfer preventing liquid providing member to provide the recording medium contacting surface with a transfer preventing liquid to prevent a part of the recording medium or an ink from transferring to the recording medium contacting surface.

(1-10) In the inkjet recording apparatus of (1-9), the transfer preventing liquid contains a silicone oil.

(1-11) In the inkjet recording apparatus of (1-1), the heating and pressing device has a recording medium contacting surface to contact the recording medium and comprises a transfer preventing liquid providing member to provide the recording medium contacting surface with a transfer preventing liquid to prevent a part of the recording medium or an ink from transferring to the recording medium contacting surface before heating and pressing the recording medium after the recording head has conducted recording on the recording medium.

(1-12) In the inkjet recording apparatus of (1-1), the heating and pressing device has a recording medium contacting surface to contact the recording medium and comprises a glossing liquid providing member to provide a glossing liquid onto the recording medium contacting surface.

(1-13) In the inkjet recording apparatus of (1-12), the inkjet recording apparatus is adapted to record an image on one of plural kinds of recording medium and the a glossing liquid providing member comprises a control section to control whether or not to provide the glossing liquid in accordance with the kind of the recording medium.

(1-14) In the inkjet recording apparatus of (1-12), the inkjet recording apparatus is adapted to record an image on one of plural kinds of recording medium and the a glossing liquid providing member comprises a selecting section to select whether or not to provide the glossing liquid.

(1-15) In the inkjet recording apparatus of (1-12), the glossing liquid contains a silicone oil.

(1-16) In the inkjet recording apparatus of (1-1), further the inkjet recording apparatus comprises a glossing liquid providing member to provide a glossing liquid onto the recording medium after the recording head has conducted recording on the recording medium.

(1-17) In the inkjet recording apparatus of (1-1), when the inkjet recording apparatus does not conduct recording during a predetermined time period, the temperature controller stop controlling the heating temperature such that the heating and pressing device stop heat generation.

(1-18) In the inkjet recording apparatus of (1-17), when the temperature controller resumes controlling the heating temperature after the temperature controller stopped the controlling, the heating and pressing device conduct heating and pressing by prolong relatively a heating and pressing time period after the heating temperature becomes higher than a lowest heating temperature and until the heating temperature becomes within a predetermined temperature range.

(1-19) In the inkjet recording apparatus of (1-18), when the heating and pressing device prolongs the heating and pressing time period for the recording medium, the recording head prolongs relatively a recording time period per a unit length of the recording medium in a conveying direction.

(1-20) In the inkjet recording apparatus of (1-19), the recording head scans on the recording sheet forwardly backwardly in a direction perpendicular to the conveying direction, and wherein the recording head prolongs the recording time period by adjusting a stop time at which a scanning direction is changed.

(1-21) In the inkjet recording apparatus of (1-19), the recording head is a line head having a length corresponding to a width of the recording medium, and wherein the recording head prolongs the recording time period by adjusting a ink jetting time interval.

(1-22) In the inkjet recording apparatus of (1-1), when the inkjet recording apparatus does not conduct recording during a predetermined time period, the temperature controller controls such that the heating and pressing device keeps the heating temperature within a second temperature lower than the range.

(1-23) In the inkjet recording apparatus of (1-1), when the inkjet recording apparatus does not conduct recording during a predetermined time period, the temperature controller controls such that the heating and pressing device keeps the heating temperature within a second temperature lower than the range, and further when the inkjet recording apparatus does not conduct recording during a predetermined another time period, the temperature controller stop controlling the heating temperature such that the heating and pressing device stop heat generation.

(1-24) In the inkjet recording apparatus of (1-1), the heating and pressing device comprises a heating roller, a driven roller, a heating belt stretched around the heating roller and the driven roller, a pressing roller provided opposite to the heating roller, and a pressing member provided downstream in a conveying direction from the pressing roller and to press the recording medium.

(1-25) In the inkjet recording apparatus of (1-24), the heating belt is an endless belt whose surface roughness is 0.01 $\mu$m to 0.5 $\mu$m.

(1-26) In the inkjet recording apparatus of (1-24), the pressing member is a plate.

(1-27) In the inkjet recording apparatus of (1-1), the heating and pressing device comprises a heating roller, a driven roller, a heating belt stretched around the heating roller and the driven roller, a pressing roller provided opposite to the heating roller, and a pressing belt to press the heating belt.

(1-28) In the inkjet recording apparatus of (1-27), the heating belt and the pressing belt come in contact with each other.

(1-29) In the inkjet recording apparatus of (1-27), the heating belt has a surface roughness of 0.01 $\mu$m to 0.5 $\mu$m.

(1-30) In the inkjet recording apparatus of (1-27), when the conveyor conveys the recording medium through the heating and pressing device, the heating and pressing device comes in contact with the recording medium for a contact time of 3 to 15 seconds.

(1-31) A inkjet recording method of recording an image on a recording medium having an ink receiving layer containing thermoplastic resin particles on a surface thereof and a pigment ink solvent absorbing layer adjoining to an inner side of the ink receiving layer, comprises steps of:

recording an image with a pigment ink;

making the ink receiving layer to be transparent by heating and pressing the recording medium with a heating temperature of $T_0 \pm \Delta T$° C., where $T_0$ is 50 to 150° C. and $\Delta T$ is not larger than 10° C.

(1-32) In the inkjet recording method of (1-31), $T_0$ is 80 to 130° C.

Further, the above object of the present invention may be attained by the following preferable structures.

(2-1) An ink jet recording apparatus having: a recording head to record by jetting the ink onto the recording medium having the ink receiving layer including the thermoplastic resin particle on the surface layer, and the pigment ink solvent absorbing layer adjoining the inside of the ink receiving layer; a heating and pressing means for heating and pressurizing the recording medium and for making the ink receiving layer of the recording medium transparent; a temperature control means for maintaining the temperature of the heating and pressing means within a predetermined temperature range; and a recording medium conveying means for conveying the recording medium on which recording is conducted by the recording head, to the heating and pressing means, wherein the heating and pressurizing time of the recording medium by the heating and pressing means is 0.1–2 sec.

Thereby, the heating and pressurizing processing sufficiently necessary for making the ink receiving layer of the recording medium transparent, can be realized, and the good image print can be made.

(2-2) An ink jet recording apparatus having: a recording head to record by jetting the ink onto the recording medium having the ink receiving layer including the thermoplastic resin particle on the surface layer, and the pigment ink solvent absorbing layer adjoining the inside of the ink receiving layer; a heating and pressing means for heating and pressurizing the recording medium and for making the ink receiving layer of the recording medium transparent; a temperature control means for maintaining the temperature of the heating and pressing means within a predetermined temperature range; and a recording medium conveying means for conveying the recording medium on which recording is conducted by the recording head, to the heating and pressing means, wherein the heating and pressurizing time of the recording medium by the heating and pressing means is changed depending on the kind of recording media.

Thereby, on the various recording media, the heating and pressurizing processing can be respectively conducted by the optimum heating time, and it is effective for the good quality image print formation.

(2-3) An ink jet recording apparatus having: a recording head to record by jetting the ink onto the recording medium having the ink receiving layer including the thermoplastic resin particle on the surface layer, and the pigment ink solvent absorbing layer adjoining the inside of the ink receiving layer; a heating and pressing means for heating and pressurizing the recording medium and for making the ink receiving layer of the recording medium transparent; a temperature control means for maintaining the temperature of the heating and pressing means within a predetermined temperature range; and a recording medium conveying means for conveying the recording medium on which recording is conducted by the recording head, to the heating and pressing means, wherein, depending on the kind of the recording media, the maintaining temperature range of the heating and pressing means is changed.

Thereby, on the various recording media, the heating and pressurizing processing can be respectively conducted at the optimum heating temperature, and it is effective for the good quality image print formation.

(2-4) An ink jet recording apparatus having: a recording head to record by jetting the ink onto the recording medium having the ink receiving layer including the thermoplastic resin particle on the surface layer, and the pigment ink solvent absorbing layer adjoining the inside of the ink receiving layer; a heating and pressing means for heating and pressurizing the recording medium and for making the ink receiving layer of the recording medium transparent; a temperature control means for maintaining the temperature of the heating and pressing means within a predetermined temperature range; and a recording medium conveying means for conveying the recording medium on which recording is conducted by the recording head, to the heating and pressing means, wherein the heating and pressing means is structured by including 2 rollers which sandwich the recording medium and are opposite to each other, and at least one recording medium contact surface of 2 rollers is structured by a member of a longitudinal elastic modulus (Young's modulus) of $10^6$–$10^7$ Pa.

Thereby, the adequate pressurizing strength and pressurizing time can be obtained by a simple structure.

(2-5) An ink jet recording apparatus having: a recording head to record by jetting the ink onto the recording medium having the ink receiving layer including the thermoplastic resin particle on the surface layer, and the pigment ink solvent absorbing layer adjoining the inside of the ink receiving layer; a heating and pressing means for heating and pressurizing the recording medium and for making the ink receiving layer of the recording medium transparent; a temperature control means for maintaining the temperature of the heating and pressing means within a predetermined temperature range; and a recording medium conveying means for conveying the recording medium on which recording is conducted by the recording head, to the heating and pressing means, wherein the heating and pressing means is structured by including a belt member stretched among more than 2 rollers, and the rollers which sandwich the belt member and the recording medium and are opposite to each other.

Thereby, because the roller and the belt member are brought into surface-contact by pressure-contacting, the adequate pressurizing force and pressurizing time can be obtained even in the case of the high speed processing. Further, when the arrangement of the belt member and the roller suspending the belt member and tension of the belt member are adjusted, the contacting area and pressurizing force of the belt member with the roller opposite to the belt member can be easily adjusted.

(2-6) An ink jet recording apparatus having: a recording head to record by jetting the ink onto the recording medium having the ink receiving layer including the thermoplastic resin particle on the surface layer, and the pigment ink solvent absorbing layer adjoining the inside of the ink receiving layer; a heating and pressing means for heating and pressurizing the recording medium and for making the ink receiving layer of the recording medium transparent; a temperature control means for maintaining the temperature of the heating and pressing means within a predetermined temperature range; and a recording medium conveying means for conveying the recording medium on which recording is conducted by the recording head, to the heating and pressing means, wherein the heating and pressing means is structured by including 2 belt members which sandwich the recording medium and are opposite to each other, and roller group to suspend the belt members.

Thereby, because the roller and the belt member are brought into surface-contact by pressure-contacting, the adequate pressurizing force and pressurizing time can be obtained even in the case of the high speed processing. Further, when the arrangement of each of rollers or the tension of each of belt members is adjusted, the contacting area and pressurizing force of the belt member with each other can be easily adjusted. Further, the degree of freedom of the design in the conveying direction of the recording medium is high, and it is advantageous for the size reduction of the apparatus or the increase of the operability.

(2-7) An ink jet recording apparatus according to any one of item (2-1) to (2-6), having: a recording head to record by jetting the ink onto the recording medium having the ink receiving layer including the thermoplastic resin particle on the surface layer, and the pigment ink solvent absorbing layer adjoining the inside of the ink receiving layer; a heating and pressing means for heating and pressurizing the recording medium and for making the ink receiving layer of the recording medium transparent; a temperature control means for maintaining the temperature of the heating and pressing means within a predetermined temperature range; and a recording medium conveying means for conveying the recording medium on which recording is conducted by the recording head, to the heating and pressing means, wherein, when the predetermined temperature range is $T_0 \pm \Delta T°$ C., $T_0$ is 50–150° C., and $\Delta T$ is not higher than 10° C.

Thereby, the stable heating processing of the recording medium can be conducted within the temperature range which is sufficiently necessary for heating processing, and making the ink receiving layer transparent can be stably conducted with the good quality.

(2-8) An ink jet recording apparatus according to any one of items (2-1) to (2-7), wherein the recording medium pressurizing force by the heating and pressing means is $9.8\times10^4$–$4.9\times10^6$ Pa.

Thereby, the stable pressurizing processing of the recording medium can be conducted with the pressurizing force which is sufficiently necessary for pressurizing processing, and making the ink receiving layer transparent can be stably conducted with the good quality.

(2-9) An ink jet recording apparatus having: a recording head to record by jetting the ink onto the recording medium having the ink receiving layer including the thermoplastic resin particle on the surface layer, and the pigment ink solvent absorbing layer adjoining the inside of the ink receiving layer; a heating and pressing means for heating and pressurizing the recording medium and for making the ink receiving layer of the recording medium transparent; a temperature control means for maintaining the temperature of the heating and pressing means within a predetermined temperature range; and a recording medium conveying means for conveying the recording medium on which recording is conducted by the recording head, to the heating and pressing means, wherein a cleaning means for cleaning the recording medium contact surface of the heating and pressing means is provided.

Thereby, it can be prevented that, in the heating and pressing means, the contact surface with the recording medium is soiled, and the image of the recording medium is soiled, and the heating and pressurizing performance is lowered, and the ink receiving layer of the recording medium can be always made transparent with good quality.

(2-10) An ink jet recording apparatus having: a recording head to record by jetting the ink onto the recording medium having the ink receiving layer including the thermoplastic resin particle on the surface layer, and the pigment ink solvent absorbing layer adjoining the inside of the ink receiving layer; a heating and pressing means for heating and pressurizing the recording medium and for making the ink receiving layer of the recording medium transparent; a temperature control means for maintaining the temperature of the heating and pressing means within a predetermined temperature range; and a recording medium conveying means for conveying the recording medium on which recording is conducted by the recording head, to the heating and pressing means, wherein the apparatus has a transfer prevention liquid providing means for providing the transfer prevention liquid to prevent one portion of the recording medium or ink from transferring onto the contact surface of the recording medium of the heating and pressing means to the recording medium contact surface of the heating and pressing means.

Thereby, a portion of the recording medium or the ink is prevented from transferring onto the recording medium contact surface of the heating and pressing means, and it can be prevented that the contact surface with the recording medium is soiled and the image of the recording medium is soiled, and the heating and pressurizing performance is lowered, and the ink receiving layer of the recording medium can be always made transparent with good quality.

(2-11) An ink jet recording apparatus having: a recording head to record by jetting the ink onto the recording medium having the ink receiving layer including the thermoplastic resin particle on the surface layer, and the pigment ink solvent absorbing layer adjoining the inside of the ink receiving layer; a heating and pressing means for heating and pressurizing the recording medium and for making the ink receiving layer of the recording medium transparent; a temperature control means for maintaining the temperature of the heating and pressing means within a predetermined temperature range; and a recording medium conveying means for conveying the recording medium on which recording is conducted by the recording head, to the heating and pressing means, wherein the apparatus has a transfer prevention liquid providing means for providing the transfer prevention liquid to prevent one portion of the recording medium or ink from transferring onto the contact surface of the recording medium of the heating and pressing means to the recording medium after recording and before heating and pressurizing.

Thereby, a portion of the recording medium or the ink is prevented from transferring onto the recording medium contact surface of the heating and pressing means, and it can be prevented that the contact surface with the recording medium is soiled and the image of the recording medium is soiled, and the heating and pressurizing performance is lowered, and the ink receiving layer of the recording medium can be always made transparent with good quality.

(2-12) An ink jet recording apparatus according to item 2-10 or 2-11, wherein the transfer prevention liquid includes silicone oil.

Thereby, the transfer onto the contact surface with the recording medium of the heating and pressing means can be surely prevented by the low cost and stable material.

(2-13) An ink jet recording apparatus having: a recording head to record by jetting the ink onto the recording medium having the ink receiving layer including the thermoplastic resin particle on the surface layer, and the pigment ink solvent absorbing layer adjoining the inside of the ink receiving layer; a heating and pressing means for heating and pressurizing the recording medium and for making the ink receiving layer of the recording medium transparent; a temperature control means for maintaining the temperature of the heating and pressing means within a predetermined temperature range; and a recording medium conveying means for conveying the recording medium on which recording is conducted by the recording head, to the heating and pressing means, wherein the apparatus has a gloss liquid providing means for providing the gloss liquid to provide the gloss to the recording medium to the recording medium contact surface of the heating and pressing means.

Thereby, in addition to making the recording medium surface transparent, the apparatus can provide the further gloss, and can form the higher quality image print.

(2-14) An ink jet recording apparatus having: a recording head to record by jetting the ink onto the recording medium having the ink receiving layer including the thermoplastic resin particle on the surface layer, and the pigment ink solvent absorbing layer adjoining the inside of the ink receiving layer; a heating and pressing means for heating and pressurizing the recording medium and for making the ink receiving layer of the recording medium transparent; a temperature control means for maintaining the temperature of the heating and pressing means within a predetermined temperature range; and a recording medium conveying means for conveying the recording medium on which recording is conducted by the recording head, to the heating and pressing means, wherein the apparatus has a gloss liquid providing means for providing the gloss liquid to provide the gloss to the recording medium to the recording medium after recording.

Thereby, in addition to making the recording medium surface transparent, the apparatus can provide the further gloss, and can form the higher quality image print.

(2-15) An ink jet recording apparatus according to items 2-13 or 2-14, wherein the apparatus has a control means for controlling whether the gloss liquid is provided, depending on the kind of recording media.

Thereby, the apparatus can automatically select only the recording medium of the kind to which the gloss is to be provided, and provide the gloss to it.

(2-16) An ink jet recording apparatus according to items 2-13 or 2-14, wherein the apparatus has the gloss liquid providing selection means for selecting whether the gloss liquid is to be provided.

Thereby, it can be freely selected depending on the purpose whether the gloss liquid is to be provided to the recording medium.

(2-17) An ink jet recording apparatus according to any one of items 2-13-2-16, wherein the gloss liquid includes silicon oil.

Thereby, the gloss can be surely provided onto the recording medium surface by the low cost and stable material.

(2-18) An ink jet recording apparatus having: a recording head to record by jetting the ink onto the recording medium having the ink receiving layer including the thermoplastic resin particle on the surface layer, and the pigment ink solvent absorbing layer adjoining the inside of the ink receiving layer; a heating and pressing means for heating and pressurizing the recording medium and for making the ink receiving layer of the recording medium transparent; a temperature control means for maintaining the temperature of the heating and pressing means within a predetermined temperature range; and a recording medium conveying means for conveying the recording medium on which recording is conducted by the recording head, to the heating and pressing means, wherein, when recording is not conducted for a predetermined time period, the temperature control by the temperature control means is stopped, and the heating of the heating and pressing means is stopped.

Thereby, the useless electric power consumption is suppressed and the saving of power consumption can be attained.

(2-19) An ink jet recording apparatus having: a recording head to record by jetting the ink onto the recording medium having the ink receiving layer including the thermoplastic resin particle on the surface layer, and the pigment ink solvent absorbing layer adjoining the inside of the ink receiving layer; a heating and pressing means for heating and pressurizing the recording medium and for making the ink receiving layer of the recording medium transparent; a temperature control means for maintaining the temperature of the heating and pressing means within a predetermined temperature range; and a recording medium conveying means for conveying the recording medium on which recording is conducted by the recording head, to the heating and pressing means, wherein, when the recording is not conducted for a predetermined time period, the heating and pressing means is maintained within the second temperature range which is lower than a predetermined temperature range.

Thereby, the saving of the power consumption can be attained, and because the heating and pressing means can be quickly heated when the heating and pressurizing processing is started, the heating and pressurizing processing can be restarted in a short time.

(2-20) An ink jet recording apparatus having: a recording head to record by jetting the ink onto the recording medium having the ink receiving layer including the thermoplastic resin particle on the surface layer, and the pigment ink solvent absorbing layer adjoining the inside of the ink receiving layer; a heating and pressing means for heating and pressurizing the recording medium and for making the ink receiving layer of the recording medium transparent; a temperature control means for maintaining the temperature of the heating and pressing means within a predetermined temperature range; and a recording medium conveying means for conveying the recording medium on which recording is conducted by the recording head, to the heating and pressing means, wherein, when the recording is not conducted for a predetermined time period, the heating and pressing means is maintained within the second temperature range which is lower than a predetermined temperature range, and further, when the recording is not conducted for a predetermined time period, the temperature control by the temperature control means is stopped, and the heat generation of the heating and pressing means is stopped.

Thereby, the useless power consumption for a long period of time is suppressed, and the saving of the power consumption can be attained, and when the image recording is restarted after the comparatively short time recording stop, because the heating and pressing means can be quickly heated, the heating and pressurizing processing can be restarted in a short time.

(2-21) An ink jet recording apparatus according to any one of items (2-18) to (2-20), wherein, after returning from the heat generation stop of the heating and pressing means or from the second temperature range, while the heating and pressing means reaches a range which is a range not smaller than the lowest processing temperature, and a predetermined temperature range, the heating and pressurizing time is relatively extended, and the heating and pressurizing processing of the recording medium is conducted.

Thereby, it is unnecessary to wait for the heating and pressing means to reach a predetermined temperature range, and the heating and pressurizing processing can be started in an earlier time period, and the increase of the speed of the image print formation can be attained so much.

(2-22) An ink jet recording apparatus according to item (21), wherein, when the heating and pressurizing time of the recording medium is extended, the recording time per unit time period in the recording medium conveying direction is relatively extended.

Thereby, the recording speed of the image by the recording head can be almost the same as the heating and pressurizing processing speed of the recording medium by the heating and pressing means, and it is unnecessary that a special recording medium accommodation means for making the recorded recording medium stand by is provided between the recording head and the heating and pressing means.

(2-23) An ink jet recording apparatus according to item (2-22), wherein the recording head is structured such that it conducts recording by the reciprocation scanning along the direction almost perpendicular to the conveying direction of the recording medium, and by adjusting the stop time when the movement direction of the recording head is reversed, the recording time per unit length in the recording medium conveying direction is prolonged.

Thereby, the drive frequency and scanning speed of the recording head are not changed at all and can be constant, and thereby, the ink injection characteristic of the recording head is stable, and the drive circuit and scanning drive system of the recording head can be simplified.

(2-24) An ink jet recording apparatus according to item (2-22), wherein the recording head is structured by a linear head in which the ink jetting nozzles are formed along the entire range of the width of the recording medium, and by adjusting the ink jet interval of the recording head, the recording time per unit length in the recording medium conveying direction is prolonged.

Generally, in the case of the linear head, because the ink jet interval is longer than the scanning type recording head, even when the linear head is changed so that its jetting period becomes long, there is an advantage that the change of the ink injection characteristic is small.

BRIEF DESCRIPTION OF THE DRAWINGS

FIGS. 4(*a*) and 4(*b*) each is a structural view showing another mode of the heating and pressing means.

FIG. 34(*a*) is a front view showing yet another example of the cooling means.

FIG. 34(*b*) is a perspective view showing yet another example of the cooling means.

FIG. 35(*a*) is a front view showing another example of the pressing means.

FIG. 35(*b*) is a front view showing yet another example of the pressing means.

FIG. 44(*b*) is a perspective view showing yet another example of the cooling means.

DETAILED DESCRIPTION OF THE PREFERRED EMBODIMENT

Embodiments of the present invention will be described below.

Figure 26:
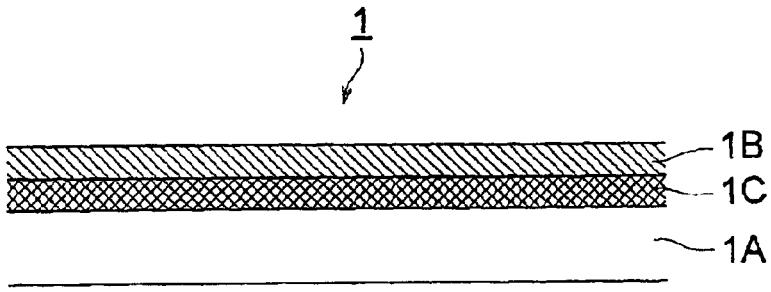
FIG. 26 is a sectional view showing a lamination layer structure of the recording medium.

A recording medium which is mainly used for an inkjet recording apparatus according to the present invention, as shown in FIG. 26, is structured in such a manner that it has an ink receiving layer 1B including a thermoplastic resin particle on a surface layer of a support material 1A, and has at least a pigment ink solvent absorption layer 1C, adjoining the ink receiving layer 1B, having a void layer in which the ink solvent component is absorbed after a color material and an ink solvent component are separated on the surface of the ink receiving layer 1B.

As the support material 1A, a support material which is conventionally used as the inkjet recording medium, can be used, and for example, the paper made support material such as a plain paper, art paper, coat paper, and cast coat paper, and further a plastic support material, a paper support material (RC paper or a resin-coated paper) whose both sides are coated by a resin such as polyolefin, and a composite support material in which these are adhered to each other, can be used.

As a thermoplastic resin particle included in the ink receiving layer 1B, for example, poly carbonate, poly acrylo nitrile, polystyrene, poly acrylic acid, poly metha acrylic acid, poly vinyl chloride, poly vinylidene chloride, polyvinyl acetate, polyester, polyamide, poly ether, and their copolymer, and their salt, are listed. The thermoplastic resin particle is appropriately selected in consideration of the ink acceptability, glossiness of the image after transferring by heating and pressurizing, and the image fastness and releasing property.

Relating to the ink acceptability, when the particle side of the thermoplastic resin particle is not larger than 0.05 $\mu$m, the separation speed of the pigment particle in the pigment ink and the ink solvent becomes low, and the ink absorption speed is lowered. Further, when it exceeds 10 $\mu$m, it is not preferable from the point of the adherence to the pigment ink solvent absorption layer 1C adjacent to the ink receiving layer 1B when it is coated onto the support material, and the coating film strength of the recording medium after the drying of the coating. Therefore, as the preferable thermoplastic resin particle, it is preferably 0.05–10 $\mu$m, and more preferably, 0.1–5 $\mu$m.

The thermoplastic resin particle forming the outmost layer exists in the dispersing condition in the solvent such as water, before coating drying. In the case of single thermoplastic resin particle in which there is no fluctuation in the dispersed particle sizes, the particle is subjected to hexagonal closest packing in the drying after coating, and the single particle layer is formed, and the percentage of void at the case is about 26%. However, normally, the thermoplastic resin particle has the poly-dispersibility, and the percentage of void changes depending on the flocculation condition of the thermoplastic rein particles each other. Further, the formed void diameter is depending on the particle diameter of the thermoplastic resin particle.

Further, as the coating film thickness on the support material 1A, 0.1–10 $\mu$m is preferable, and more preferably, 0.5–7 $\mu$m.

As the reference of selection of the thermoplastic resin particle, the glass transition point (Tg) is listed. When Tg is lower than the coating drying temperature, for example, the cating drying temperature at the time of recording medium production is already higher than Tg, the void by the thermoplastic fine particle for the ink solvent passes vanishes. Further, when Tg is more than the temperature at which Tg is degenerated by the heat of the support material 1A, because, after the ink jet recording by the pigment ink, the thermoplastic resin particle is melted and the film is formed, the fixing operation at the high temperature is necessary, and the load on the apparatus and the thermal stability of the support material 1A become a problem. Preferable Tg of the thermostatic resin particle is 50–150° C., and as described later, in the temperature control in the heating and pressing means of the ink jet recording apparatus, this Tg is a target temperature range.

After the image formation, it is necessary that the image deterioration by the aging conservation of the recording image is suppressed as much as possible. When the pigment ink is used, it is not necessary to wary about the density lowering and discoloration in the relatively short period of time as the dye ink, however, from a view point to suppress the yellowing (separation) by the UV light of the no-printing portion, it is necessary to select the thermoplastic resin particle.

It is necessary that the pigment ink solvent absorption layer 1C adjacent to the ink receiving layer 1B of the outermost layer has the absorption power of the pigment ink solvent, and it is exhibited when the inorganic solid fine particle (hereinafter, simply called inorganic fine particle) is included in the solvent absorption layer of the pigment ink.

As the inorganic fine particle to be used for the above purpose, for example, a white inorganic pigment such as precipitated calcium carbonate, heavy calcium carbonate, magnesium carbonate, kaolin, clay, talc, calcium sulfate, barium sulfate, titan dioxide, zinc oxide, zinc hydro oxide, zinc sulfide, zinc carbonate, hydrotalcite, alminium silicate, diatom earth, calcium silicate, magnesium silicate, composite amorphous silica, colloidal silica, alumina, colloidal almina, pseudo-boehmite, alminium hydro oxide, lithopone, zeolite, magnesium hydro oxide, is listed.

The average particle size of the inorganic fine particles is obtained in such a manner that the fine particle itself or the fine particle appeared on a cross section or the surface of the void type pigment ink solvent absorption layer is observed by the electronic microscope, and the average particle size of the 100 arbitrary particles is found, and the average particle size is found as their simple average value (average of number of pieces). Herein, the particle size of each inorganic fine particle is a value which is expressed by the diameter when the circle equal to its projected area is supposed.

When considered from the view point in which the high density image is formed, a sharp image is recorded, and it can be produced in the low cost, as the inorganic solid fine particle, it is preferable that the inorganic solid fine particle selected from fine particle silica composed by the vapor phase method, colloidal silica and alumina, or alumina hydrate, is used. Alumina or alumina hydrate may be crystalline or amorphous, and further, an arbitrary shape one such as undefined particle, spherical particle, or needle particle, can be used. Presently, the fine particle silica composed by such the vapor phase method, is brought into market, and in the fine particle silica sold in the market, there are each kind of aerosols made by Nippon Aerosil Co.

Although there is specially no limitation in the average particle diameter of the inorganic fine particle, it is preferable that it is not larger than 100 nm, and the most preferable average particle diameter to form the void layer is different depending on the compound. For example, in the case of the silica of the vapor phase method, the particle in which the average particle diameter of the primary particle (the particle diameter in the dispersed liquid condition before coating) of the inorganic fine particle dispersed in the condition of the primary particle, is 4–20 nm, can be most preferably used.

As the pigment ink solvent absorption layer IC, the above inorganic fine particles are used, and other than this, for example, a blended liquid of each kind of hydrophilic resins disclosed in Japanese Tokkaisho No. 59-148583, No. 55-51583, and No. 58-72429, and silica, or urethane resin emulsion containing alkylen oxide disclosed in Japanese Tokkaihei No. 9-150574, No. 10-181189, or containing poly carbonate, can be used.

Further, other than a case that the pigment ink solvent absorption layer is formed by using the inorganic fine particles, the pigment ink solvent absorption layer 1C may be formed in such a manner that polyurethane resin emulsion, and a water soluble epoxy compound and/or aceto acetylated polyvinyl alcohol are used together, and further, a coating liquid in which epichlorohydrine poly amide resin is used together, is used.

As polyurethane resin emulsion in this case, polyurethane resin emulsion in which the diameter of the particle having the poly carbonate chain, the poly carbonate chain and poly ester chain, is 3.0 $\mu$m, is preferable, and it is further preferable that the poly urethane resin obtained when poly urethane resin of the poly urethane resin emulsion has poly carbonate polyole, and the poly urethane resin obtained by the reaction of polyole having the poly carbonate polyole and polyester polyole with aliphatic isocyanate compound, has sulfonic group in the molecule, and further, has epichlorohydrine poly amide resin, and water soluble epoxy compound and/or aceto acetylated vinyl alcohol.

The pigment ink solvent absorption layer 1C using the poly urethane resin is presumed that the weak flocculation of cation and anion is formed, and following this, a void having the pigment ink solvent absorption power is formed, and thereby the image can be formed.

In the ink receiving layer 1B of the recording medium 1 and the pigment ink solvent absorption layer 1C, it is preferable that the whole amount of the void (void capacity) is not smaller than 20 ml per recording sheet 1 $m^2$. In the case where the void capacity is not larger than 20 $ml/m^2$, when the ink amount at the printing time is not larger than 1 $ml/m^2$, although the ink absorptivity is good, when the ink amount exceeds 40 $ml/m^2$, a problem is easily generated that the ink is not perfectly absorbed, and the image quality is lowered, and the drying property is late.

Although the upper limit of the void capacity is not specifically limited, because it is necessary in order not to worsen the physical characteristic of the coating film, such as clacking, that the film thickness of the void type ink absorption layer is normally not larger than 50 $\mu$m, and from this point, it is difficult to make the void capacity more than 40 $ml/M^2$. The void capacity is, when it is measured by J.TAPPI paper pulp testing method No. 51-87 liquid absorptivity testing method (Bristol method) of paper or paper board, expressed by the liquid transition amount ($ml/m^2$) at the absorption time 2 sec. In this connection, in the above measuring method, the pure water (ion exchange water) is used in the measurement, however, in order to make the judgement of the measuring area easy, the water soluble dye not larger than 2% may be contained.

At the time of coating of the recording medium, thickener may be used for increasing the coating property. As a coating method, other than a bar coater, roll coater, applicator, or spinner, from the point of view for increasing the production efficiency, when more than 2 kind of layers are simultaneously coated, extrusion coating and curtain coating are specially effective.

As silicon emulsion or water soluble silicon compound which is preferably contained in the ink receiving layer 1B, for example, dimethyl siloxane compound in which the functional group of siloxane is methyl and which is general as the mold releasing agent, and further, in the compound, as the substitutional group, the compound into which vinyl group, hydrogen atom, mercaptal group, acrylic group, amino group, or phenyl group is introduced, is listed. Further, as a content, it is preferable that, to the thermoplastic resin particle of 100, the mass ratio is not larger than 1%. When the addition amount is more than 1%, the mold releasing property is increased, however, the color unevenness presumed that it is due to the unevenness of the transferring by the heating and pressurizing, is generated, which is not preferable.

Figure 1:
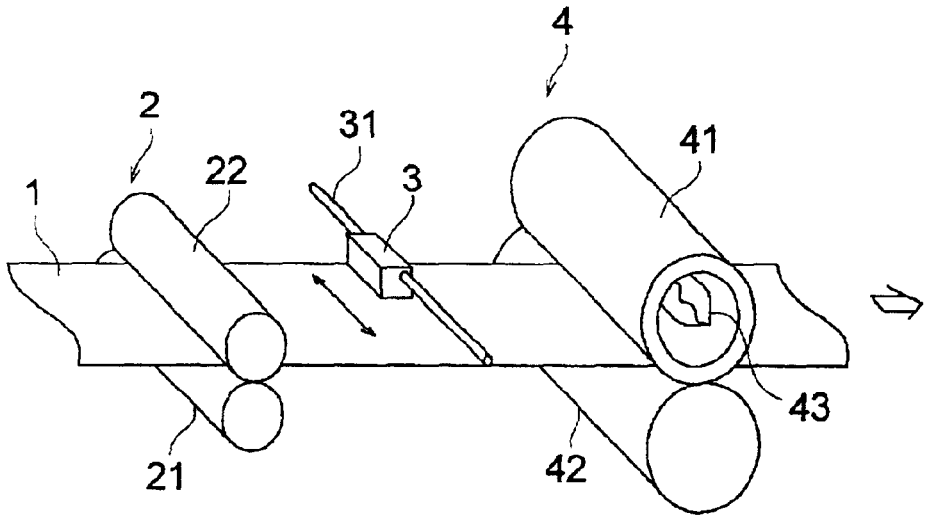
FIG. 1 is an outline structural view of an ink jet recording apparatus.

FIG. 1 is an outline structural view of an ink jet recording apparatus according to the present invention.

The recording medium 1 is supplied by the supply means, not shown, and conveyed to the right direction shown in the drawing by the recording medium conveying means 2 (hereinafter, simply called conveying means), and by the recording head 3, arranged in the downstream side of the conveying means 2, a predetermined image is recorded and formed on the recording surface of the recording medium 1.

The recording medium 1 is, in the example shown by the drawing, an example in which a long length roll paper which is wound roll like, is used, is shown, however, not limited to this, but may be a sheet-like recording medium which is cut into an appropriate size.

The conveying means 2 is structured by having a conveying roller 21 which is rotation driven by a drive means, not shown, and a driven roller 22 to sandwich the recording medium 1 between the conveying roller 21 and it, and under the condition that the recording medium 1 is sandwiched between the conveying roller 21 and driven roller 22, by the rotation drive of the conveying roller 21, corresponding to the image recording by the recording head 3, which will be described later, the recording medium 1 is conveyed by a predetermined amount to the right direction (sub scanning direction) shown by the drawing.

The recording head 3 is a reciprocating scanning type recording head which is arranged in the downstream side of the conveying means 2, and movably attached to a scanning guide 31 provided such that it is almost perpendicular to the conveying direction of the recording medium 1, extending over the width direction of the recording medium 1, and is structured so that it can move in the main scanning direction.

The recording head 3 has a plurality of ink tanks in which a pigment ink of each color such as Y (yellow), M (magenta), C (cyan), K (black), is stored, and while conducting the main scanning movement along the scanning guide 31, by jetting a predetermined ink at a predetermined timing corresponding to the image data, the recording head 3 cooperates with the conveyance of the recording medium 1 by the conveying means 2, and records and forms a predetermined image on the recording surface of the recording medium 1.

As the pigment ink, the conventionally known organic and inorganic pigment can be used. For example, an azo pigment such as azo lake, insoluble azo pigment, condensation azo pigment, or chelate azo pigment, a polycyclic pigment such as phthaloyanine, perylene pigment, anthraquinone pigment, quinacridone pigment, dioxanezine pigment, thioindigo pigment, isoindolinone pigment, or quinophthalone pigment, a dye lake such as basic dye type lake, acidic dye type lake, an organic pigment, such as nitro pigment, a nitroso pigment, aniline black, daylight fluorescent pigment, or an inorganic pigment such as carbon black, are listed.

The specific organic pigment will be listed below.

As the pigment for magenta or red, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 22, C.I. pigment red 123, C.I. pigment red 139, C.I. pigment red 144, C.I. pigment red 149, C.I. pigment red 166, C.I. pigment red 177, C.I. pigment red 178, and C.I. pigment red 222, are listed.

As the pigment for orange or yellow, C.I. pigment orange 31, C.I. pigment orange 43, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, and C.I. pigment yellow 138, are listed.

As the pigment for green or cyan, C.I. pigment blue 15, C.I. pigment blue 15:2, C.I. pigment blue 15:3, C.I. pigment blue 16, and C.I. pigment blue 60, C.I. pigment green 7, are listed.

On the opposite side of the recording head 3, sandwiching the recording medium 1, a recording medium holding portion 32 is arranged, and by a absorption means, not shown, the recording medium 1 is absorbed and held onto the surface, and prevents the recording medium 1 from floating when the image is recorded and formed on the recording surface of the recording medium 1 by the magnetic head 3.

The heating and pressing means 4 is arranged in the downstream side of the recording head 3 so that it conducts the heating and pressurizing onto the recording medium 1 after the image is recorded and formed by the recording head 3, and is structured by having a heating roller 41 and a pressurizing roller 42 to sandwich the recording medium 1 between the heating roller 41 and the pressurizing roller 42.

Figure 2:
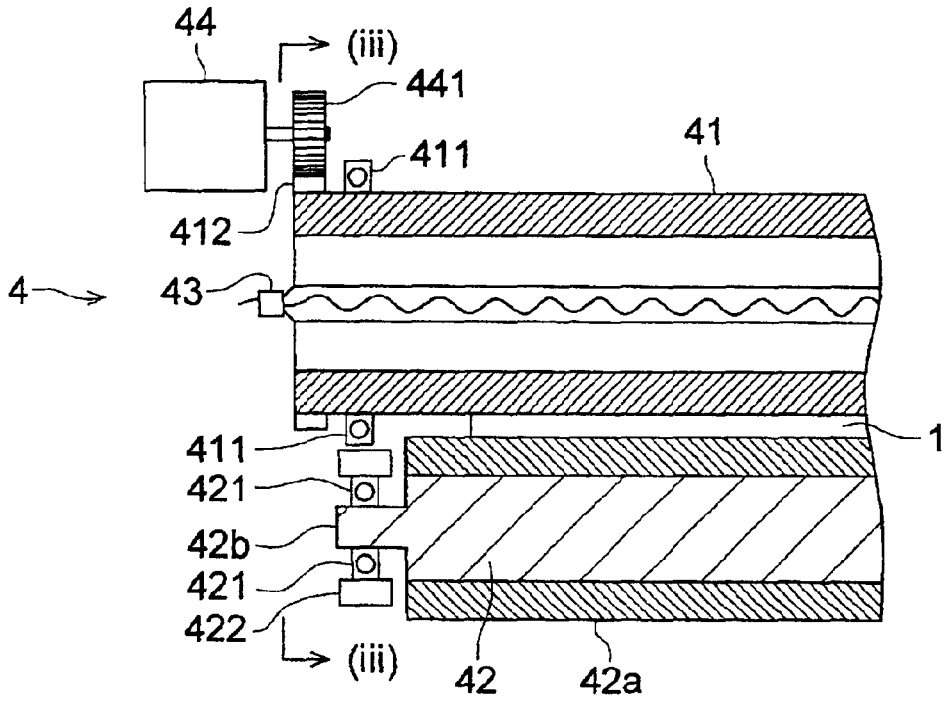
FIG. 2 is a partial sectional view of a heating and pressing means.

As shown in FIG. 2, the heating roller 41 is composed of a hollow roller, in which a heating body 43 such as a halogen lamp heater which is a heat source, is housed along the axial direction of the roller, and by the heat of the heating body 43, the heating roller 41 is heated, and the thermoplastic resin particles included in the ink receiving layer of the recording medium 1, are fused. A gear 412 is formed on the periphery of the end portion of the heating roller 41, and when it is engaged with a gear 441 attached to a drive motor 44, the drive force of the drive motor 44 is transmitted, and the roller is rotated in a predetermined direction. The numeral 411 shows a bearing.

The heating roller 41 is preferably formed of the material having high thermal conductivity so as to effectively heat the recording medium 1 by the heat generated from the heating body 43, and a metallic roller is preferably used. It is preferable that fluorine resin coating is conducted on the surface to prevent the contamination due to the ink when the recording medium 1 is heated and pressurized. Other than that, a silicon rubber roller on which heat resistance silicon rubber is coated, may be used.

A temperature sensor 5 is arranged close to the surface of the heating roller 41, and when the temperature of the heating roller 41 is detected by the temperature sensor 5, the heat generation amount of the heating body 43 is controlled by the temperature control means, not shown, and it is controlled that the temperature of the heating roller 41 is maintained within a predetermined temperature range.

Figure 3:
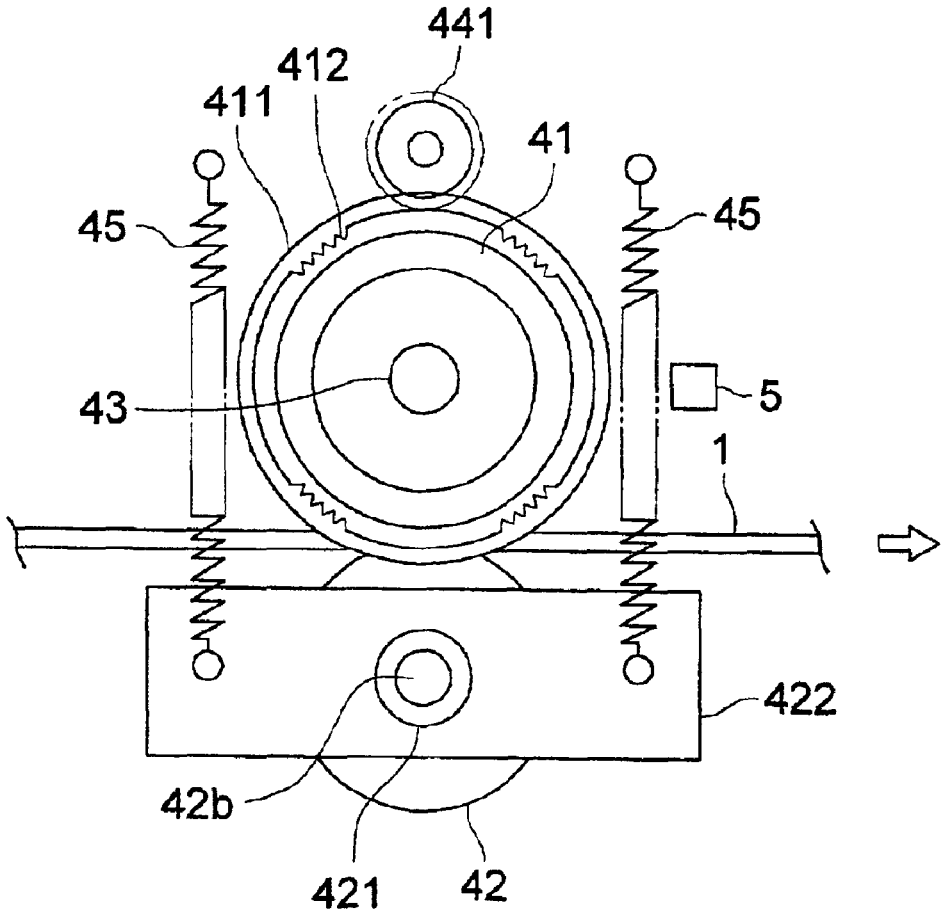
FIG. 3 is a sectional view along (iii)—(iii) line in FIG. 2.

The pressurizing roller 42 is composed of a metallic roller such as stainless steal on which a rubber coating 42*a* having elasticity is conducted on the outer periphery, and as shown in FIG. 3, the roller shafts 42*b* on its both ends are respectively attached to and supported by a supporting frame 422 through bearings 421. The supporting frame 422 is urged by urging members 45 and 45 so that the pressurizing roller 42 contact pressures the heating roller 41 with the recording medium 1 between them, by a predetermined pressurizing force, such that the pressuring roller 42 pressures the recording medium 1 onto the heating roller 41. In the example in the drawing, by the urging members 45 and 45, the pressurizing roller 42 is urged in the direction pulled to the heating roller 41 side, however, the urging members may be provided in such a manner that the pressuring roller 42 is urged in the direction to be pressurized to the heating roller 41 side. Further, as the urging members 45 and 45, other than a coil spring or leaf spring, a member which can urge the pressurizing roller 42 to the heating roller 41 side by a predetermined spring force, may be arbitrarily used.

The recording medium 1 on which a predetermined image is recorded and formed by the recording head 3, is conveyed to the heating and pressing means 4 by the conveying means 2. In the heating and pressing means 4, the recording medium 1 is sandwiched between the heating roller 41 and the pressurizing roller 42, and by the rotation of the heating roller 41, while the recording medium 1 is conveyed at a predetermined speed, the recording medium 1 is heated and pressurized in its process, and the plastic resin particles in the ink recepter layer on the surface layer are fused and smoothed, and are made transparent.

In the present example, the heating and pressurizing time of the recording medium 1 by the heating and pressing means 4 is 0.1–2 sec. When the heating and pressurizing time of the recording medium 1 is within this range, the heating and pressurizing processing sufficiently necessary for making the ink receiving layer of the recording medium 1 transparent can be conducted, and is effective for the good quality image print formation. In order to make the heating and pressurizing time by the heating and pressing means 4 within the above range, it can be conducted by appropriately adjusting the number of rotation of the heating roller 41.

In the present example, the pressurizing roller 42 has a rubber coating 42*a* having the elasticity on its surface (recording medium contact surface), thereby, a nip area formed between the heating roller 41 and it, is formed with a certain degree of width. When the modulus of longitudinal elasticity (Young's modulus) of the rubber coating 42*a* which is the recording medium contact surface of the pressurizing roller 42, is $10^6$–107 Pa, preferably, $1.0\times10^6$–$4.0\times10_6$ Pa, the heating roller 41 and pressurizing roller 42 can be brought into pressurizing contact with each other with a large contact area, and the adequate pressurizing force and pressurizing time can be obtained with the simple structure.

In this connection, when the heat resistance silicon rubber is coated on the outer periphery of the heating roller 41 instead of the pressurizing roller 42, it may have the modulus of longitudinal elasticity (Young's modulus) within the above range, and further, these rollers may be structured such that both of the heating roller 41 and the pressurizing roller 42 have the modulus of longitudinal elasticity (Young's modulus) within the above range. In a word, when it is structured in such a manner that the recording medium contact surface of at least one of 2 rollers 41 and 42 has the modulus of longitudinal elasticity (Young's modulus) within the above range, it is allowable.

Further, in the present invention, when the heating and pressurizing time of the recording medium 1 is changed corresponding to the kind of the recording media 1, the optimum heating and pressurizing processing can be respectively conducted for various recording media 1, thereby, it is effective for the good quality print formation.

Herein, as the kind of recording media, the kind of materials of support material of the recording media, the kind of the thickness of the support material, the kind of thermoplastic resin particles included in the ink receiving layer of the recording media, and the kind of texture (silk finish, gloss finish) of the recording medium surface, are listed.

Further, in the present invention, corresponding to the above kind of recording media 1, the maintained temperature range of the heating and pressing means 4 may be changed, and thereby, in the same manner, the optimum heating and pressurizing processing can be respectively conducted on various recording media 1, and it is effective for the good quality image print formation.

Figure 5:
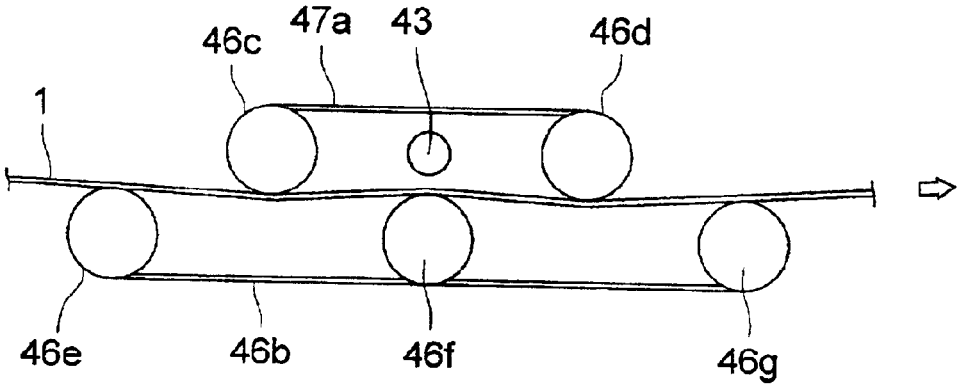
FIG. 5 is a structural view showing further other mode of the heating and pressing means.

In FIG. 4 and FIG. 5, another mode of the heating and pressing means 4 will be shown.

In FIG. 4(*a*), the heating roller 41 is the same as the mode shown in FIGS. 1–3, however, instead of the structure of the pressurizing roller 42 to pressurize the recording medium 1 between the heating roller 41 and it, it is structured by a belt member 47 stretched between 2 rollers 46*a* and 46*b* which are opposite to each other, with the recording medium 1 between the heating roller 41 and it.

In this mode, the belt member 47 is stretched between both rollers 46*a* and 46*b* by a predetermined tension, and when the belt member 47 is brought into pressure contact with the heating roller 41, the recording medium 1 is sandwiched between both, and simultaneously pressurized, and by the rotation of the heating roller 41, is conveyed in the right direction shown in the drawing.

As the material of the belt member 47, the metallic member such as stainless steel or elastic member such as silicon rubber, can be used.

According to this mode, because the heating roller 41 and the belt member 47 are in surface contact with each other, the adequate pressurizing force and pressurizing time can also be obtained specially at the high speed processing. Further, when the arrangement of each of rollers 46*a* and 46*b* or the tension of the belt member 47 is adjusted, the contact area of the heating roller 41 with the belt member 47 and pressurizing force can be easily adjusted.

Further, in FIG. 4(*b*), the pressurizing roller 42 is the same as the mode shown in FIGS. 1–3, and the belt member 47 is used instead of the heating roller 41. The heating body 43 is arranged inside the belt member 47 and the directly heats the belt member 47, however, each of rollers 46*a* and 46*b* to suspend the belt member 47 is made hollow, and the heating bodies 43 are housed in each of rollers 46*a* and 46*b*, and the rollers 46*a* and 46*b* may be heated.

In this connection, rollers to stretch the belt member 47 is not limited to 2 rollers, but, may be more than 3 rollers.

FIG. 5 shows the mode in which the heating and pressing means 4 is structured by 2 belt members 47*a* and 47*b* which are opposite to each other, sandwiching the recording medium 1 between them, and roller group (46*c*–46*g*) to stretch the belt members 47*a* and 47*b*.

The belt member 47*a* is stretched between 2 rollers 46*a* and 46*d*, by a predetermined tension, and inside of them, the heating body 43 is arranged. By this heating body 43, the belt member 47*a* is heated.

On the one hand, the belt member 47*b* is arranged in such a manner that it is opposite to the belt member 47*a* sandwiching the recording medium 1 between them, and is stretched extending over 3 rollers 46*e*, 46*f*, and 46*g* by a predetermined tension. In this connection, the rollers 46*c* and 46*d*are respectively positioned between the rollers 46*e* and 46*f*, and between rollers 46*f* and 46*g*.

In this mode, the recording medium 1 is sandwiched between belt members 47*a* and 47*b*, and the rollers 46*c* and 46*d* are rotated by a drive means, not shown, and when the belt member 47*a* is driven counterclockwise, the recording medium 1 is conveyed in the right direction shown by the drawing. The belt members 47*a* and 47*b* are opposite to each other in the condition of the contact pressure, and during the process in which the recording medium 1 is sandwiched between both belt members 47*a* and 47*b*, and conveyed, it is heated and simultaneously pressurized.

Even in this mode, because the belt members 47*a* and 47*b* are brought into surface contact, the adequate pressurizing force and the pressurizing time can be obtained specially even at the high speed processing. Further, when the arrangement of each of rollers 46*c*–46*g* or tension of each of belt members are adjusted, the contact area of both belt members 47*a* and 47*b* and the pressurizing force can be easily adjusted. Further, there is also an advantage in which, when the arrangement of each of rollers 46*c*–46*g* is changed, the degree of freedom of the design according to the conveying direction of the recording medium is higher than the mode in FIG. 1–FIG. 3 and FIG. 4, and it is effective for the size reduction of the apparatus and the increase of the operability.

In the present invention, it is preferable that the pressurizing force of the recording medium 1 by the heating and pressing means 4, is $9.8\times10^{4-4.9\times106}$ Pa. When the pressurizing force is out of the above range to the higher or lower side, it is difficult to obtain the sufficiently necessary pressuring force for finely making the ink receiving layer of the recording medium 1 transparent. In this connection, the pressuring force can be measured by sandwiching the pressure sensing sheet in the pressurizing and heating means 4 and pressurizing it, and by converting the pressure from the coloring degree of the pressure sensing sheet. Incidentally, even in the case that the heating and pressing means is constructed by two belt members, as stated above, it may be possible to obtain an excellent image print by changing a heating and pressing time period in accordance with a kind of the recording medium or by changing a set range of keeping temperature.

Figure 6:
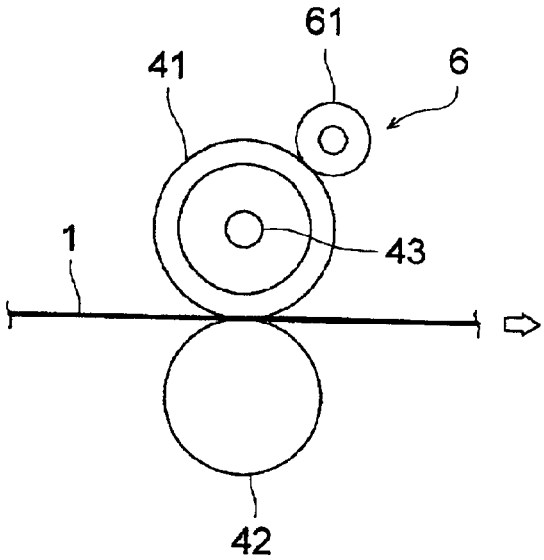
FIG. 6 is a structural view showing a cleaning means.
Figure 7:
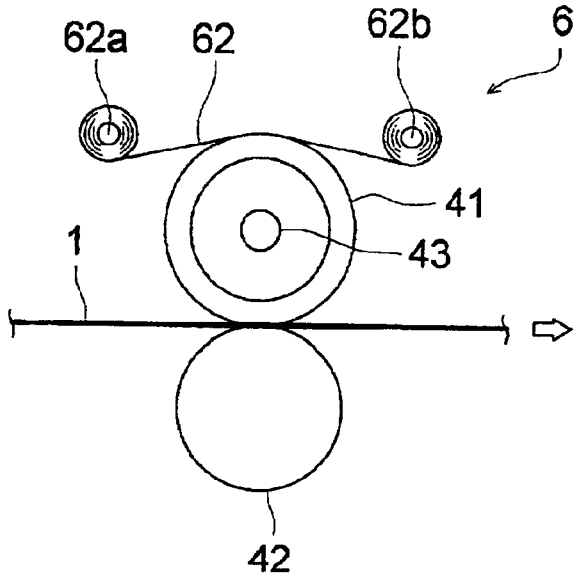
FIG. 7 is a structural view showing another mode of a cleaning means.

FIG. 6 and FIG. 7 show a structure of a cleaning means 6 for cleaning the recording medium contact surface of the heating and pressing means 4.

FIG. 6 shows an example in which a cleaning roller 61 is provided on the recording medium contact surface of the outer peripheral surface of the heating roller 41 of the heating and pressing means 4.

The cleaning roller 61 is composed of a sponge roller structured by surrounding the sponge on the outer periphery of the rotation shaft, and extends in parallel to the heating roller 41 and is arranged detachably. This cleaning roller 61 is not rotated normally, and its sponge surface is in contact with the recording medium contact surface of the heating roller 41, and when the heating roller 41 is rotated, the sponge surface slidingly contacts with the recording medium contact surface, and wipes off a stain of the recording medium contact surface.

A rotation drive means, not shown, is provided to the cleaning roller 61, and for example, when the number of processed recording media 1 becomes a predetermined processing amount, it is drive controlled in such a manner that it is rotated by a predetermined angle (for example, 5°), and the recording medium contact surface of the heating roller 41 can be cleaned by a new surface of the cleaning roller 61 surface. When it is rotated by a predetermined amount, and the whole of the cleaning roller 61 surface is stained, it is detached and replaced with a new article for each sponge surface and cleaning roller 61.

FIG. 7 shows an example in which a cleaning belt 62 is provided on the recording media contact surface of the outer peripheral surface of the heating roller 41 of the heating and pressing means 4.

The cleaning belt 62 is formed by a non-woven fabric into at least almost the same width as the recording medium contact surface of the heating roller 41, and stretched between 2 wind up rollers 62*a* and 62*b*, and it is structured in such a manner that it is fed from one roller 62*a* or 62*b* and can be wound up by a rotation drive means, not shown, onto the other roller 62*b* or 62*a*.

The cleaning belt 62 is arranged in such a manner that it is brought into contact with the recording medium contact surface of the heating roller 41 under the condition that it is stretched between both wind up rollers 62*a* and 62*b*, and normally, both wind up rollers 62*a* and 62*b* are not rotated, and when the heating roller 41 is rotated, it slidingly contacts with the recording medium surface, and the stain of the recording medium surface is wiped off. Then, it is structured in such a manner that, for example, when the number of processed recording media 1 becomes a predetermined processing amount, the wind up roller 62*a* or 62*b* are drive controlled so that it is rotated by a predetermined amount, and a new surface of the cleaning belt 62 can clean the recording medium contact surface of the heating roller 41. When whole cleaning belt 62 is wound up, it is removed and replaced with a new article.

As described above, when the cleaning means 6 is provided to the heating and pressing means 4, it can be prevented that the contact surface with the recording medium 1 is stained and the image is stained, or the heating and pressurizing performance is lowered, and it can be attained that the ink receiving layer of the recording medium 1 is always made transparent with good quality. Incidentally, it may be possible to provide the cleaning means 6 such as a cleaning roller 61 and a cleaning belt 62 onto the heating and pressing means constructed by two belt members. In this case, by providing the cleaning means 6 so as to come in contact with the outer peripheral surface of the belt member as a position opposite to a roller around which the belt member is stretched, it may be possible to enhance the cleaning effect.

Figure 8:
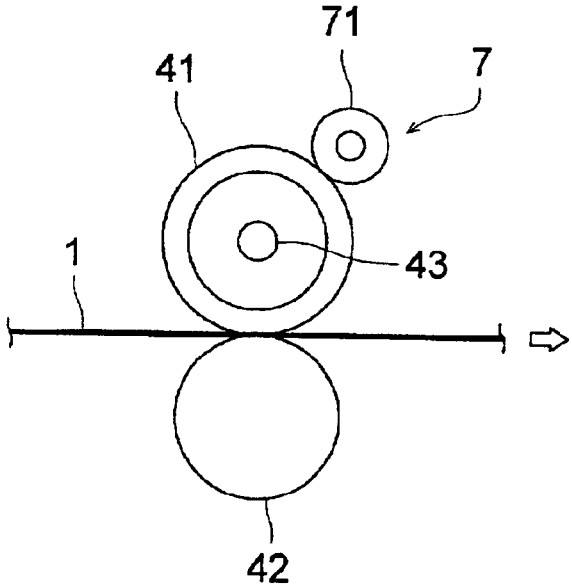
FIG. 8 is a structural view showing a transfer prevention liquid providing means.
Figure 9:
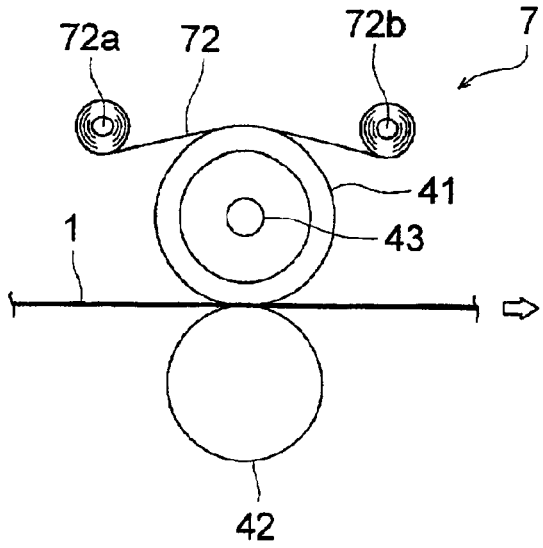
FIG. 9 is a structural view showing another mode of the transfer prevention liquid providing means.
Figure 10:
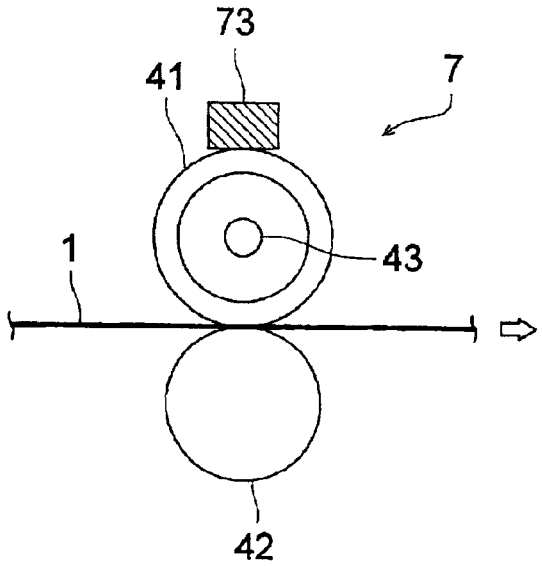
FIG. 10 is a structural view showing further other mode of the transfer prevention liquid providing means.

FIG. 8–FIG. 10 show the structure of the transferring prevention liquid providing means.

The transferring prevention liquid providing means shown in these drawings, provides the transferring prevention liquid to prevent the ink coated on the recording medium 1 surface from transferring onto the recording medium contact surface of the heating and pressing means 4, from a portion of the recording medium 1 (for example, thermoplastic resin particle included in the ink receiving layer) or from the recording head 3, onto the recording medium contact surface.

As the transferring prevention liquid, it is preferable that the silicon oil is included. The silicon oil is a stable material although its cost is low, and the stain on the recording medium contact surface can be surely prevented.

In the mode shown in FIG. 8, it is structured in such a manner that a coating roller 71 formed of a sponge roller in which the transferring prevention liquid is impregnated, is arranged so that it is brought into contact with the outer peripheral surface which is the recording medium contact surface of the heating roller 41, and the transferring prevention liquid impregnated in the coating roller 71 is coated on the recording medium contact surface by the rotation of the heating roller 41. To the coating roller 71, a rotation drive means (not shown) is provided, and for example, at every time when the number of processed sheets becomes a predetermined amount, the coating roller 71 is rotated by each predetermined angle, and the transferring prevention liquid can be coated by a new surface of the coating roller 71. The coating roller 71 is detachably structured, and when the impregnated transferring prevention liquid is consumed, the roller 71 is replaced with a new article.

In the mode shown in FIG. 9, the transferring prevention liquid is impregnated in the coating belt 72 formed of the non-woven fabric stretched between 2 wind up rollers 72*a* and 72*b*, and the coating belt 72 is brought into contact with the recording medium contact surface of the heating roller 41, and the transferring prevention liquid impregnated in the coating belt 72 is coated on the recording medium contact surface by the rotation drive of the heating roller 41. The rotation drive means (not shown) is provided to the wind up roller 72*a* or 72*b*, and the roller is rotated by each predetermined amount every time when, for example, the processing number of sheets becomes a predetermined amount, and the area on which the transferring prevention liquid has been coated, is wound up, and the transferring prevention liquid can be coated by a new surface of the coating belt 72. When the coating belt 72 has been wound up, it is replaced with the new article.

In the mode shown in FIG. 10, a coating pad 73 formed of the non-woven fabric in which the transferring prevention liquid is impregnated, is brought into contact with the recording medium contact surface of the heating roller 41, and by the rotation of the heating roller 41, the transferring prevention liquid impregnated in the coating pad 73 is coated on the recording medium contact surface. The coating pad 73 is detachably structured, and when the impregnated transferring prevention liquid has been consumed, it is replaced with a new article.

As described above, when the transferring prevention liquid providing means 7 to provide the transferring prevention liquid on the recording medium contact surface of the heating and pressing means 4 is provided, a portion of the recording medium 1 or the ink is prevented from transferring onto the recording medium contact surface of the heating and pressing means 4, and it can be prevented that the image of the recording medium is stained, or the heating and pressurizing performance is lowered, and it is possible that the ink receiving layer of the recording medium 1 is always made transparent with good quality. Incidentally, without limiting to the present example, it may constructed such that the transfer preventing liquid is provided from the transfer preventing liquid providing means 7 such as a coating roller 71, a coating belt 72 and a coating pad onto an outer peripheral surface of a belt member of the heating and pressing means constructed by the belt member.

Figure 11:
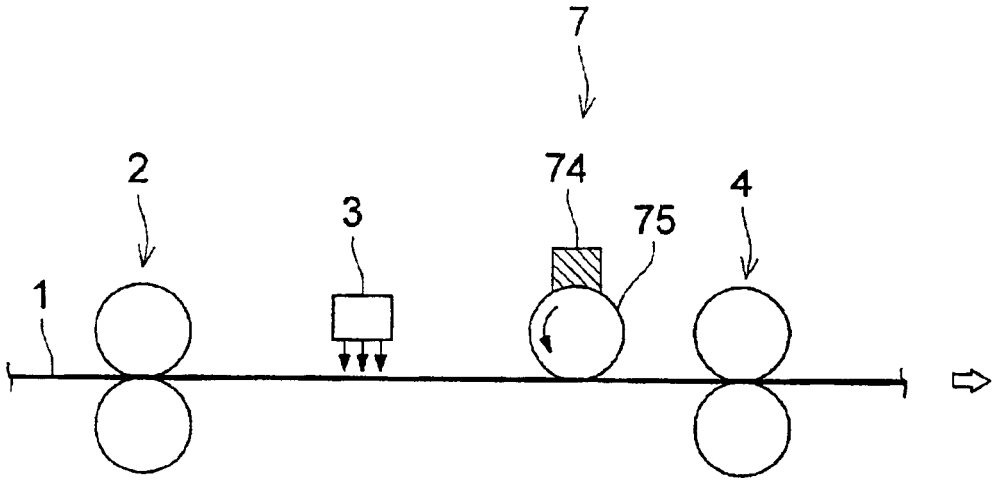
FIG. 11 is a structural view showing yet further other mode of the transfer prevention liquid providing means.

FIG. 11 shows yet another mode of the transferring prevention liquid providing means 7.

The transferring prevention liquid providing means 7 shown in this mode, is arranged on the downstream side of the recording head 3 and the upstream side of the heating and pressing means 4 (not limited to the paired roller construction), not on the recording medium contact surface of the heating and pressing means 4, and the transferring prevention liquid is provided to the recording medium 1 after the image recording by the recording head 3 and before the heating and pressurizing processing by the heating and pressing means 4.

The transferring prevention liquid is impregnated in the same coating pad 74 as in the mode shown in FIG. 10, and. is in contact with the surface of the coating roller 75 arranged so that it is in contact with the recording surface of the recording medium 1 after the image is recorded and formed by the recording head 3. Thereby, the transferring prevention liquid impregnated in the coating pad 74 through the coating roller 75 is coated on the recording surface of the recording medium 1.

As described above, when the transferring prevention liquid providing means 7 is provided in such a manner that the transferring prevention liquid is provided to the recording medium 1 after the image recording by the recording head and before the heating and pressurizing processing by the heating and pressing means 4, in the same manner as above, a portion of the recording medium 1 or the ink is prevented from transferring onto the recording medium contact surface of the heating and pressing means 4, and it is effective because it can be prevented that the image of the recording medium is stained, or the heating and pressurizing performance is lowered, and it is possible that the ink receiving layer of the recording medium 1 is always made transparent with good quality.

In this connection, in FIG. 11, an example in which the transferring prevention liquid is impregnated in the coating pad 74, is described, and a case in which the transferring prevention liquid is respectively impregnated in the coating roller 71 formed of the sponge roller shown in FIG. 8, or in the coating belt 72 shown in FIG. 9, and those coating roller 71 or coating belt 72 are brought into contact with the recording medium 1 through the coating roller 75 as shown in FIG. 11, or directly brought into contact with the recording medium 1, thereby, the transferring prevention liquid may be provided onto the recording medium 1.

Figure 12:
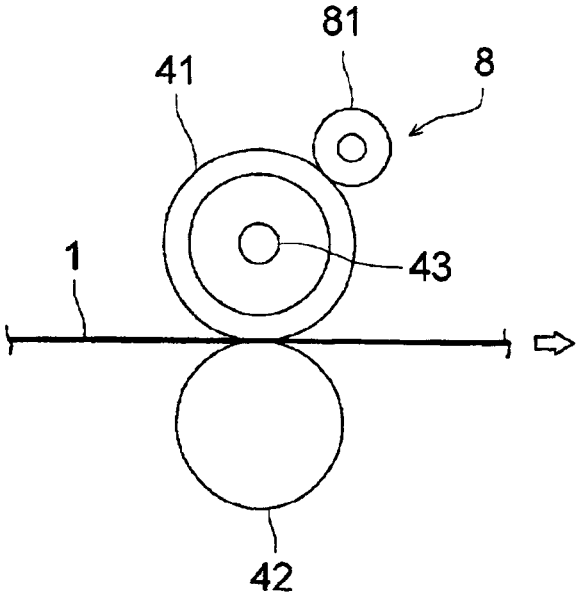
FIG. 12 is a structural view showing a gloss liquid providing means.
Figure 13:
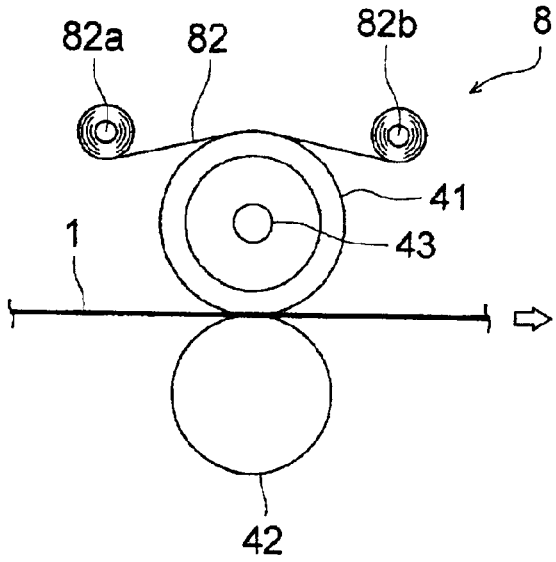
FIG. 13 is a structural view showing another mode of a gloss liquid providing means.
Figure 14:
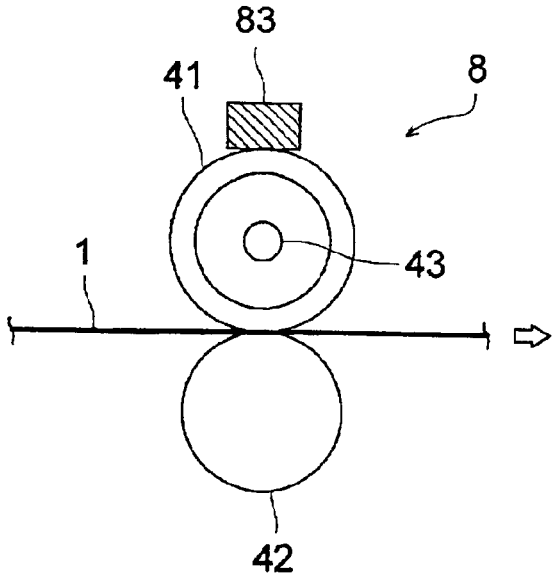
FIG. 14 is a structural view showing further other mode of a gloss liquid providing means.

FIG. 12–FIG. 14 show the structure of a gloss liquid providing means.

A gloss liquid providing means 8 shown in these views provides the gloss liquid to provide the gloss onto the surface of the recording medium 1 on the recording medium contact surface of the heating and pressing means 4, onto the recording medium contact surface.

As the gloss liquid, it is preferable that the silicon oil is included. Although the silicon oil is low cost, it is a stable material, and can surely provide the gloss onto the recording medium 1 surface.

In the mode shown in FIG. 12, the coating roller 81 formed of a sponge roller in which the gloss liquid is impregnated, is arranged so that it is brought into contact with the outer peripheral surface which is the recording medium contact surface of the heating roller 41, and by the rotation of the heating roller 41, the gloss liquid impregnated in the coating roller 81 is coated onto the recording medium contact surface. The rotation drive means (not shown) is provided to the coating roller 81, and it is rotated at each predetermined angle every time when the number of processing sheets becomes a predetermined amount, and the gloss liquid can be coated by a new surface of the coating roller 81. The coating roller 81 is detachably structured, and when the impregnated gloss liquid is consumed, it is replaced with the new article.

In the mode shown in FIG. 9, the gloss liquid is impregnated in the coating belt 82 formed of the non-woven fabric stretched between 2 wind up rollers 82*a* and 82*b*, and the coating belt 82 is brought into contact with the recording medium contact surface of the heating roller 41, and the gloss liquid impregnated in the coating belt 82 is coated on the recording medium contact surface by the rotation drive of the heating roller 41. The rotation drive means (not shown) is provided to the wind up roller 82*a* or 82*b*, and the roller is rotated by each predetermined amount every time when, for example, the processing number of sheets becomes a predetermined amount, and the area on which the gloss liquid has been coated, is wound up, and the gloss liquid can be coated by a new surface of the coating belt 82. When the coating belt 82 has been wound up, it is replaced with the new article.

In the mode shown in FIG. 14, a coating pad 83 formed of the non-woven fabric in which the gloss liquid is impregnated, is brought into contact with the recording medium contact surface of the heating roller 41, and by the rotation of the heating roller 41, the gloss liquid impregnated in the coating pad 83 is coated on the recording medium contact surface. The coating pad 83 is detachably structured, and when the impregnated gloss liquid has been consumed, it is replaced with a new article.

As described above, when a gloss liquid providing means 8 for providing the gloss liquid onto the recording medium contact surface of the heating and pressing means 4 is provided, in addition to the process to make the recording medium 1 surface transparent, further gloss can be provided, thereby, the higher quality image print can be formed. The glossy liquid providing means 8 is not restricted to the construction of the heating and pressing means. In addition to the paired roller construction, the glossy liquid providing means 8 may be provided onto a heating and pressing means having a paired belt construction.

Figure 15:
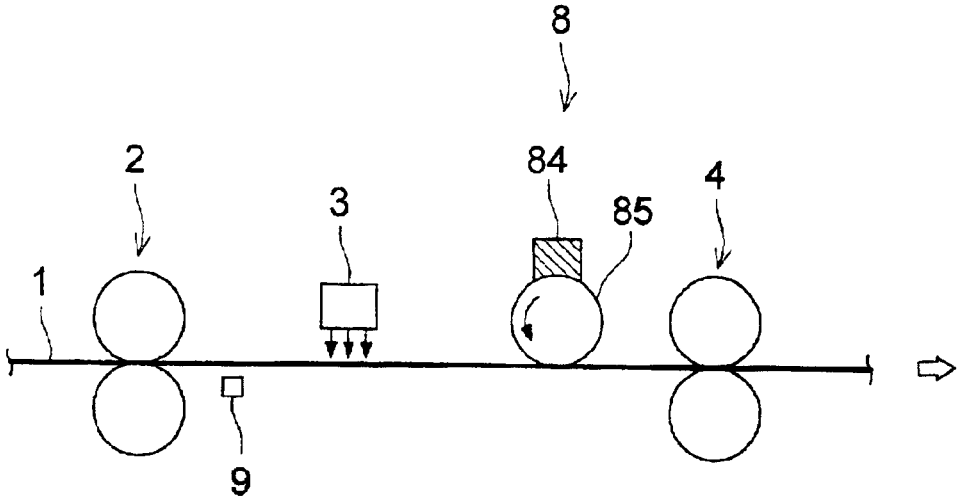
FIGS. 15(*a*) and 15(*b*) each is a structural view showing yet further other mode of a gloss liquid providing means.
Figure 15:
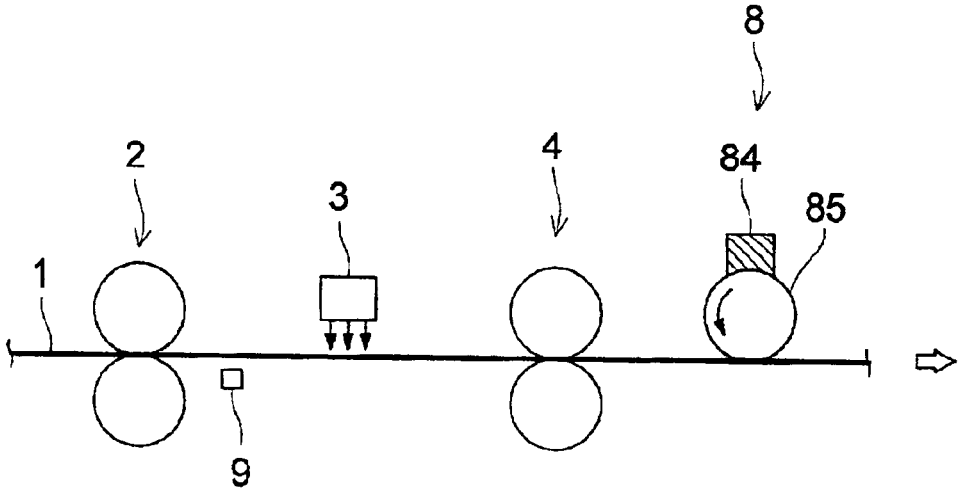

FIG. 15 shows another mode of the gloss liquid providing means 8.

The gloss liquid providing means 8 shown in this mode provides the gloss liquid, not onto the recording medium contact surface of the heating and pressing means 4, but onto the recording medium 1 after the image is recorded and formed by the recording head 3. FIG. 15(*a*) shows the mode in which the gloss liquid is provided onto the recording medium 1 before the heating and pressurizing processing by the heating and pressing means 4, and FIG. 15(*b*) shows the mode in which, in the same manner, the gloss liquid is provided after the heating and pressurizing processing by the heating and pressing means 4, and any mode may be allowable when the gloss liquid is provided onto the recording medium 1 after the image is recorded and formed by the recording head 3.

The gloss liquid is impregnated in the same coating pad 84 as the coating pad 83 shown in FIG. 14, and through the coating roller 85 which is in contact with the coating pad 84, the gloss liquid can be coated on the recording surface of the recording medium 1.

Even when the gloss liquid providing means 8, as described above, is provided to the recording medium 1 after the image recording by the recording head, in the same manner as the above, the further gloss can be provided in addition to a process to make the recording medium 1 surface transparent, thereby, the higher quality image print can be formed.

Figure 16:
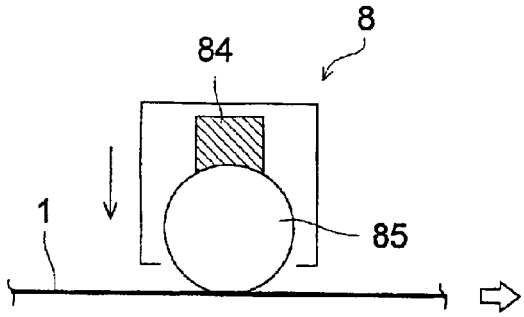
FIGS. 16(*a*) and 16(*b*) each is an explanation view showing a condition that providing of the gloss liquid is selectively conducted.
Figure 16:
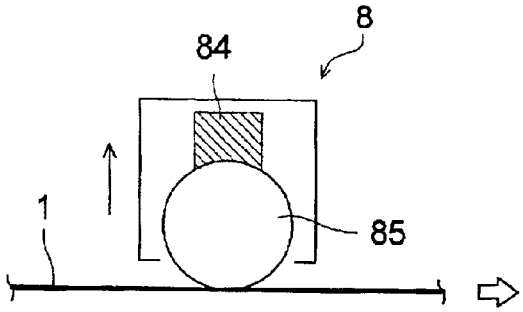

In this connection, the gloss liquid providing means 8 is structured so that the whole including the coating pad 84 and the coating roller 85 can be moved close to or separately from the recording medium 1 as shown in FIGS. 16(*a*) and 16(*b*), by the drive means, not shown, and it is also preferable that a means to automatically select whether the gloss liquid is provided corresponding to the kind of the recording media 1, is provided. Incidentally, in the present example, the construction of the heating and pressing means is not limited.

Figure 17:
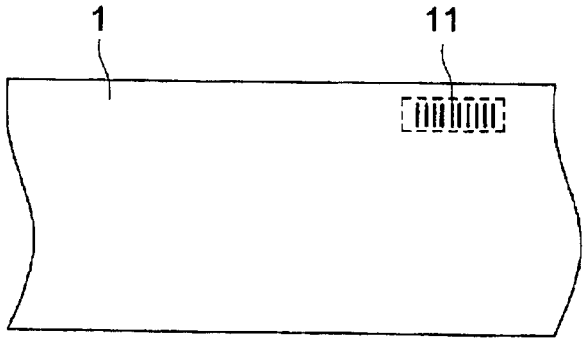
FIG. 17 is an explanation view showing a rear surface of a recording medium on which a classification code is provided.
Figure 18:
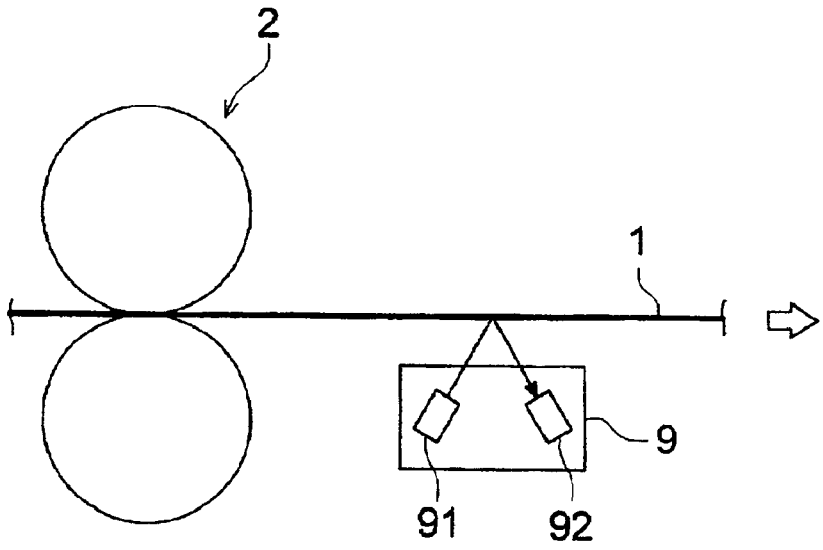
FIG. 18 is a structural view showing a recording medium classification judgment sensor.

As a means for judging the kind of the recording media 1, as shown in FIG. 17, a classification code 11 such as a bar-code by which the kind information is recorded on the rear surface (a reversal side surface to the recording surface) of the recording medium 1, is previously provided, and further, a recording medium classification judgment sensor 9 is provided on the upstream side of the gloss liquid providing means 8, for example, as shown in FIG. 15, on the upstream side of the recording head 3, and by the sensor 9, by detecting the classification code 11 of the recording medium 1 rear side, the kind of the recording medium 1 is judged, and corresponding to the judgment result, the gloss liquid providing means 8 is moved closely and separately, and the providing or no-providing of the gloss liquid can be controlled. As this recording medium classification judgment sensor 9, as shown in FIG. 18, an optical sensor structured by a light projection section 91 composed of an LED, and a light reception section 92 composed of a phototransistor light receiving the reflected light in which the detection light projected from the light projection section 91 is projected onto the recording medium 1 rear surface and reflected from the surface, may be used.

Figure 19:
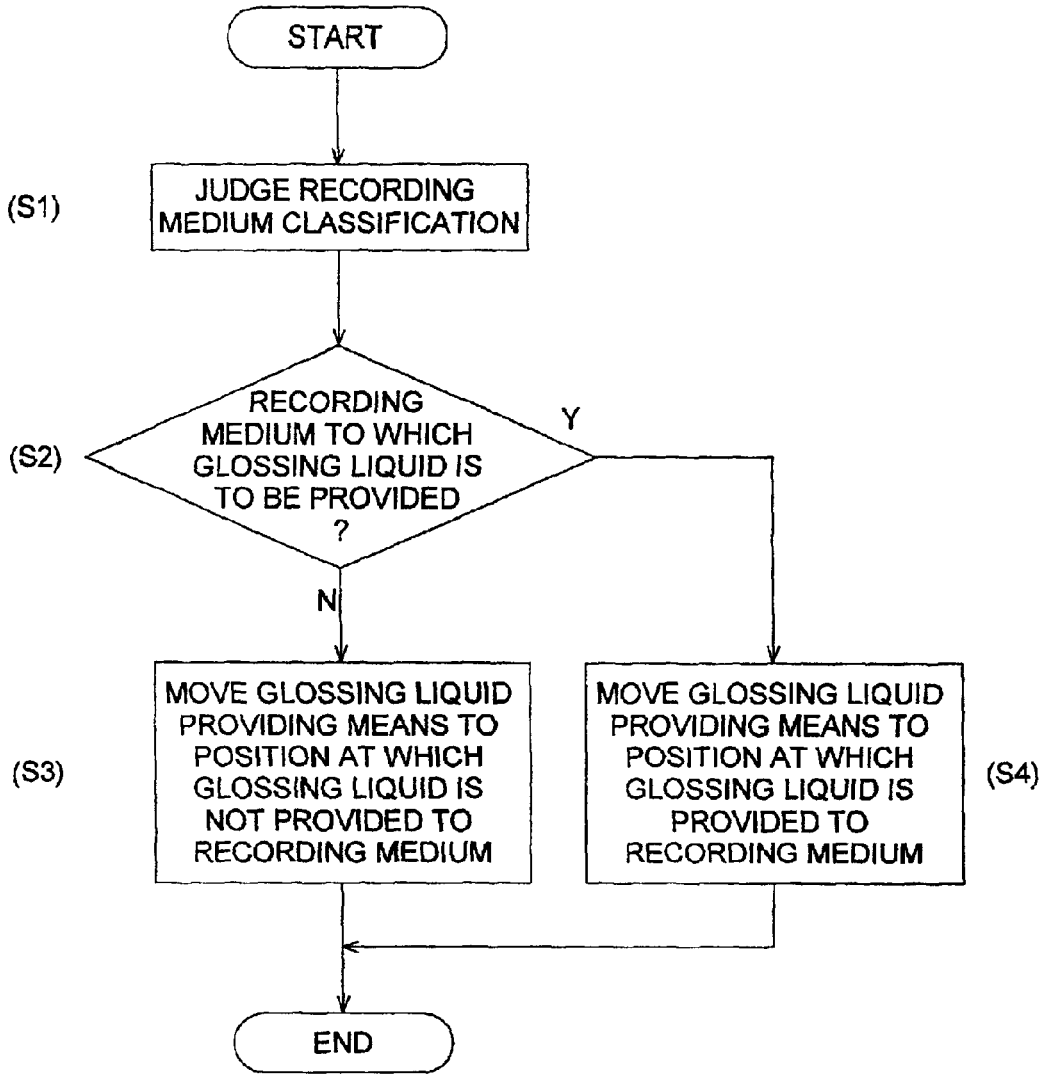
FIG. 19 is a flow chart showing a control flow of the gloss liquid providing means.

In FIG. 19, a control flow of such the gloss liquid providing means 8 is shown.

Initially, by the recording medium classification judgment sensor 9, the classification code 11 of the recording medium 1 is detected, and its kind is judged (S1). Next, it is judged whether the judged kind of the recording medium 1 is the kind to which the gloss liquid is to be provided (S2), as the result, when it is judged to be a kind to which it is not necessary that the gloss liquid is provided, or to which the gloss liquid is not to be provided, the gloss liquid providing means 8 is separated from the recording medium 1 as shown in FIG. 16(*b*), and is moved to a position at which the gloss liquid is not provided (S3). On the one hand, when it is judged to be a kind to which it is necessary to provide the gloss liquid, or it is preferable to provide the gloss liquid, the gloss liquid providing means 8 is brought into contact with the recording surface of the recording medium 1 as shown in FIG. 16(*a*), and is moved to a position at which the gloss liquid is provided (S4).

As described above, when a means for selectively judging whether the gloss liquid is provided or not corresponding to the kind of the recording medium 1, is provided, for only the recording medium 1 of the kind to which the gloss liquid is to be provided, the gloss can be selectively provided.

In the present invention, it is also preferable that a gloss liquid providing selection means for arbitrarily selecting whether the gloss liquid is provided or not, to the recording medium 1 is provided. As such the gloss liquid providing selection means, it can be structured by, for example, a gloss liquid providing switch. When the operator arbitrarily operates this gloss liquid providing selection means, the gloss liquid providing means 8 is selectively changed to the contact position or separation position to the recording medium 1 as shown in FIGS. 16(*a*) and 16(*b*).

Figure 20:
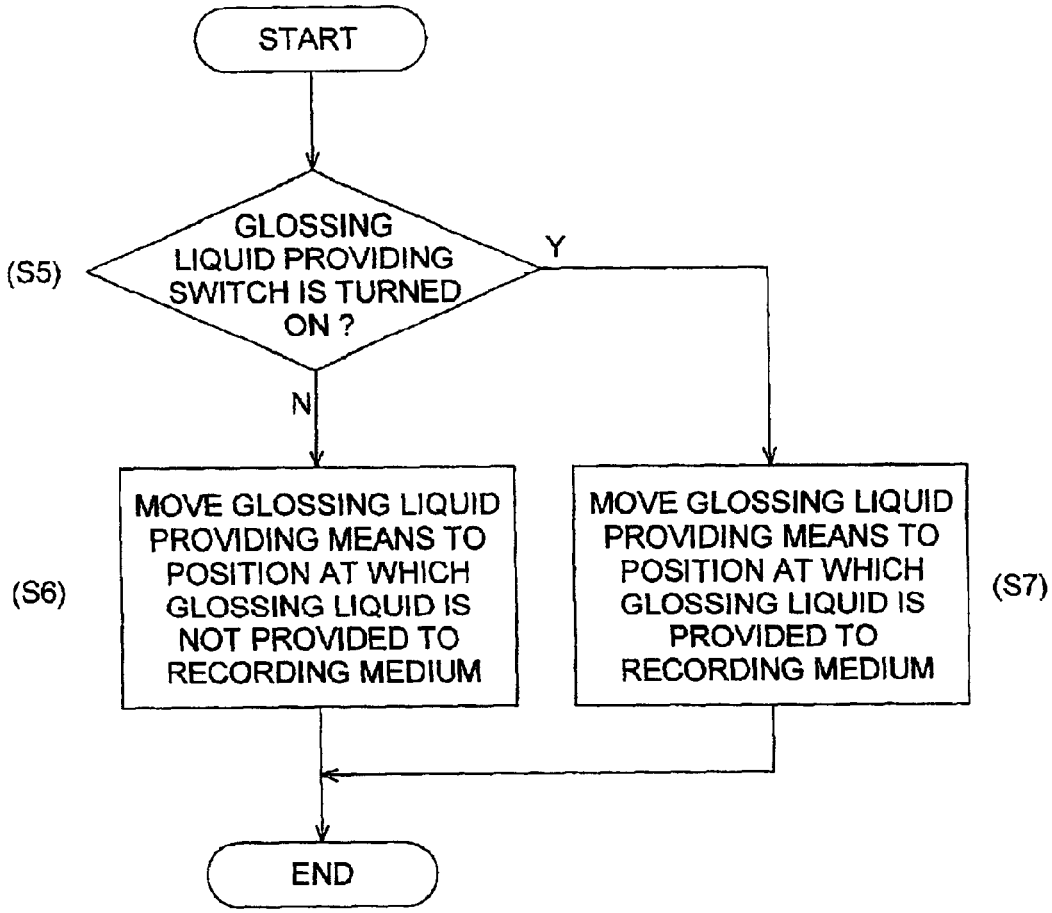
FIG. 20 is a flow chart showing another control flow of the gloss liquid providing means.

In FIG. 20, the control flow of the gloss liquid providing means 8 when the gloss liquid providing switch as the gloss liquid providing selection means is used, is shown.

Initially, it is judged whether the gloss liquid providing switch is in ON condition (S5), as the result, when it is judged to be in OFF condition, the gloss liquid providing means 8 is separated from the recording medium 1 as shown in FIG. 16(*b*), and moved to a position at which the gloss liquid is not provided (S6). On the one hand, when it is judged to be in ON condition, the gloss liquid providing means 8 is brought into contact with the surface of the recording medium 1 as shown in FIG. 16(*a*), and moved to a position at which the gloss liquid is provided (S7).

As described above, when the gloss liquid providing selection means for selecting whether the gloss liquid is provided or not, is provided, it can be freely selected depending on the purpose whether the gloss is provided or not, to the recording medium 1.

In this connection, as shown in FIG. 15 and FIG. 16, as the gloss liquid providing means 8 for providing the gloss liquid onto the recording surface of the recording medium 1, an example in which the gloss liquid is impregnated in the coating pad 84 is described, however, it may also be allowable when the gloss liquid is respectively impregnated in the coating roller 81 shown in FIG. 12 or the coating belt shown in FIG. 13, and the gloss liquid impregnated in these coating roller 81 or coating belt 82 is coated onto the recording medium 1 through the coating roller 85 or directly, as shown in FIG. 15 and FIG. 16.

Further, in order to control whether the gloss liquid is provided onto the recording medium 1, it may also be conducted by judging the classification of the recording medium 1 by the recording medium classification judgment sensor 9, or by arbitrarily operating the gloss liquid providing selection switch, when the coating roller 81, coating belt 82, and coating pad 83 respectively shown in FIG. 12–FIG. 14 are structured so that these can be close to or separate from the heating roller 41.

Figure 21:
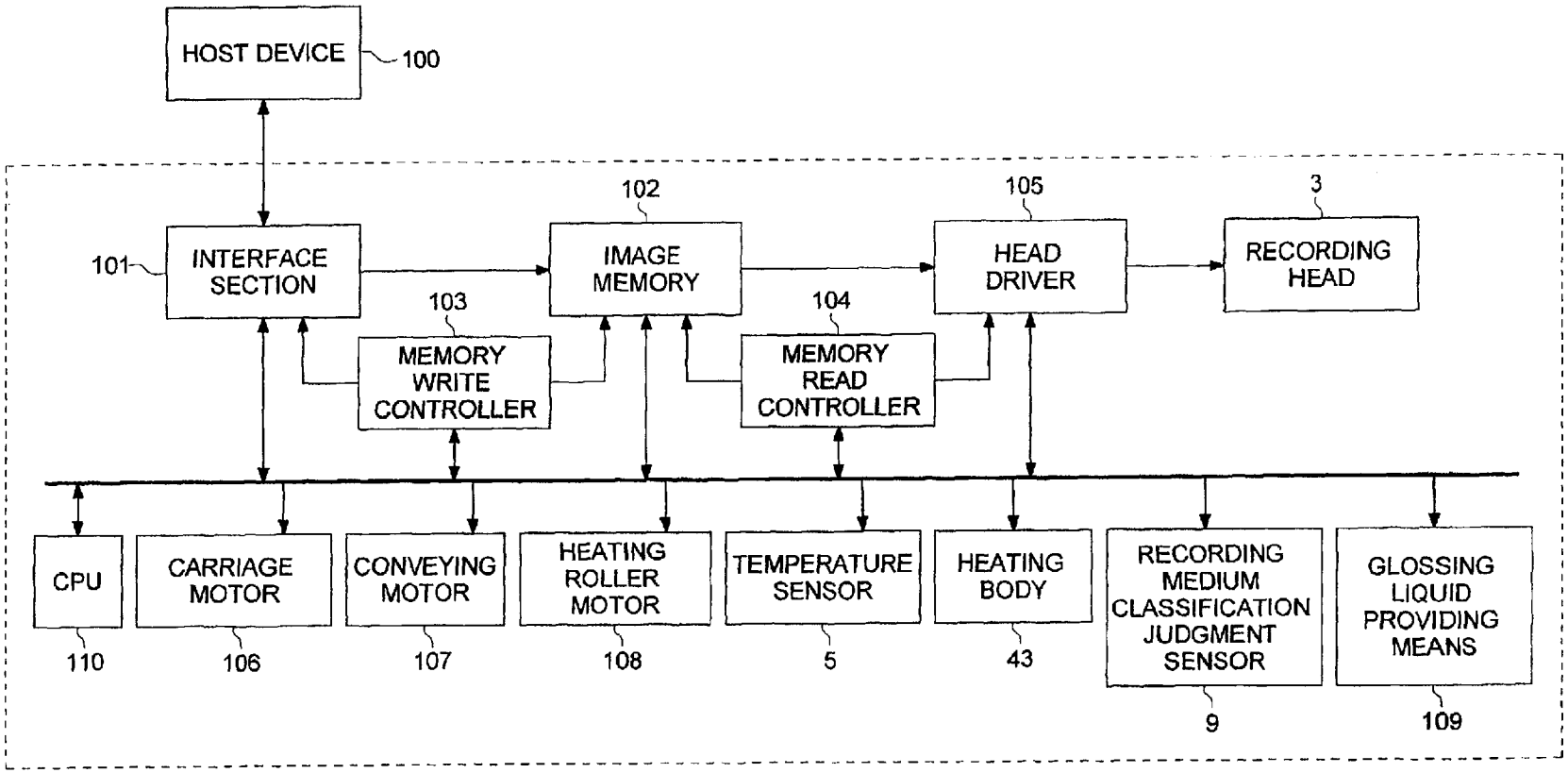
FIG. 21 is a structural block diagram showing an electric structure of the ink jet recording apparatus.

Next, by using a block diagram shown in FIG. 21, the structure of the control system of the ink jet recording apparatus according to the present invention will be described. In this connection, for the already described numeric codes, description will be neglected.

In the drawing, numeral 100 is a host device and is composed of a computer having the image data (parameter such as recording size of the image, the image data which is color separated into Y, M, C, and K) to be recorded in the ink jet recording apparatus. The image data sent from the host device 100 is taken into the ink jet recording apparatus through an interface section 101.

Numeral 102 is an image memory for temporarily storing the image data taken from the host device 100, numeral 103 is a memory write controller to control the writing of the image data to the image memory 102, numeral 104 is a memory read controller to control the reading out of the image data stored in the image memory 102, and numeral 105 is a head driver to drive control the ink jetting of the recording head 3 corresponding to the image data read from the image memory 102.

Numeral 106 is a carriage motor to cause the recording head 3 to movement scan, numeral 107 is a conveying motor to rotation drive the conveying roller 21, numeral 108 is a heating roller motor to rotation drive the heating roller 41 or belt members 47*a,b*, and numeral 109 is a gloss liquid providing switch constituting the gloss liquid providing selection means.

Numeral 110 is a CPU which controls the interface section 101, image memory 102, memory write controller 103, and memory read controller 104, and takes in the information of the image data from the host device 100, and corresponding to the image data, the heating roller temperature from the temperature sensor 5, and the judgment result by the recording medium classification judgment sensor 9, controls the head driver 105, carriage motor 106, conveying motor 107, heating roller motor 108, and heating body 43, and controls the providing of the gloss liquid by the operator operation of the gloss liquid providing switch 109.

Next, the temperature control means of the heating and pressing means 4 in the present invention will be described.

In the present invention, the heating and pressing means 4 is maintained in a predetermined temperature range by the temperature control means. The predetermined temperature range maintained by the temperature control means is preferable when it has a predetermined variation width ($\Delta T$) to the target temperature (To) which is sufficiently necessary for making the ink receiving layer of the recording medium 1 transparent, and when the predetermined temperature range is $To \pm \Delta T$, it is preferable that To is 50–150° C., preferably 80–130° C. and $\Delta T$ is not smaller than 10° C.

When $To \pm \Delta T$ is out of the above range, it exceeds the variation range sufficiently necessary for stably heating processing the recording medium 1, and the process for making the ink receiving layer transparent, which is important to form the good quality image print, can not be finely conducted.

Each mode of the temperature control by such the temperature control means, will be described below. In this connection, when [temperature] is used relating to the heating and pressing means 4, it means the temperature range having a predetermined variation range.

The first mode of the temperature control is as follows: when image is not recorded for a predetermined time period, the temperature control is stopped, and the heating of the heating body 43 is stopped (sleep mode), and the heating of the heating and pressing means 4 is not conducted.

Figure 22:
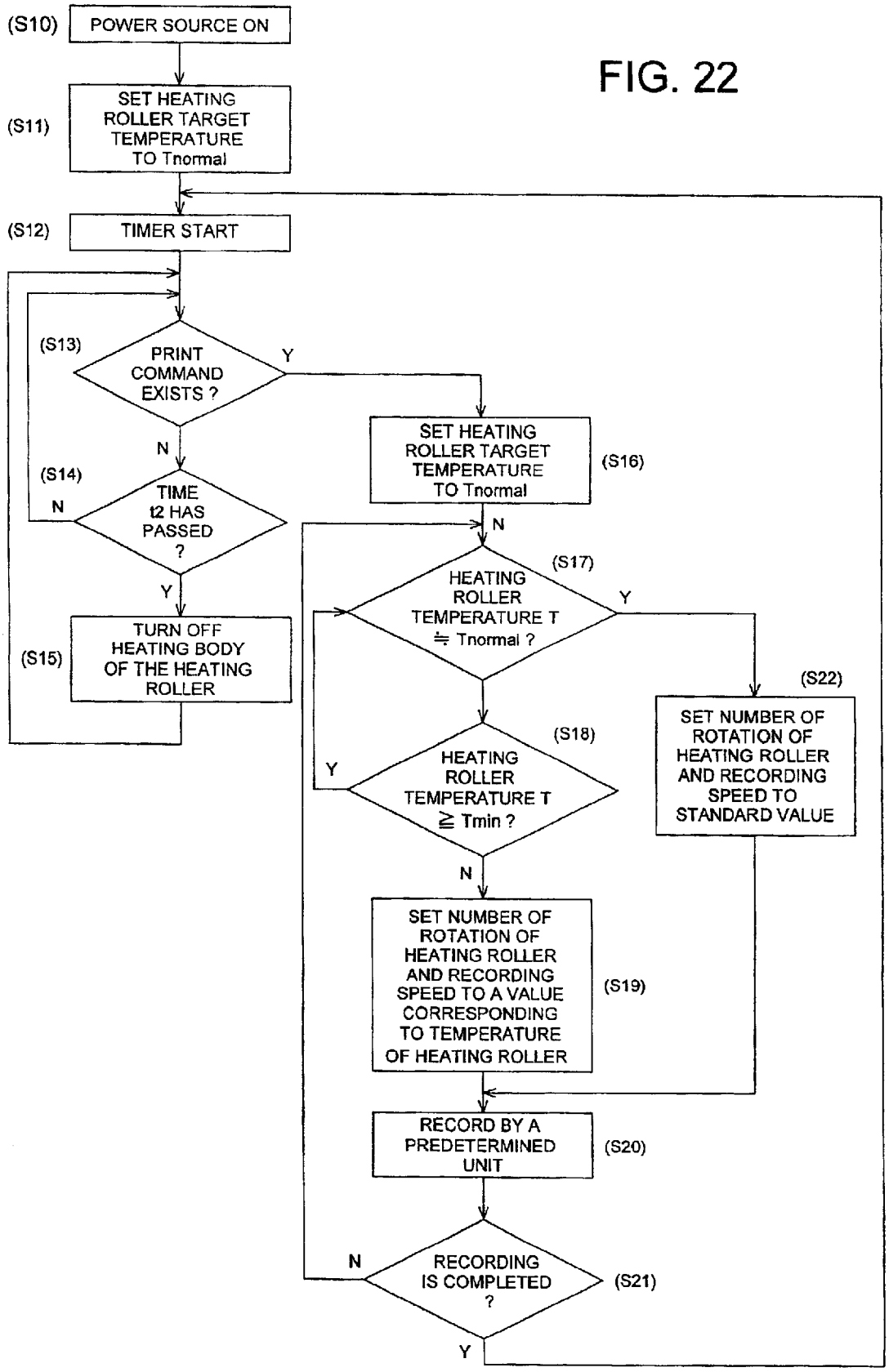
FIG. 22 is a flow chart showing a control flow of the first mode of a temperature control means.

This control flow will be described below by using FIG. 22.

Initially, the apparatus is started by the power source ON of the apparatus (S10), and the target temperature of the heating roller 41 is set to the standard temperature ($T_{normal}$) when the recording medium 1 is heating and pressurizing processed (S11), and next, the timer is started (S12).

After the timer is started, the existence of the print command is judged (S13), and when the print command does not exist, it is judged whether the timer elapsed time is over the sleep mode start time ($t_2$) (S14), and when it is not yet over the start time, the processing of S13–S14 is repeated.

In S14, when the timer elapsed time is over $t_2$, the temperature control is switched to the sleep mode, and the current flow to the heating body 43 of the heating roller 41 is stopped and in the OFF condition (S15). Thereby, the temperature control is stopped and the heating roller 41 is in no-heating condition. After the temperature control is in the sleep mode, and the heating body 43 of the heating roller 41 is in OFF condition, the sequence returns to S13, and the existence of the print command is judged again, and until the print command exists, the processing in S13–S15 is repeated.

In S13, when the print command exists, the target temperature of the heating roller 41 is set to the standard temperature ($T_{normal}$) when the recording medium 1 is heating and pressurizing processed (S16), and after that, the recording medium 1 is heating and pressurizing processed according to the heating and pressurizing control flow. Further, in S14, also when the print command exists before the timer elapsed time is over $t_2$, the recording medium 1 is heating and pressurizing processed according to the heating and pressurizing control flow.

As described above, in the temperature control means, in the case where the image is not recorded for a predetermined period of time, when the temperature control is stopped and the heating of the heating and pressing means 4 is stopped, the useless electric consumption is suppressed, and saving of the electric consumption can be attained.

Next, by using the same drawing, the heating and pressurizing control flow when the print command exists in S13, will be described.

In S13, when the print command exists, the temperature (T) of the heating roller 41 is set to the standard temperature ($T_{normal}$) which is the target at the time when the recording medium 1 is heating and pressurizing processed (S16). Next, it is judged whether the temperature of the heating roller 41 almost reaches the standard temperature ($T \approx T_{normal}$) (S17), and when it does not yet reach the standard temperature, next, it is judged whether the temperature of the heating roller 41 exceeds the lowest processing temperature ($T_{min}$) necessary when the recording medium 1 is heating and pressurizing processed ($T \geqq T_{min}$?) (S18). This lowest processing temperature ($T_{min}$) is the lowest temperature by which the thermoplastic resin particle in the ink receiving layer of the recording medium 1 can be fused when the rotation speed of the heating roller 41 is made to be the lowest, and is determined corresponding to the kind of the recording media 1.

In S18, when $T < T_{min}$, the sequence stands by until the temperature becomes $T \geqq T_{min}$, and when the temperature becomes $T \geqq T_{min}$, the number of rotation of the heating roller 41 and the recording speed of the recording head 3 are set to the value corresponding to the arrival temperature of the heating roller 41 (S19), and the heating and pressurizing time is relatively extended and the recording medium 1 is heating and pressurizing processed, and the image recording of a predetermined unit, for example, for each 1 line of the image, and for each 1 sheet of the image, is conducted (S20).

When the heating and pressurizing time is relatively extended, it is preferable that the recording time per unit length in the recording medium conveying direction of the image by the recording head 3 is relatively extended. Thereby, the recording speed of the image by the recording head 3 can be almost the same as the heating and pressurizing processing speed of the recording medium 1 by the heating and pressing means 4, and it is not necessary that a special recording medium accommodation means for making the recorded recording medium 1 stand by is provided between the recording head 3 and the heating and pressing means 4.

In order to relatively extend the recording time per unit length in the recording medium conveying direction, in the case of the reciprocating scanning type recording head 3 to conduct movement scanning along the direction almost perpendicular to the conveying direction of the recording medium 1, it can be adjusted when the stop time when the movement direction of the recording head 3 is reversed, is extended. In this method, because the drive frequency and scanning speed of the recording head 3 are not changed at all and can be constant, and the ink jetting characteristic is stable, and further, the drive circuit or the scanning drive system of the recording head 3 can be simplified, it is preferable.

Figure 25:
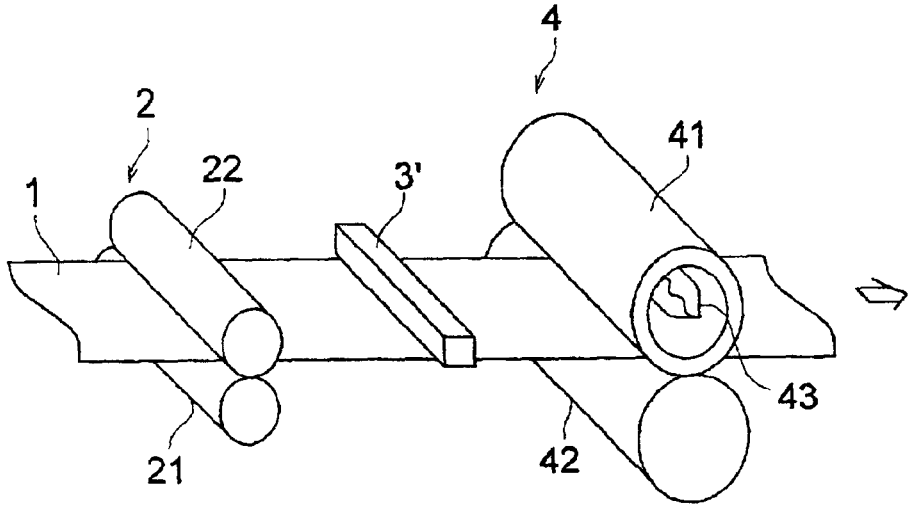
FIG. 25 is a structural view showing another mode of the ink jet recording apparatus.

Further, in the present invention, as shown in FIG. 25, the recording head may be structured by a linear recording head 3' which has the length corresponding to the width of the recording medium 1, and is provided over the width direction of the recording medium 1, and in which the ink jet nozzle is formed over the whole range of width of the recording medium 1, and in the case of such the recording head 3', in order to relatively extend the recording time per unit length in the recording medium conveying direction as described above, it can be adjusted by the operation by which the ink jet interval of the recording head 3' is delayed. Generally, in the case of the linear head 3', because the ink jet interval is longer than the reciprocating scanning type recording head 3, even when it is changed so that the jet period is prolonged, the change of the ink jet characteristic is small.

In S20, when a predetermined unit of image recording has been completed, it is judged whether the image recording of the commanded predetermined number of print sheets is completed (S21), and when it is not yet completed, the processing of S17–S20 is repeated.

In S17, when the temperature (T) of the heating roller 41 almost reaches the standard temperature ($T_{normal}$), the rotation number of the heating roller 41 and the recording speed of the recording head 3 are set to a standard value (S22), and the image recording and heating and pressurizing processing are conducted until the print of the command number of sheets is completed.

As described above, after the return from the heating stop of the heating and pressing means 4, while the heating and pressing means 4 is not lower than the lowest processing temperature, and the heating and pressing means 4 reaches a predetermined temperature range, when the heating and pressurizing time is relatively extended, and the heating and pressurizing processing of the recording medium 1 is conducted, it is not necessary to wait until the heating and pressing means 4 reaches a predetermined temperature range, and the heating and pressurizing processing can be early started, and the increase of the image print formation speed can be attained so much.

In S21, when a predetermined unit of the image recording has been completed, the sequence returns to S12 and the timer is started(after reset, it is restarted) and the temperature control after S13 and the subsequent, by the temperature control means is repeated.

The second mode of the temperature control by the temperature control means will be described below.

The second mode of the temperature control is as follows: when the recording of the image is not conducted for a predetermined time period, the heating and pressing means 4 is maintained in the second temperature range (energy saving mode) lower than a predetermined temperature range by the temperature control means.

Figure 23:
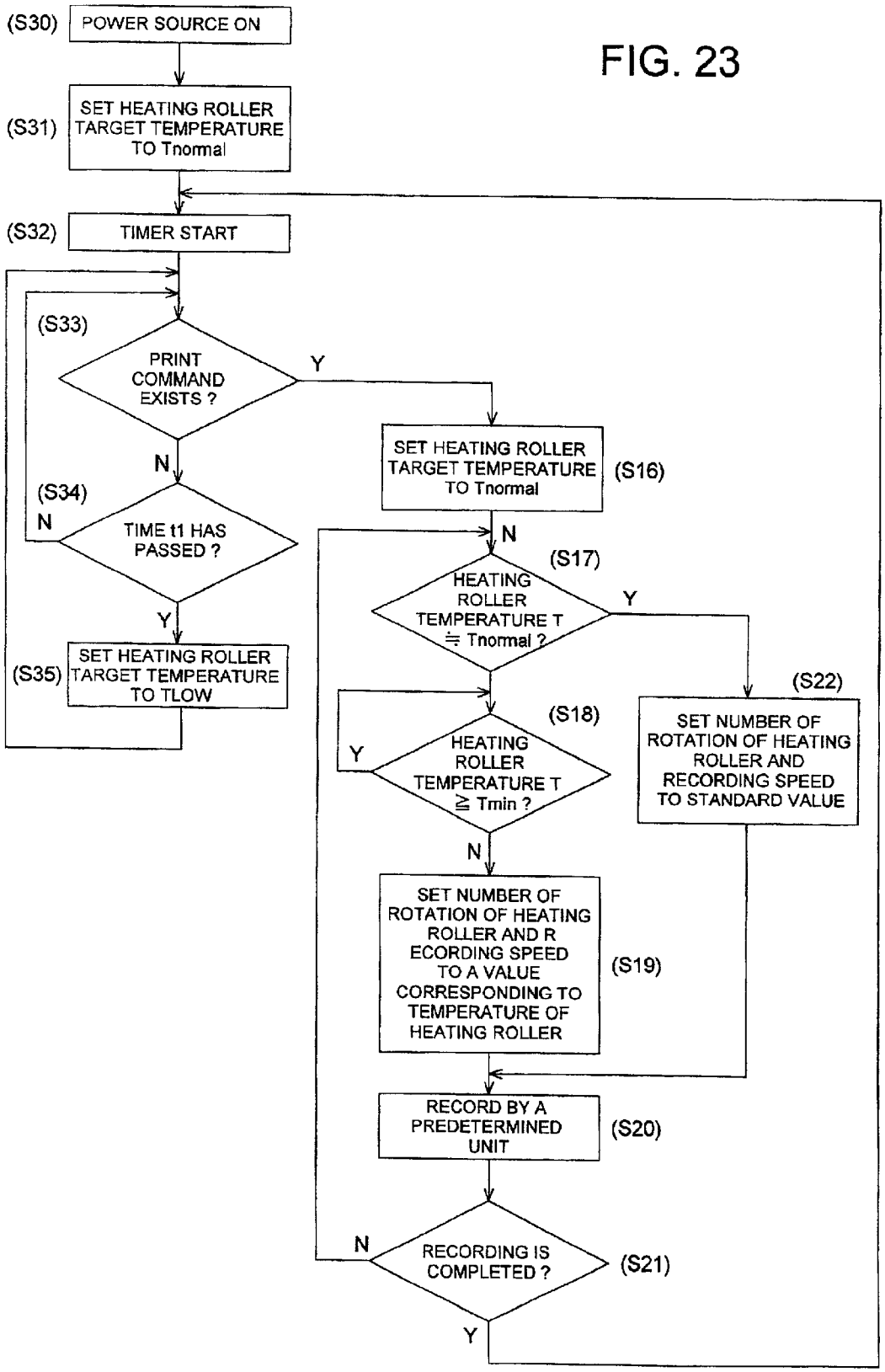
FIG. 23 is a flow chart showing a control flow of the second mode of a temperature control means.

By using FIG. 23, this control flow will be described.

Initially, the apparatus is started by the power source ON of the apparatus (S30), and the target temperature of the heating roller 41 is set to the standard temperature ($T_{normal}$) when the recording medium 1 is heating and pressurizing processed (S31), and next, the timer is started (S32).

After the timer start, the existence of the print command is judged (S33), and when the print command does not exist, it is judged whether the timer elapsed time is over the energy saving mode start time ($t_1$) (S34), and when it is not yet over the start time, the processing in S33–S34 is repeated.

In S34, when the timer elapsed time is over $t_1$, the temperature control is switched to the energy saving mode, and the target temperature (T) of the heating roller 41 is set to a temperature ($T_{low}$)) which is lower than the standard temperature ($T_{normal}$) (S35). Thereby, the temperature of the heating roller 41 is controlled to the second temperature range which is lower than a predetermined temperature range. After the temperature control is switched to the energy saving mode and the temperature of the heating roller 41 is set to the $T_{low}$, the sequence returns to S33 and the existence of the print command is judged again, and processing in S33–S35 is repeated until the print command exists.

In S33, when the print command exists, the target temperature of the heating roller 41 is set to the standard temperature ($T_{normal}$) at the time when the recording medium 1 is heating and pressurizing processed (S16), and after that, the recording medium 1 is heating and pressurizing processed according to the heating and pressurizing control flow. Further, in S34, even when the print command exists before the timer elapsed time is over $t_1$, the recording medium 1 is heating and pressurizing processed according to the heating and pressurizing control flow. Because the control flow of the heating and pressurizing processing hereinafter is the same as in S16–S22 shown in FIG. 22, the explanation is neglected.

As described above, in the temperature control means, in the case where the image is not recorded for a predetermined time period, when the temperature of the heating and pressing means 4 is controlled in the second temperature range which is lower than a predetermined temperature range, the electric power consumption can be saved, and at the time of the heating and pressurizing processing start, because the heating roller 41 can be quickly heated to the standard temperature, the heating and pressurizing processing can be restarted in a short time.

Further, in the heating and pressurizing processing in this second mode, after the return from the second temperature range of the heating and pressing means 4, while the heating and pressing means 4 is not lower than the lowest processing temperature, and the heating and pressing means 4 reaches a predetermined temperature range, when the heating and pressurizing time is relatively extended, and the heating and pressurizing processing of the recording medium 1 is conducted, it is not necessary to wait until the heating and pressing means 4 reaches a predetermined temperature range, and the heating and pressurizing processing can be early started, and the increase of the image print formation speed can be attained so much.

The third mode of the temperature control by the temperature control means will be described below.

The third mode of the temperature control is as follows: when the image is not recorded for a predetermined time period, the heating and pressing means 4 is maintained in the second temperature range (energy saving mode) which is lower then a predetermined temperature range, and further, when the image is not recorded for a predetermined period of time, the temperature control is stopped, and the heating of the heating and pressing means 4 is stopped (sleep mode).

Figure 24:
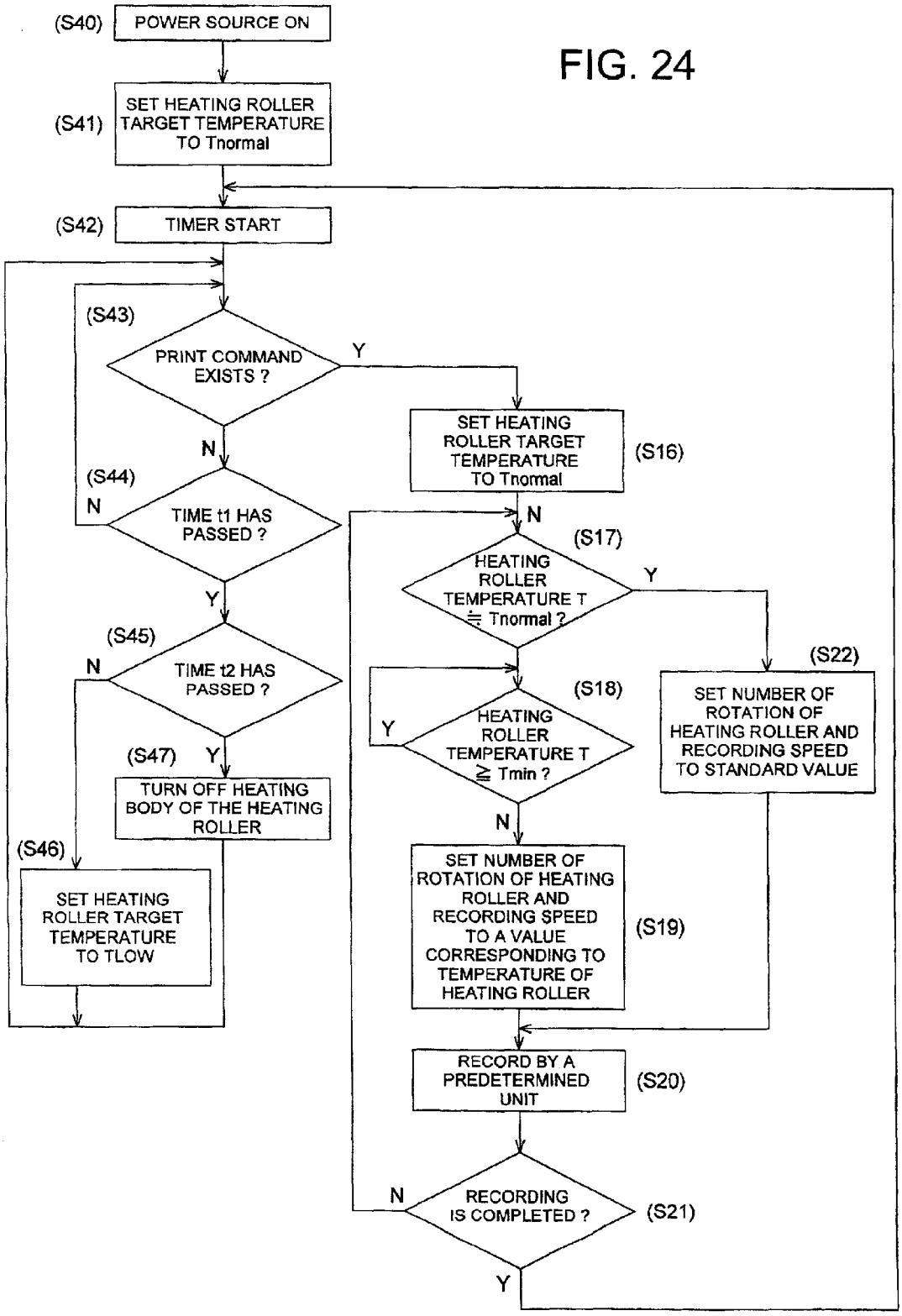
FIG. 24 is a flow chart showing a control flow of the third mode of a temperature control means.

This control flow will be described below, by using FIG. 24.

Initially, the apparatus is started by the power source ON of the apparatus (S40), and the target temperature of the heating roller 41 is set to the standard temperature ($T_{normal}$) when the recording medium 1 is heating and pressurizing processed (S41), and next, the timer is started (S42).

After the timer start, the existence of the print command is judged (S43), and when the print command does not exist, it is judged whether the timer elapsed time is over the energy saving mode start time ($t_1$) (S44), and when it is not yet over the start time, the processing in S43–S44 is repeated.

In S44, when the timer elapsed time is over $t_1$, next, it is judged whether the timer elapsed time is over the sleep mode start time ($t_2$) (S45). In this connection, the relationship between the energy saving mode start time ($t_1$) and the sleep mode start time ($t_2$) is $t_1<t_2$. As the result, when the timer elapsed time is over $t_1$, but not yet over $t_2$, the temperature control is switched to the energy saving mode, and the target temperature (T) of the heating roller 41 is set to a temperature ($T_{low}$) which is lower than the standard temperature ($T_{normal}$) (S46). Thereby, the temperature of the heating roller 41 is controlled to the second temperature range which is lower than a predetermined temperature range. After the temperature control is switched to the energy saving mode and the temperature of the heating roller 41 is set to the $T_{low}$, the sequence returns to S43 and the existence of the print command is judged again, and processing in S43 and subsequent is repeated until the print command exists.

In S45, when the timer elapsed time is over also $t_2$, the temperature control is switched to the sleep mode, and the current flow to the heating body 43 of the heating roller 41 is stopped and the heating body 43 of the heating roller 41 is in an OFF condition. Thereby, the temperature control is stopped, and the heating roller 41 is in a no-heating condition. After the temperature control is switched to the sleep mode and the heating body 43 of the heating roller 41 is in an OFF condition, the sequence returns to S43, and the existence of the print command is judged again, and processing in S43 and subsequent is repeated until the print command exists.

In S43, when the print command exists, the target temperature of the heating roller 41 is set to the standard temperature ($T_{normal}$) at the time when the recording medium 1 is heating and pressurizing processed (S16), and after that, the recording medium 1 is heating and pressurizing processed according to the heating and pressurizing control flow. Further, in S44, even when the print command exists before the timer elapsed time is over $t_1$, the recording medium 1 is heating and pressurizing processed according to the heating and pressurizing control flow. Because the control flow of the heating and pressurizing processing hereinafter is the same as in S16–S22 shown in FIG. 22, the explanation is neglected.

As described above, in the temperature control means, in the case where the image is not recorded for a predetermined time period, when the temperature of the heating and pressing means 4 is controlled in the second temperature range which is lower than a predetermined temperature range, and further in the case where the image is not recorded for a predetermined time period, when the temperature control of the heating and pressing means is stopped and the heating of the heating and pressing means is stopped, the useless power consumption for a long period of time is suppressed, and the electric power consumption can be saved, and when the image recording is restarted after a relatively short time of the recording stop, because the heating roller 41 can be quickly heated to the standard temperature, the heating and pressurizing processing can be restarted in a short time.

Further, in the heating and pressurizing processing in this third mode, after the return from the heating stop of the heating and pressing means 4 or the second temperature range of the heating and pressing means 4, while the heating and pressing means 4 is not lower than the lowest processing temperature, and the heating and pressing means 4 reaches a predetermined temperature range, when the heating and pressurizing time is relatively extended, and the heating and pressurizing processing of the recording medium 1 is conducted, it is not necessary to wait until the heating and pressing means 4 reaches a predetermined temperature range, and the heating and pressurizing processing can be early started, and the increase of the image print formation speed can be attained so much.

According to the present invention, the ink jet recording apparatus by which, when the recording medium having an ink receiving layer including the thermoplastic resin particle on the surface layer, and the pigment ink solvent absorption layer adjacent to the inside of the ink acepter layer, is heated and pressurized and the ink receiving layer is made transparent, a process to make the layer transparent is adequately conducted, and the high quality image print can be formed, can be provided.

Next, the concrete embodiment of the heating and pressing means of the present invention will be explained.

[The First Example]

Figure 27:
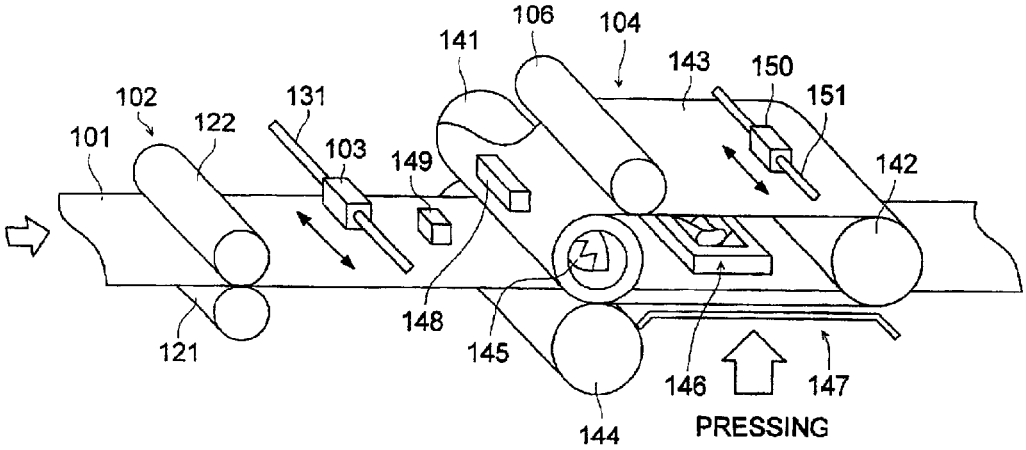
FIG. 27 is a perspective view showing an embodiment of the present invention.

FIG. 27 is an outline structural view of the ink jet recording apparatus according to item (1) of the present invention. The ink jet recording apparatus which is the present invention is structured by a recording medium conveying means 102 for conveying a recording medium 101, a recording head 103 to record a predetermined image on the recording surface of the recording medium 101, and heating and pressing means 104 for conducting the fixing processing on the recording medium 101 on which the image is recorded and formed by the recording head 103.

The recording medium 101 is supplied by a supply means (not shown) and conveyed to the right direction in the drawing by a recording medium conveying means (hereinafter, simply called conveying means) 102, and a predetermined image is recorded on the recording surface of the recording medium 101 by the recording head 103 arranged at the downstream side of the conveying means 102. Then, the recording medium 101 after the recording, is further conveyed to the heating and pressing means 104 arranged at the downstream side of the recording head 103, and after the fixing processing of the image recorded on the recording surface of the recording medium 101 is conducted, it is delivered to the outside of the ink jet recording apparatus.

Herein, as the recording medium 101, in the example shown in the drawing, an example in which a long roll paper wound roll-like is used is shown, but it is not limited to this, and a sheet-like recording medium cut into an appropriate size may also be used.

The conveying means 102 comprises a conveying roller 121 driven by a drive means, not shown, and a driven roller 122 to sandwich the recording medium 101 between the conveying roller 121 and the driven roller 122, and while the recording medium 101 is sandwiched between the conveying roller 121 and the driven roller 122, by the rotation of the conveying roller 121, corresponding to the image recording by the recording head 103, which will be described later, a predetermined amount of the recording medium 101 is conveyed to the right direction in the drawing (sub scanning direction).

The recording head 103 is arranged at the downstream side of the conveying means 102, and a reciprocating operation-type recording head which is structured such that it can be moved in the main scanning direction along an operation guide 131 provided so as to be almost perpendicular to the conveying direction of the recording medium 101 ranging over the width direction of the recording medium 101.

In the recording head 103, a plurality of ink tanks in which each color pigment ink, such as, for example, Y (yellow), M (magenta), C (cyan), K (black), is stored, are provided, and while moving in the main scanning direction along the operation guide 131, by jetting the predetermined ink at a predetermined timing corresponding to the image data, the recording head 103 is cooperated with the conveyance of the recording medium 101 by the conveying means 102, and records and forms a predetermined image on the recording surface of the recording medium 101.

The heating and pressing means 104 is arranged at the downstream side of the recording head 103 in order to heat and pressurize and press the recording medium 101 after the image is recorded and formed by the recording head 103, and comprises: a heating roller 141; pressurizing roller 144 to sandwich the recording medium 101 between the heating roller 141 and it; heating belt 143 suspended around the heating roller 141; driven roller 142 driven by it; cooling means 146 for cooling the heating belt 143; pressing means 147 for pressing the recording medium 101 onto the heating belt 143; temperature sensor 148 to detect the surface temperature of the heating belt 143; conveyance sensor 149 to detect the recording medium 101 before the heating roller 141 and the pressurizing roller 144; surface sensor 150 to detect the surface roughness of the heating belt 143; and cleaning means 106 for removing the ink stain adhered onto the surface of the heating belt 143.

Figure 28:
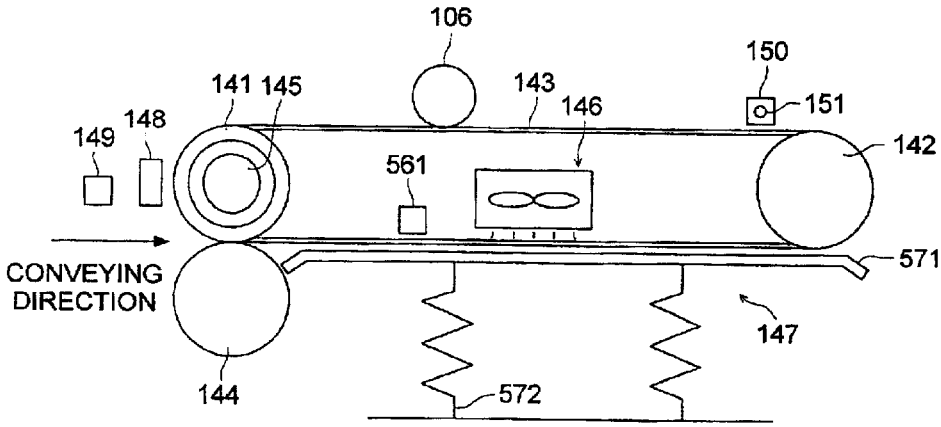
FIG. 28 is a front view showing an embodiment of the present invention.

As shown in FIG. 28, the heating roller is composed of a hollow roller, and the heating element 145 such as a halogen heater, which is a heat source, is housed along its axial direction, and by the heat of the heating element 145, the heating roller 141 is heated, and the heating belt 143 suspended by the roller, is also heated, thereby, the thermoplastic resin particle included in the ink receiving layer of the recording medium 101 pressed by that, is fused.

It is preferable that this heating roller 141 is formed of the material with the high heat conductivity so that the recording medium 101 can be efficiently heated by the heat generated by the heating element 145, and it is preferable that the metallic roller is used.

The temperature sensor 148 to detect the surface temperature of the heating belt 143 suspended by the roller 141, is arranged close to the heating roller 141, and by detecting the surface temperature of the heating belt 143 by the temperature sensor 148, the heating amount of the heating element 145 inside the heating roller 141 is controlled by the temperature control means, not shown, and the surface temperature of the heating belt 143 is controlled so as to be maintained within a predetermined temperature range.

Figure 29:
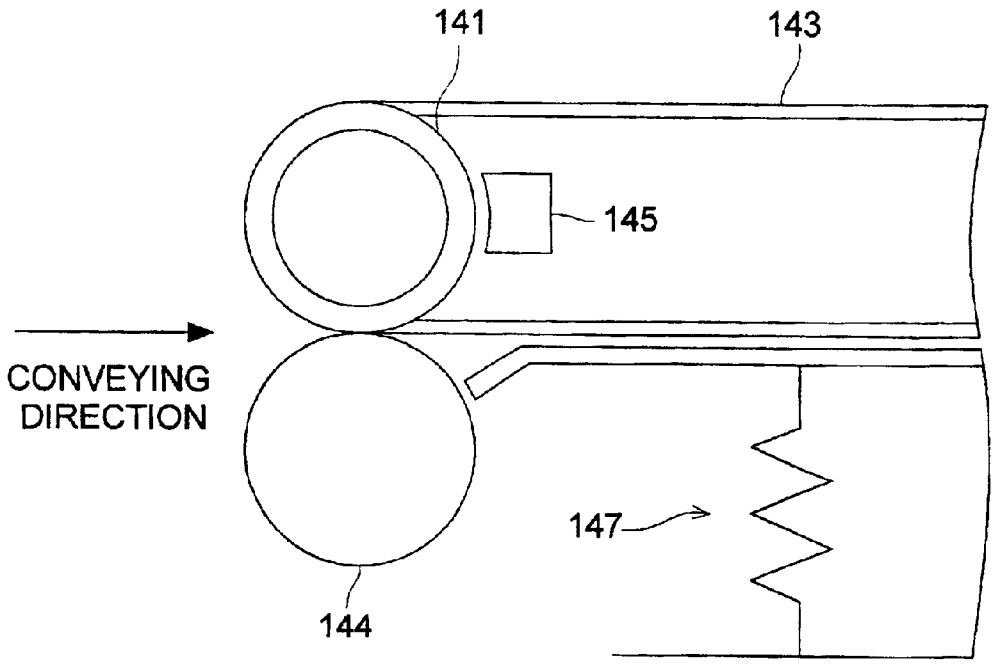
FIG. 29 is a front view showing another example of the arrangement position of the heating element.

The heating element 145 may also provided in the vicinity of the outside of the heating roller 141 as shown in FIG. 29.

The heating belt 143 is stretched between the heating roller 141 and driven roller 142, and after it is heated to a predetermined temperature range by the heating element 145 inside the heating roller 141, the surface is pressed onto the recording medium 101 after the image is recorded and formed by the recording head 3. Thereby, the thermoplastic resin particle included in the ink receiving layer of the recording medium 101 is fused, and its surface roughness is improved to the degree equal to the roughness of the surface of the heating belt 143.

Accordingly, it is required for the heating belt that its surface roughness is small, and specifically, it is required that Ra=not larger than 0.5 $\mu$m, and not smaller than 0.01 $\mu$m (ideally, Ra=not larger than 0.1 $\mu$m).

Herein, the accompanying effect to that the surface roughness of the belt is made small, will be described. Generally, in the same material, it is well known that, the more the surface roughness is reduced, the more the abrasion resistance is increased, and durability is increased. Further, it is well known that the more the surface roughness is reduced, the more excellent effect is shown in the antistatic property and the prevention of offset. Accordingly, also in the present invention, the same effect can be obtained.

As the heating belt 143, a belt in which basically the coating is coated on the surface of the metallic belt, is used, and considering about the parting property from the recording medium 101 and the surface roughness when it is coated, the following are listed as the material.

Nickel belt+silicon rubber+PFA

Nickel belt+PFA

Nickel belt+silicon rubber

Nickel belt+fluorine coat

Nickel belt+silicon rubber+hardening-type silicon

Nickel belt+hardening-type silicon

SUS belt+silicon rubber+PFA

SUS belt+PFA

SUS belt+silicon rubber

SUS belt+fluorine coat

SUS belt+silicon rubber+hardening-type silicon

SUS belt+hardening-type silicon

Polyimide belt+silicon rubber+PFA

Polyimide belt+PFA

Polyimide belt+silicon rubber

Polyimide belt+fluorine coat

Polyimide belt+silicon rubber+hardening-type silicon

Polyimide belt+hardening-type silicon

Figure 30:
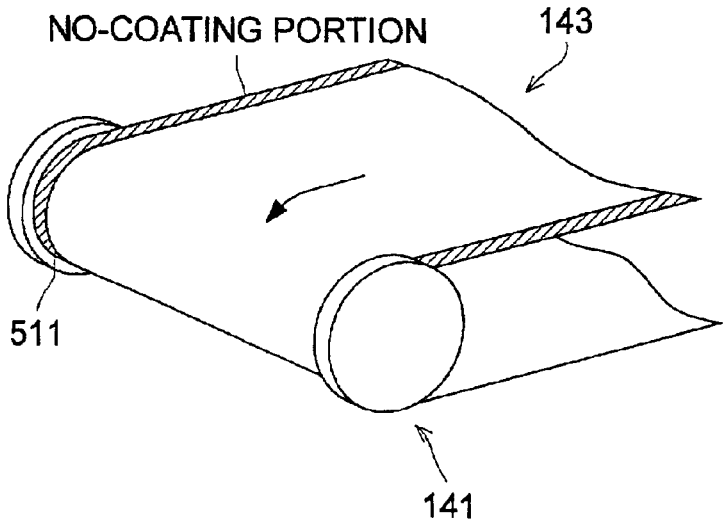
FIG. 30 is a perspective view showing a contact portion of an end surface of the heating belt with a flange of the heating belt.

In the heating belt 143, in a belt on which a coating such as silicon rubber is provided on its surface, as shown in FIG. 30, no-coating portions are provided on both end portions of the heating belt 143, and by avoiding the contact with the drop out prevention flanges 411 of the heating belt 143 which are respectively provided on end portions of the heating roller 141 and the driven roller 142, the generation of the dust following the peeling-off of the coating is prevented.

As described above, because the heating belt 143 is an important element to determine the surface roughness of the recording medium 101, the caution is necessary for the control of the surface roughness. Accordingly, the surface sensor 150 to detect the surface roughness is provided and when the surface roughness of the heating belt 143 is lowered to a predetermined reference, the replacement time is reported by an alarm means, not shown.

The surface sensor 150 is structured in such a manner that it can be moved along the operation guide 151 provided so as to be about perpendicular to the drive direction of the heating belt ranging over the width direction of the heating belt 143, and the surface roughness is detected ranging over the whole width of the heating belt.

Further, for the purpose of controlling the surface roughness of the heating belt 143, other than the above means, a means for reporting the replacement time according to the conveying distance of the recording medium 101 is provided, and the conveying distance of the recording medium is measured by a measurement means, not shown, and when it reaches a predetermined distance, the replacement time is reported by the alarm means, not shown.

The pressurizing roller 144 is structured by using a metallic roller such as the stainless steel, or a metallic roller such as the stainless steel on whose outer periphery elastic coating is provided. Selection of both is depending on the structure of the heating belt 143. That is, when both are not provided with elastic coating, because the single contact (?????) is generated, in such the case, as the heating belt 143, a roller on whose surface the coating with elasticity is provided is used, and as the pressurizing roller 144, a roller on whose outer periphery the coating with the elasticity is provided is used. In this connection, the thickness of the coating provided on the pressurizing roller is, for the prevention of the twist of the coating, not larger than 5 mm.

Figure 31:
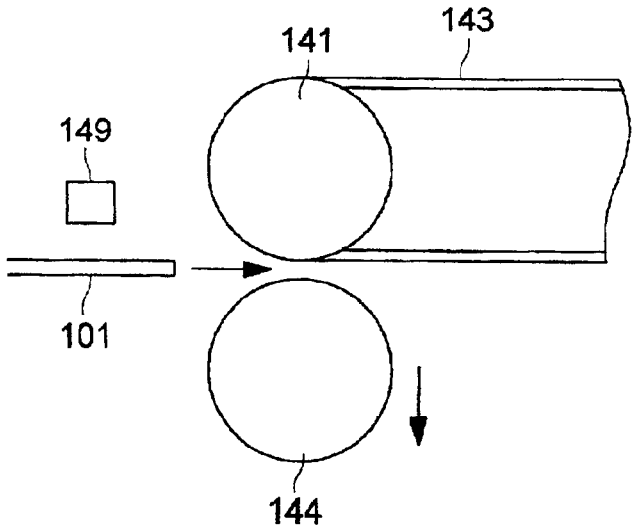
FIG. 31 is a front view showing the pressure control of the pressurizing roller when the recording medium is set.

The pressurizing roller 144 is always pressed onto the heating roller 141 side by an urging means, not shown, and as shown in FIG. 31, the conveyance sensor 149 is provided before the heating roller 141 and the pressurizing roller 144, and by this conveyance sensor 149, when it is detected that the recording medium 101 is conveyed, the control is conducted in such a manner that the urging means reduces the pressing force of the pressurizing roller 144 onto the heating roller 141. It is conducted for the purpose of preventing the surface of the heating belt 143 and the pressurizing roller 144 form being damaged by the end surface protruded portion of the recording medium 101.

The cooling means 146 is provided for cooling the heating belt 143, at the downstream of the conveying direction of the recording medium 101 of the heating belt 141 and the pressurizing belt 144. It is because that the recording medium 101 passed through the heating roller 141 and the pressurizing roller 144 is pressed onto the heating belt 143 by the pressing means 147, which will be described later, and thereby, while the surface roughness is improved, further conveyed to the downstream, and finally, in the case where it is separated from the downstream end of the heating belt 143 which is the exit of the heating and pressing means 104, when the surface temperature is not fully cooled to lower than the glass transition point Tg, because bad influence is caused on the surface roughness, it is necessary to fully cool it. Accordingly, when the surface temperature of the heating belt 143 is detected by the temperature sensor 461, and corresponding to the value, the cooling means 146 controls the degree of cooling, the surface temperature at the downstream end of the heating belt 143 of the recording medium 101 is suppressed to lower than the glass transition point Tg.

Figure 32:
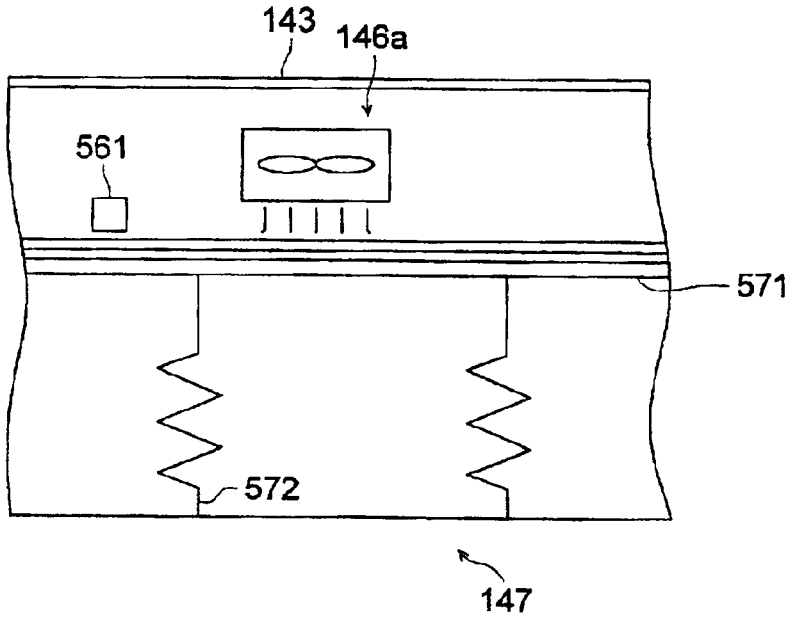
FIG. 32 is a front view showing another example of the cooling means.
Figure 33:
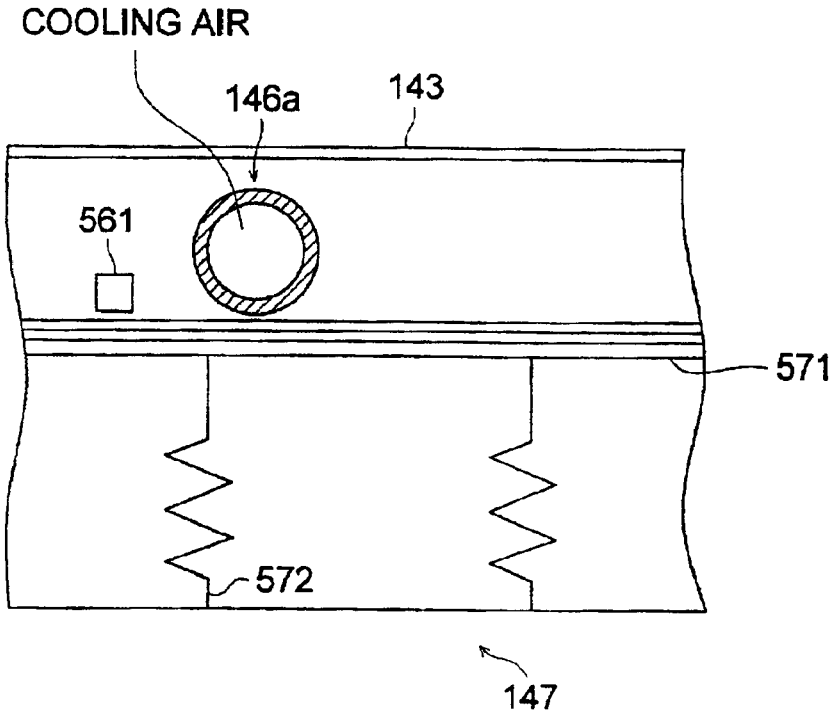
FIG. 33 is a front view showing yet another example of the cooling means.

Specific examples of the cooling means 146 will be shown in FIG. 32, FIG. 33 and FIG. 34.

FIG. 32 is a view in which an air-cooling fan is used for the cooling means 146. As shown in the drawing, the cooling means **146*a* has the temperature sensor 461, and by the temperature sensor 461, the surface temperature of the heating belt 143 is detected, and corresponding to the value, by controlling the blast amount, the surface temperature at the downstream end of the heating belt 143 of the recording medium 101** is suppressed to lower than the glass transition point Tg.

FIG. 33 is a view in which a hollow pipe is used for the cooling means 146, and the cooling air is circulated inside it. As shown in the drawing, the cooling means 146*b* has the temperature sensor 461 , and by the temperature sensor 461, the surface temperature of the heating belt 143 is detected, and corresponding to the value, by controlling the temperature of the cooling air, the surface temperature at the downstream end of the heating belt 143 of the recording medium 101 is suppressed to lower than the glass transition point Tg.

In FIGS. 34(*a*) and (*b*), in the cooling means 146, the Peltier element is used as the cooling medium, and the heat radiation is conducted by the radiation block provided at the outside of the heating belt 143 through the heat transfer element. As shown in FIG. 34(*a*), the cooling means 146*c* has the temperature sensor 461, and by the temperature sensor 461, the surface temperature of the heating belt 143 is detected, and corresponding to the value, by controlling the temperature of the cooling air, the surface temperature at the downstream end of the heating belt 143 of the recording medium 101 is suppressed to lower than the glass transition point Tg. Herein, the radiation block is, as shown in FIG. 34(*b*), provided at the position sufficiently separated from the heating belt 143, and is separated to the range in which they do not influence on each other.

Further, the heat in which the Peltier element absorbs from the heating belt 43, is supplied again to the heating belt 143, and may also be a supplement of the heating.

The pressing means 147 is structured by a plate-like member 471, and an urging means 472 for urging the plate-like member 471 and the recording medium 101 to the heating belt 143 side. It is preferable that the plate-like member 471 is formed of metal, and it is required that its surface roughness is small as the same as the heating belt, and specifically, it is required that Ra=not larger than 0.5 $\mu$m, and not smaller than 0.01 $\mu$m, (ideally, Ra=not larger than 0.1 $\mu$m).

The pressing means 147 is, as shown in FIG. 35(*a*), not provided with the urging means 472, and by its position adjustment, it may also be a means for urging it to the heating belt 143 side. Further, as shown in FIG. 35(*b*), it may be structured by a plurality of urging rollers 473, and may also urge it to the heating belt 143 side.

The cleaning means 106 is composed of a roller whose outer periphery is surrounded by a absorber such as a sponge, and as shown in FIG. 27 and FIG. 28, provided in the direction perpendicular to the conveying direction of the heating belt 143. The cleaning means 106 is a driven roller driven by the movement of the heating belt 143, and when the heating belt 143 is driven, its surface slide-contacts with the surface of the heating belt 143, and wipes out the stain on the surface of the heating belt 143. In this connection, the cleaning means 106 is arranged detachably, and when it is stained, it is replaced with the new article.

Figure 45:
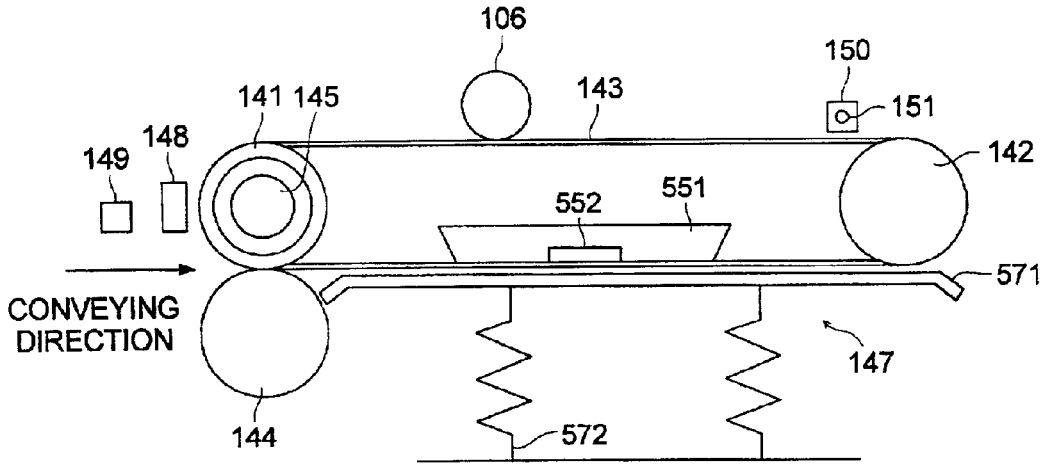
FIG. 45 is a front view showing the ink jet recording apparatus provided with an auxiliary heating means.
Figure 46:
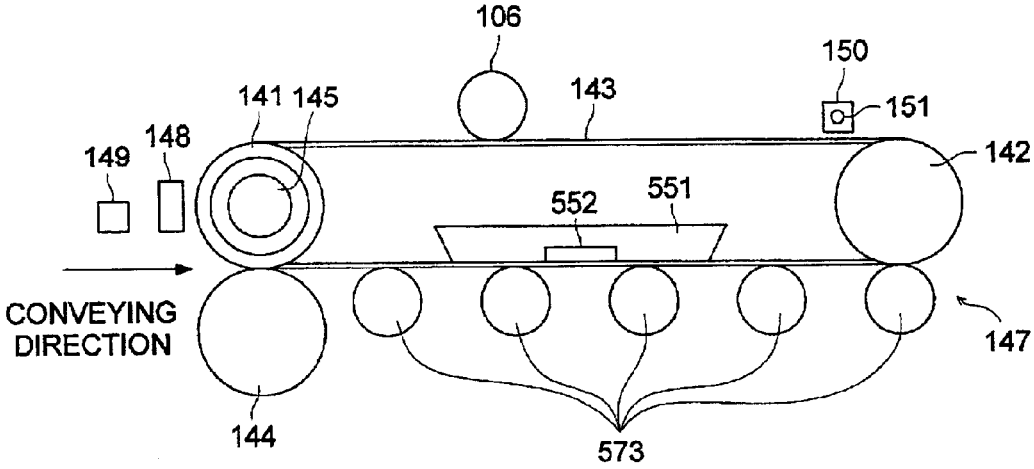
FIG. 46 is a front view showing another example of the ink jet recording apparatus provided with an auxiliary heating means.

Further, as shown in FIG. 45 and FIG. 46, in addition to the heating element 145 provided in the heating roller 141, an auxiliary heating means 451 is provided inside the heating belt 143, and by additionally supplying the heat to the recording medium 101, it can also be further promoted to make the ink receiving layer transparent. The auxiliary hating means 451 has the temperature sensor 452 inside, and by the temperature sensor 452, the surface temperature of the heating belt 143 is detected, and by the temperature control means, not shown, the heat generation amount of the auxiliary heating means 451 is controlled, thereby, the surface temperature of the heating belt 143 is controlled so as to be maintained within the predetermined temperature range.

As described above, after the image is recorded and formed by the recording head 103, the recording medium 101 is conveyed to the heating and pressing means 104, and initially, by pressing of the heating roller 141 and the pressurizing roller 144, the undulation of the surface is flattened. Next, by the heat supplied from the heating belt, the thermoplastic resin particle included in the ink receiving layer of the recording medium 101 is fused, and the surface roughness is improved. Further, when the image formation surface of the recording medium 101 is pressed to the surface of the heating belt 143 by the pressing means 147, the surface roughness is improved to the equal degree to the surface roughness (Ra=0.5 $\mu$m–0.01 $\mu$m) of the heating belt 143. Then, after the surface temperature is cooled to lower than the glass transition point Tg by the cooling means 146, it is delivered to the outside of the heating and pressing means 104. A time period during which the recording medium 1 comes in contact with the heating belt is preferably 3 to 15 seconds in order to obtain an excellent image.

In the present invention, the heating and pressing means 4 is maintained in a predetermined temperature range by the temperature control means. The predetermined temperature range maintained by the temperature control means is preferable when it has a predetermined variation width ($\Delta$T) to the target temperature (To) which is sufficiently necessary for making the ink receiving layer of the recording medium 1 transparent, and when the predetermined temperature range is To$\pm\Delta$T, it is preferable that To is 50–150° C., preferably 80–130° C. and $\Delta$T is not smaller than 10° C.

When To$\pm\Delta$T is out of the above range, it exceeds the variation range sufficiently necessary for stably heating processing the recording medium 1, and the process for making the ink receiving layer transparent, which is important to form the good quality image print, can not be finely conducted.

By the above means, when the image formation surface of the recording medium 101 is made transparent, and the surface roughness is improved, because the reflectance of the light of the image formation surface is increased, and the degree of the gloss of the recording medium 101 is increased, the higher quality image print than the conventional one can be formed.

[The Second Example]

Figure 36:
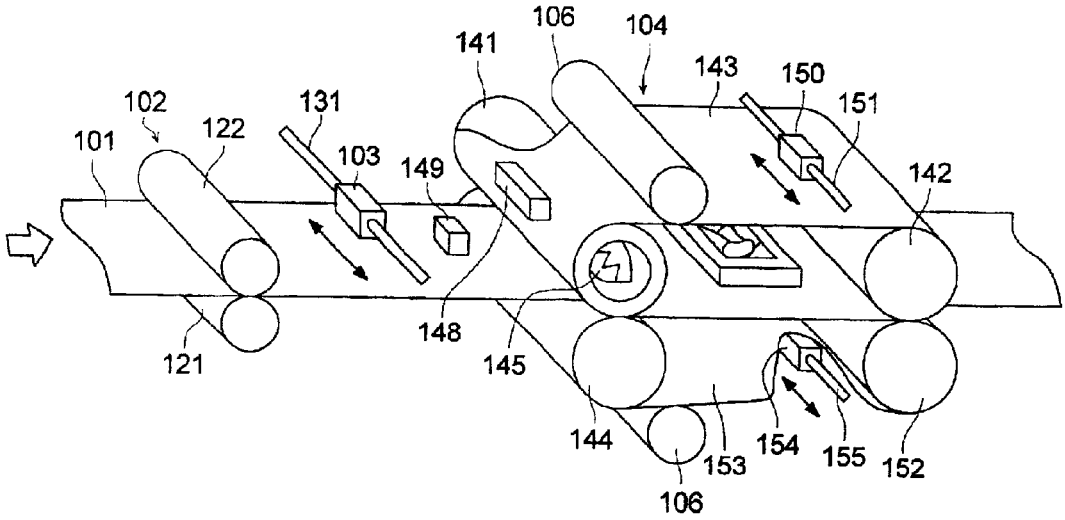
FIG. 36 is a perspective view showing another embodiment of the present invention.

FIG. 36 is an outline structural view of the ink jet recording apparatus according to item (4) of the present invention. The ink jet recording apparatus which is the present invention is structured by a recording medium conveying means 102 for conveying a recording medium 101, a recording head 103 to record a predetermined image on the recording surface of the recording medium 101, and heating and pressing means 104 for conducting the fixing processing on the recording medium 101 on which the image is recorded and formed by the recording head 103.

The recording medium 101 is supplied by a supply means (not shown) and conveyed to the right direction in the drawing by a recording medium conveying means (hereinafter, simply called conveying means) 102, and a predetermined image is recorded on the recording surface of the recording medium 101 by the recording head 103 arranged at the downstream side of the conveying means 102. Then, the recording medium 101 after the recording, is further conveyed to the heating and pressing means 104 arranged at the downstream side of the recording head 103, and after the fixing processing of the image recorded on the recording surface of the recording medium 101 is conducted, it is delivered to the outside of the ink jet recording apparatus.

Herein, as the recording medium 101, in the example shown in the drawing, an example in which a long roll paper wound roll-like is used is shown, but it is not limited to this, a sheet-like recording medium cut into an appropriate size may also be used.

The conveying means 102 comprises a conveying roller 121 driven by a drive means, not shown, and a driven roller 122 to sandwich the recording medium 101 between the conveying roller 121 and the driven roller 122, and while the recording medium 101 is sandwiched between the conveying roller 121 and the driven roller 122, by the rotation of the conveying roller 121, corresponding to the image recording by the recording head 103, which will be described later, a predetermined amount of the recording medium 101 is conveyed to the right direction in the drawing (sub scanning direction).

The recording head 103 is arranged at the downstream side of the conveying means 102, and a reciprocating operation-type recording head which is structured such that it can be moved in the main scanning direction along an operation guide 131 provided so as to be almost perpendicular to the conveying direction of the recording medium 101 ranging over the width direction of the recording medium 101.

In the recording head 103, a plurality of ink tanks in which each color pigment ink, such as, for example, Y (yellow), M (magenta), C (cyan), K (black), is stored, are provided, and while moving in the main scanning direction along the operation guide 131, by jetting the predetermined ink at a predetermined timing corresponding to the image data, the recording head 103 is cooperated with the conveyance of the recording medium 101 by the conveying means 102, and records and forms a predetermined image on the recording surface of the recording medium 101.

The heating and pressing means 104 is arranged at the downstream side of the recording head 103 in order to heat and pressurize and press the recording medium 101 after the image is recorded and formed by the recording head 103, and comprises: a heating roller 141; pressurizing roller 144 to sandwich the recording medium 101 between the heating roller 141 and it; heating belt 143 suspended around the heating roller 141; driven roller 142 driven by it; pressuring belt 153 which is suspended by the pressuring roller 144, and which is a means for pressing the recording medium 101 onto the heating belt 143; driven roller 152 driven by that; cooling means 146 for cooling the heating belt 143; temperature sensor 148 to detect the surface temperature of the heating belt 143; conveyance sensor 149 to detect the recording medium 101 before the heating roller 141 and the pressurizing roller 144; surface sensor 150, 154 to detect the surface roughness of the heating belt 143 and the pressurizing belt 153; and cleaning means 106 for removing the ink stain adhered onto the surface of the heating belt 143 and pressurizing belt 153.

Figure 37:
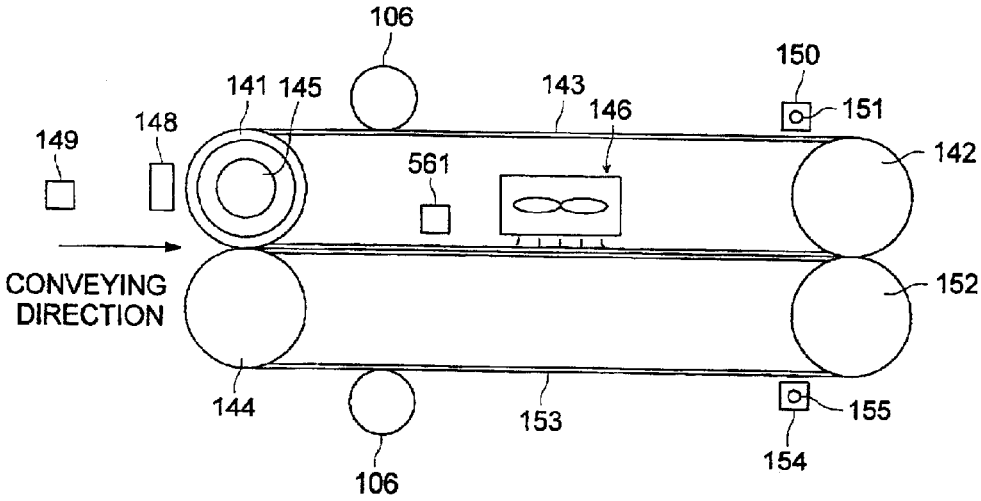
FIG. 37 is a front view showing another embodiment of the present invention.

As shown in FIG. 37, the heating roller 141 is composed of a hollow roller, and the heating element 145 such as a halogen heater, which is a heat source, is housed along its axial direction, and by the heat of the heating element 145, the heating roller 141 is heated, and the heating belt 143 which is suspended by the roller, is also heated, thereby, the thermoplastic resin particle included in the ink receiving layer of the recording medium 101 pressed by that, is fused.

It is preferable that this heating roller 141 is formed of the material with the high heat conductivity so that the recording medium 101 can be efficiently heated by the heat generated by the heating element 145, and it is preferable that the metallic roller is used.

The temperature sensor 148 to detect the surface temperature of the heating belt 143 suspended by the roller 141, is arranged close to the heating roller 141, and by detecting the surface temperature of the heating belt 143 by the temperature sensor 148, the heating amount of the heating element 145 inside the heating roller 141 is controlled by the temperature control means, not shown, and the surface temperature of the heating belt 143 is controlled so as to be maintained within a predetermined temperature range.

Figure 38:
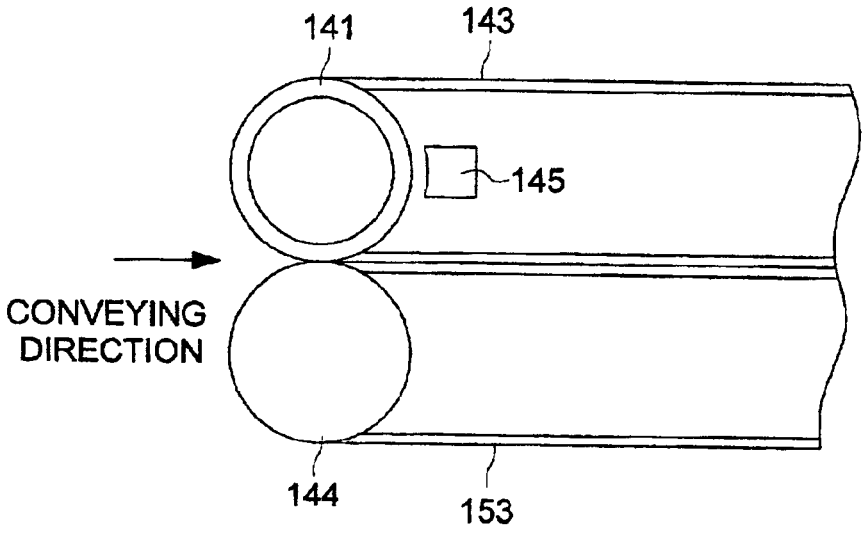
FIG. 38 is a front view showing another example of the arrangement position of the heating element.

The heating element 145 may also provided in the vicinity of the outside of the heating roller 141 as shown in FIG. 38.

The heating belt 143 is stretched between the heating roller 141 and driven roller 142, and after it is heated to a predetermined temperature range by the heating element 145 inside the heating roller 141, the surface is pressed onto the recording medium 101 after the image is recorded and formed by the recording head 3. Thereby, the thermoplastic resin particle included in the ink receiving layer of the recording medium 101 is fused, and its surface roughness is improved to the degree equal to the roughness of the surface of the heating belt 143.

Accordingly, it is required for the heating belt 143 that its surface roughness is small, and specifically, it is required that Ra=not larger than 0.5 $\mu$m, and not smaller than 0.01 $\mu$m (ideally, Ra=not larger than 0.1 $\mu$m).

As the heating belt 143, a belt in which basically the coating is coated on the surface of the metallic belt, is used, and considering about the parting property from the recording medium 101 and the surface roughness when it is coated, the following are listed as the material.

Nickel belt+silicon rubber+PFA
Nickel belt+PFA
Nickel belt+silicon rubber
Nickel belt+fluorine coat
Nickel belt+silicon rubber+hardening-type silicon
Nickel belt+hardening-type silicon
SUS belt+silicon rubber+PFA
SUS belt+PFA
SUS belt+silicon rubber
SUS belt+fluorine coat
SUS belt+silicon rubber+hardening-type silicon
SUS belt+hardening-type silicon
Polyimide belt+silicon rubber+PFA
Polyimide belt+PFA
Polyimide belt+silicon rubber
Polyimide belt+fluorine coat
Polyimide belt+silicon rubber+hardening-type silicon
Polyimide belt+hardening-type silicon In the heating belt 143, in a belt on which a coating such as silicon rubber is provided on its surface, as shown in FIG. 30, no-coating portions are provided on both end portions of the heating belt 143, and by avoiding the contact with the drop out prevention flanges 411 of the heating belt 143 which are respectively provided on end portions of the heating roller 141 and the driven roller 142, the generation of the dust following the peeling-off of the coating is prevented.

As described above, because the heating belt 143 is an important element to determine the surface roughness of the recording medium 101, the caution is necessary for the control of the surface roughness. Accordingly, as shown in FIG. 37, the surface sensor 150 to detect the surface roughness is provided and when the surface roughness of the heating belt 143 is lowered to a predetermined reference, the replacement time is reported by an alarm means, not shown.

The surface sensor 150 is structured in such a manner that it can be moved along the operation guide 151 provided so as to be about perpendicular to the drive direction of the heating belt ranging over the width direction of the heating belt 143, and the surface roughness is detected ranging over the whole width of the heating belt.

Further, for the purpose of controlling the surface roughness of the heating belt 143, other than the above means, a means for reporting the replacement time according to the conveying distance of the recording medium 101 is provided, and the conveying distance of the recording medium is measured by a measurement means, not shown, and when it reaches a predetermined distance, the replacement time is reported by the alarm means, not shown.

For the pressurizing roller 144, in the same manner as the heating roller 141, a metallic roller formed of the metal such as stainless steel, is used.

Figure 39:
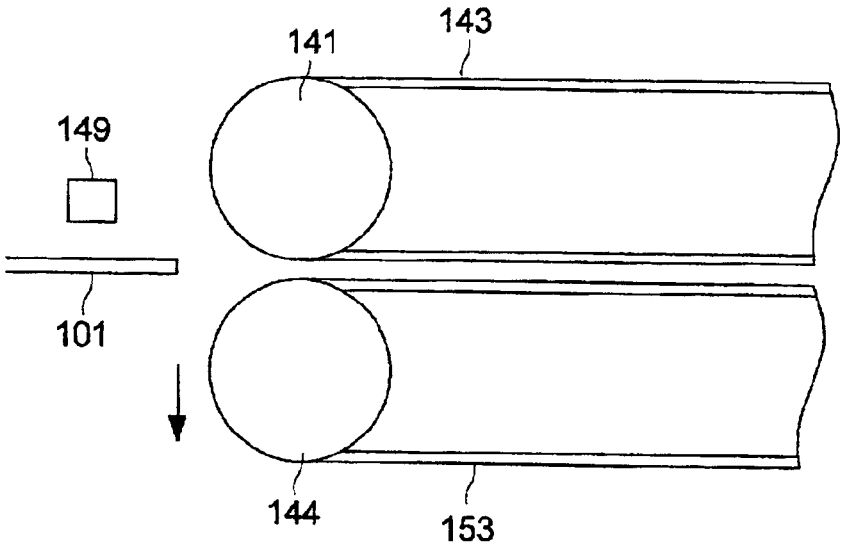
FIG. 39 is a front view showing the pressure control of the pressurizing roller when the recording medium is set.

The pressurizing roller 144 is always pressed onto the heating roller 141 side by an urging means, not shown, and as shown in FIG. 39, the conveyance sensor 149 is provided before the heating roller 141 and the pressurizing roller 144, and by this conveyance sensor 149, when it is detected that the recording medium 101 is conveyed, the control is conducted in such a manner that the urging means reduces the pressing force of the pressurizing roller 144 onto the heating roller 141. It is conducted for the purpose of preventing the surface of the heating belt 143 and the pressurizing roller 144 form being damaged by the end surface protruded portion of the recording medium 101.

The pressurizing belt 153 is a belt with which the pressing means 147 in the first example is replaced, and is stretched between the pressurizing roller 144 and the driven roller 152. When the image formation surface of the recording medium 101 is pressed onto the heating belt 143, the function to improve the surface roughness is performed.

As the pressurizing belt 153, in the same manner as the heating belt 143, a belt on which basically, the coating is coated on the surface of the metallic belt, is used, and considering about the parting property from the recording medium 101 and the surface roughness when it is coated, the materials as listed in the portion of the heating belt 143 are used.

In order to smoothly conduct the conveyance of the recording medium 101, and to adequately increase the surface roughness of the ink receiving layer of the recording medium 101, it is required that its surface roughness is equal to the heating belt 143. It is for the reason in which, when there is the difference between both surface roughness, a slip is caused between the recording medium 101 and the heating belt 143 or the pressurizing belt 153, and the improvement of the surface roughness is prevented. Specifically, it is required that Ra=not larger than 0.5 $\mu$m, and not smaller than 0.01 $\mu$m (ideally, Ra=not larger than 0.1 $\mu$m).

As described above, also in the pressurizing belt 153, in the same manner as in the heating belt 143, the caution is necessary for the control of the surface roughness. Accordingly, as shown in FIG. 36 and FIG. 37, a surface sensor 154 to detect the surface roughness is provided, and when the surface roughness of the pressurizing belt 153 is lowered to a predetermined reference, the replacement time is reported by the alarm means, not shown.

The surface sensor 154 is structure in such a manner that it can be moved along the operation guide 155 provided so as to be almost perpendicular to the drive direction of the pressurizing belt 153 ranging over the width direction of the pressurizing belt 153, and it detects the surface roughness ranging over the whole width of the heating belt.

Further, for the purpose of controlling the surface roughness of the pressurizing belt 153, other than the above means, a means for reporting the replacement time according to the conveying distance of the recording medium 101 is provided, and the conveying distance of the recording medium is measured by a measurement means, not shown, and when it reaches a predetermined distance, the replacement time is reported by the alarm means, not shown.

Figure 40:
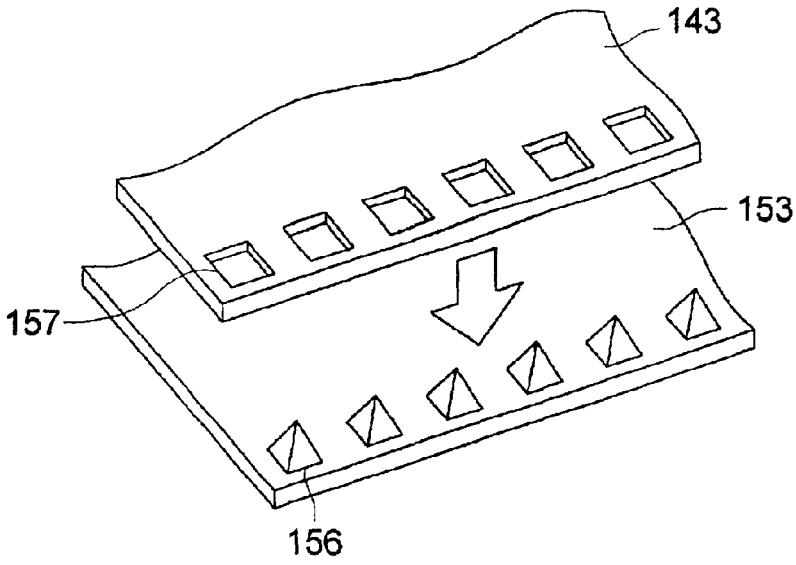
FIG. 40 is a perspective view showing a condition of the engagement of a heating belt with a pressurizing belt.
Figure 41:
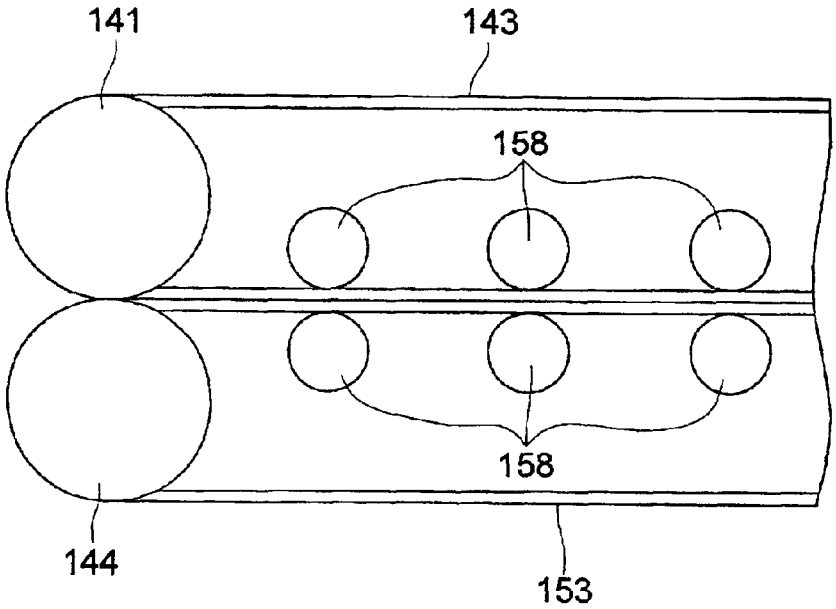
FIG. 41 is a perspective view showing a means for contacting the heating belt and the pressurizing belt with each other.

Further, in order to adequately convey the recording medium 101 without causing the slip, initially, for the purpose of coinciding the conveying speed of both belts, as shown in FIG. 40, a protruded portion 156 is provided on one belt, and a hole portion 157 to engage with the protruded portion is provided in the other belt. Next, for the purpose of preventing the slip at the time of conveyance of the recording medium 101, as shown in FIG. 41, by using the pressing roller 158,the heating belt 143 and the pressurizing belt 153 are forcibly in contact with each other.

As shown in FIG. 37, the cooling means 146 is provided for cooling the heating belt 143, at the downstream of the conveying direction of the recording medium 101 of the heating belt 141 and the pressurizing belt 144. It is because that the recording medium 101 passed through the heating roller 141 and the pressurizing roller 144 is pressed onto the heating belt 143 by the pressing belt 153, which will be described later, and thereby, while the surface roughness is improved, further conveyed to the downstream, and finally, in the case where it is separated from the downstream end of the heating belt 143 which is the exit of the heating and pressing means 104, when the surface temperature is not fully cooled to lower than the glass transition point Tg, because bad influence is caused on the surface roughness, it is necessary to fully cool it. Accordingly, when the surface temperature of the heating belt 143 is detected by the temperature sensor 461, and corresponding to the value, the cooling means 146 controls the degree of cooling, the surface temperature at the downstream end of the heating belt 143 of the recording medium 101 is suppressed to lower than the glass transition point Tg.

Figure 42:
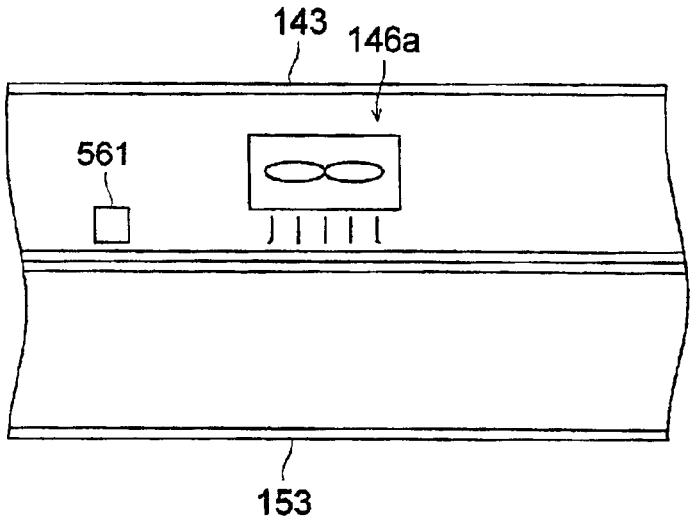
FIG. 42 is a front view showing another example of the cooling means.
Figure 43:
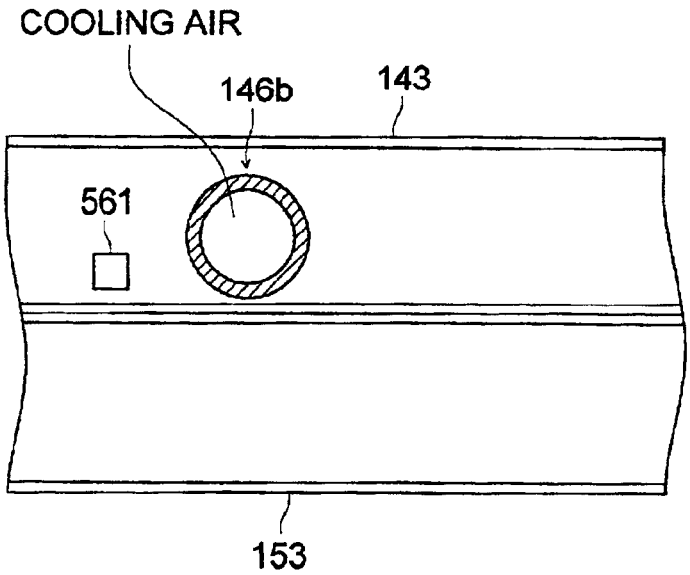
FIG. 43 is a front view showing yet another example of the cooling means.
Figure 44:
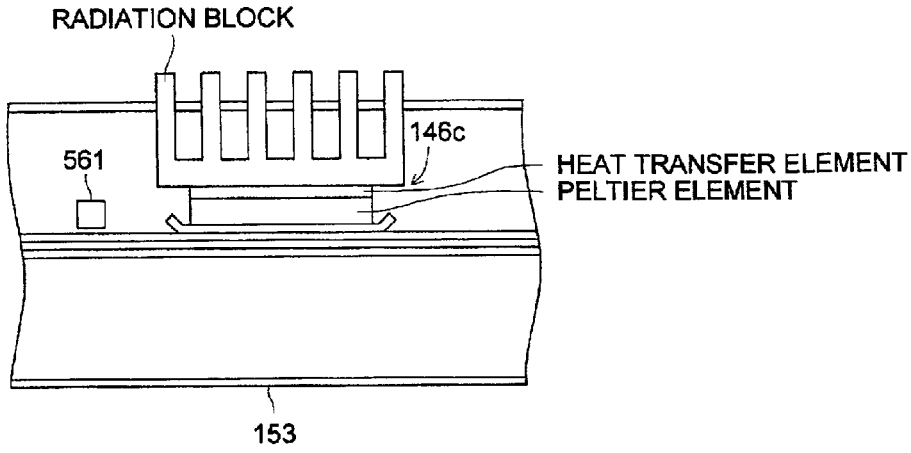
FIG. 44(*a*) is a front view showing yet another example of the cooling means.
Figure 44:
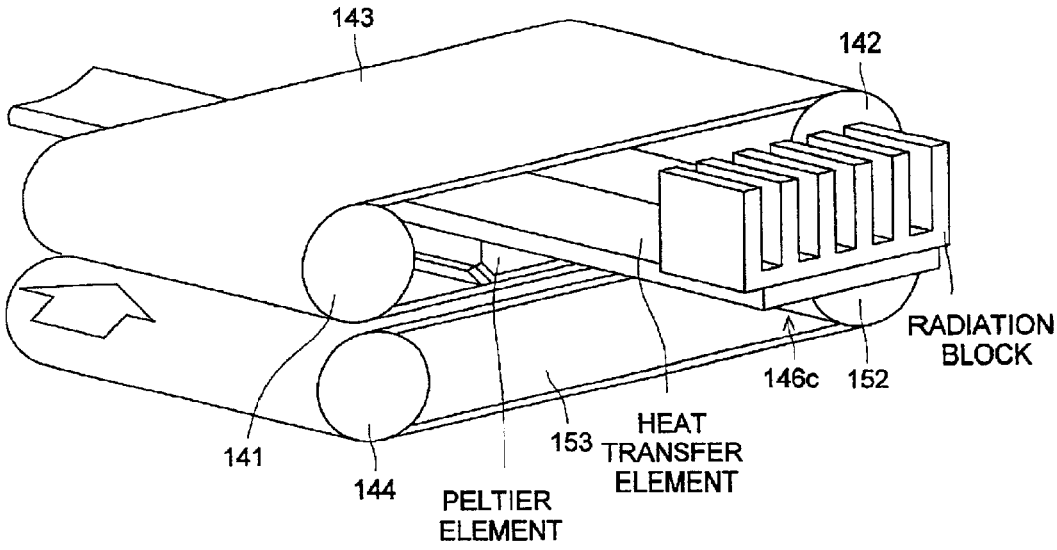

Specific examples of the cooling means 146 will be shown in FIG. 42, FIG. 43 and FIG. 44.

FIG. 42 is a view in which an air-cooling fan is used for the cooling means 146. As shown in the drawing, the cooling means 146*a* has the temperature sensor 461, and by the temperature sensor 461, the surface temperature of the heating belt 143 is detected, and corresponding to the value, by controlling the blast amount, the surface temperature at the downstream end of the heating belt 143 of the recording medium 101 is suppressed to lower than the glass transition point Tg.

FIG. 43 is a view in which a hollow pipe is used for the cooling means 146, and the cooling air is circulated inside it. As shown in the drawing, the cooling means 146*b* has the temperature sensor 461, and by the temperature sensor 461, the surface temperature of the heating belt 143 is detected, and corresponding to the value, by controlling the temperature of the cooling air, the surface temperature at the downstream end of the heating belt 143 of the recording medium 101 is suppressed to lower than the glass transition point Tg.

In FIG. 44(*a*) and (*b*), in the cooling means 146, the Peltier element is used as the cooling medium, and the heat radiation is conducted by the radiation block provided at the outside of the heating belt 143 through the heat transfer element. As shown in FIG. 44(*a*), the cooling means 146*c* has the temperature sensor 461, and by the temperature sensor 461, the surface temperature of the heating belt 143 is detected, and corresponding to the value, by controlling the temperature of the cooling air, the surface temperature at the downstream end of the heating belt 143 of the recording medium 101 is suppressed to lower than the glass transition point Tg. Herein, the radiation block is, as shown in FIG. 44(*b*), provided at the position sufficiently separated from the heating belt 143, and is separated to the range in which they do not influence on each other.

Further, the heat in which the Peltier element absorbs from the heating belt 43, may be supplied again to the heating belt 143, and may also be a supplement of the heating.

The cleaning means 106 is composed of a roller structured such that its outer periphery is surrounded by a absorber such as a sponge, and as shown in FIG. 36 and FIG. 37, is respectively provided one by one in the direction perpendicular to the conveying direction of the heating belt 143 and pressurizing belt 153. The cleaning means 106 is a driven roller driven by the movement of the heating belt 143 and the pressurizing belt 153, and when the heating belt 143 and the pressurizing belt 153 are driven, its surface slide-contacts with the surface of the heating belt 143, and wipes out the stain on the surface of the heating belt 143 and the pressurizing belt 153. In this connection, the cleaning means 106 is arranged detachably, and when it is stained, it is replaced with the new article.

Figure 47:
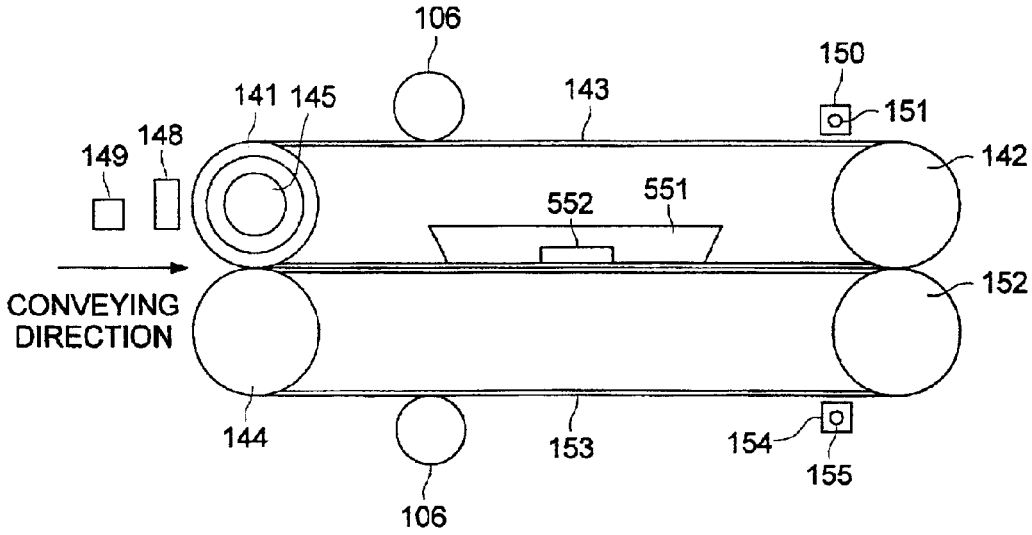
FIG. 47 is a front view showing yet another example of the ink jet recording apparatus provided with an auxiliary heating means.

Further, for example, as shown in FIG. 47, in addition to the heating element 145 provided in the heating roller 141, an auxiliary heating means 451 is provided inside the heating belt 143, and by additionally supplying the heat to the recording medium 101, it can also be further promoted to make the ink receiving layer transparent. The auxiliary hating means 451 has the temperature sensor 452 inside, and by the temperature sensor 452, the surface temperature of the heating belt 143 is detected, and by the temperature control means, not shown, the heat generation amount of the auxiliary heating means 451 is controlled, thereby, the surface temperature of the heating belt 143 is controlled so as to be maintained within the predetermined temperature range.

As described above, after the image is recorded and formed by the recording head 103, the recording medium 101 is conveyed to the heating and pressing means 104, and initially, by pressing of the heating roller 141 and the pressurizing roller 144, the undulation of the surface is flattened. Next, by the heat supplied from the heating belt, the thermoplastic resin particle included in the ink receiving layer of the recording medium 101 is fused, and the surface roughness is improved. Further, when the image formation surface of the recording medium 101 is pressed to the surface of the heating belt 143 by the heating belt 153, the surface roughness is improved to the equal degree to the surface roughness (Ra=0.5 $\mu$m–0.01 $\mu$m) of the heating belt 143. Then, after the surface temperature is cooled to lower Aid than the glass transition point Tg by the cooling means 146, it is delivered to the outside of the heating and pressing means 104.

In the present invention, the heating and pressing means 4 is maintained in a predetermined temperature range by the temperature control means. The predetermined temperature range maintained by the temperature control means is preferable when it has a predetermined variation width ($\Delta T$) to the target temperature (To) which is sufficiently necessary for making the ink receiving layer of the recording medium 1 transparent, and when the predetermined temperature range is To$\pm\Delta T$, it is preferable that To is 50–150° C., preferably 80–130° C. and $\Delta T$ is not smaller than 10° C.

When To$\pm\Delta T$ is out of the above range, it exceeds the variation range sufficiently necessary for stably heating processing the recording medium 1, and the process for making the ink receiving layer transparent, which is important to form the good quality image print, can not be finely conducted.

By the above means, when the image formation surface of the recording medium 101 is made transparent, and the surface roughness is improved, because the reflectance of the light of the image formation surface is increased, and the degree of the gloss of the recording medium 101 is increased, the higher quality image print than the conventional one can be formed.

As described above, by using the ink jet recording apparatus of the present invention, when the recording medium having the ink receiving layer including the thermoplastic resin particle in the surface layer, and pigment ink solvent absorption layer adjacent to the inside of the ink receiving layer, is heated at the appropriate temperature and pressurized by the appropriate pressure, and is fully pressed onto the heating belt having the predetermined surface roughness, the ink receiving layer can be adequately made transparent, and the high quality image print can be formed.

What is claimed is:

1. An inkjet recording method of recording an image on a recording medium having an ink receiving layer containing thermoplastic particles on a surface thereof and a pigment solvent absorbing layer adjoining to an inner side of the ink receiving layer, the pigment ink solvent absorbing layer having a void layer which absorbs a pigment ink solvent, comprising:

recording an image on the recording medium with a pigment ink; and making the ink receiving layer transparent by heating and pressing the recording medium recorded the image with a heating temperature of $T_0\pm\Delta T$° C., where $T_0$ is 50 to 150° C. and $\Delta T$ is not larger than 10° C., and a pressing force of $9.8\times10^4$ to $4.9\times10^6$ Pa wherein heating and pressing comprises using a heating and pressing device that has at least a roller of which surface has a modulus of longitudinal elasticity between $1\times10^6$ Pa and $1\times10^7$ Pa.

2. The inkjet recording method of claim 1, wherein $T_0$ is 80 to 130° C.

3. An inkjet recording method of claim 1, wherein the void layer includes an inorganic fine particle.

4. An inkjet recording apparatus, comprising:

a recording head for a pigment ink, to jet a pigment ink onto a recording medium having an ink receiving layer containing thermoplastic resin particles on a surface thereof and a pigment ink solvent absorbing layer adjoining to an inner side of the ink receiving layer, the pigment ink solvent absorbing layer having a void layer which absorbs a pigment ink solvent;

a heating and pressing device to heat and press the recording medium recorded by the recording head with pressing force of $9.8\times10^4$ to $4.9\times10^6$ Pa so as to make the ink receiving layer of the recording medium transparent wherein the heating and pressing device has at least a roller of which surface has a modulus of longitudinal elasticity between $1\times10^6$ Pa and $1\times10^7$ Pa;

a conveyor to convey the recording medium recorded by the recording head to the heating and pressing device; and a temperature controller to control a heating temperature by the heating and pressing device within a range of $T_0 \pm \Delta T°$ C., where $T_0$ is 50 to 150° C. and $\Delta T°$ C. is not larger than 10° C.

5. The inkjet recording apparatus of claim 4, wherein $T_0$ is 80 to 130° C.

6. The inkjet recording apparatus of claim 4, wherein the inkjet recording apparatus is adapted to record an image on one of plural kinds of recording medium the inkjet recording apparatus further comprises a CPU which controls the heating and pressing device so as to change a heating and pressing time period in accordance with the kind of the recording medium.

7. The inkjet recording apparatus of claim 4, wherein the inkjet recording apparatus is adapted to record an image on one of plural kinds of recording medium and the temperature controller controls the heating temperature by the heating and pressing device in accordance with the kind of the recording medium.

8. The inkjet recording apparatus of claim 4, wherein the heating and pressing device comprises a belt member stretched around at least two rollers and a roller coming in contact with the belt member so as to form a nip section therebetween where the recording medium passes through.

9. The inkjet recording apparatus of claim 4, wherein the heating and pressing device comprises two belt members each stretched around at least two rollers and the two belt members come in contact with each other so as to form a nip section therebetween where the recording medium passes through.

10. The inkjet recording apparatus of claim 4, wherein the heating and pressing device has a recording medium contacting surface to contact the recording medium and comprises a cleaning member to clean the recording medium contacting surface.

11. The inkjet recording apparatus of claim 4, wherein the heating and pressing device has a recording medium contacting surface to contact the recording medium and comprises a transfer preventing liquid providing member to provide the recording medium contacting surface with a transfer preventing liquid to prevent a part of the recording medium or an ink from transferring to the recording medium contacting surface.

12. The inkjet recording apparatus of claim 11, wherein the transfer preventing liquid contains a silicone oil.

13. The inkjet recording apparatus of claim 4, wherein the heating and pressing device has a recording medium contacting surface to contact the recording medium and comprises a transfer preventing liquid providing member to provide the recording medium contacting surface with a transfer preventing liquid to prevent a part of the recording medium or an ink from transferring to the recording medium contacting surface before heating and pressing the recording medium after the recording head has conducted recording on the recording medium.

14. The inkjet recording apparatus of claim 4, wherein the heating and pressing device has a recording medium contacting surface to contact the recording medium and comprises a glossing liquid providing member to provide a glossing liquid onto the recording medium contacting surface.

15. The inkjet recording apparatus of claim 14, wherein the inkjet recording apparatus is adapted to record an image on one of plural kinds of recording medium and the a glossing liquid providing member comprises a control section to control whether or not to provide the glossing liquid in accordance with the kind of the recording medium.

16. The inkjet recording apparatus of claim 14, wherein the inkjet recording apparatus is adapted to record an image on one of plural kinds of recording medium and the a glossing liquid providing member comprises a selecting section to select whether or not to provide the glossing liquid.

17. The inkjet recording apparatus of claim 14, wherein the glossing liquid contains a silicone oil.

18. The inkjet recording apparatus of claim 4, further comprising a glossing liquid providing member to provide a glossing liquid onto the recording medium after the recording head has conducted recording on the recording medium.

19. The inkjet recording apparatus of claim 4 further comprising a CPU, wherein when the CPU controls the inkjet recording apparatus so as not to conduct recording during a predetermined time period, the temperature controller stops controlling the heating temperature such that the heating and pressing device stops heat generation.

20. The inkjet recording apparatus of claim 19, wherein when the temperature controller resumes controlling the heating temperature after the temperature controller stopped the controlling, the temperature controller controls the heating and pressing device so as to conduct heating and pressing by prolong relatively a heating and pressing time period after the heating temperature becomes higher than a lowest heating temperature and until the heating temperature becomes within a predetermined temperature range.

21. The inkjet recording apparatus of claim 20, wherein when the temperature controller controls the heating and pressing device so as to prolong the heating and pressing time period for the recording medium, the CPU controls the recording head so as to prolong relatively a recording time period per a unit length of the recording medium in a conveying direction of the recording medium.

22. The inkjet recording apparatus of claim 21, further comprising a carriage motor for moving the recording head so as to scan on the recording medium forwardly and backwardly in a direction perpendicular to the conveying direction of the recording medium, and wherein the CPU controls the carriage motor so as to prolong the recording time period by adjusting a stop time at which a scanning direction is changed.

23. The inkjet recording apparatus of claim 21, wherein the recording head comprises a line head having a length corresponding to a width of the recording medium, and wherein the CPU controls the recording head so as to prolong the recording time period by adjusting a ink jetting time interval.

24. The inkjet recording apparatus of claim 4 further comprising a CPU, wherein when the CPU controls the inkjet recording apparatus so as not to conduct recording during a predetermined time period, the temperature controller controls such that the heating and pressing device keeps the heating temperature within a second temperature lower than the range.

25. The inkjet recording apparatus of claim 4 further comprising a CPU, wherein when the CPU controls the inkjet recording apparatus so as not to conduct recording during a predetermined time period, the temperature controller controls such that the heating and pressing device keeps the heating temperature within a second temperature lower than the range, and further when the CPU controls the inkjet recording apparatus so as not to conduct recording during a predetermined another time period, the temperature controller stops controlling the heating temperature such that the heating and pressing device stops heat generation.

26. The inkjet recording apparatus of claim 4, wherein the heating and pressing device comprises a heating roller, a driven roller, a heating belt stretched around the heating roller and the driven roller, a pressing roller provided opposite to the heating roller, and a pressing member provided downstream in a conveying direction from the pressing roller and to press the recording medium.

27. The inkjet recording apparatus of claim 26, wherein the heating belt is an endless belt whose surface roughness is 0.01 $\mu$m to 0.5 $\mu$m.

28. The inkjet recording apparatus of claim 26, wherein the pressing member is a plate.

29. The inkjet recording apparatus of claim 4, wherein the heating and pressing device comprises a heating roller, a driven roller, a heating belt stretched around the heating roller and the driven roller, a pressing roller provided opposite to the heating roller, and a pressing belt to press the heating belt.

30. The inkjet recording apparatus of claim 29, wherein the heating belt and the pressing belt come in contact with each other.

31. The inkjet recording apparatus of claim 29, wherein the heating belt has a surface roughness of 0.01 $\mu$m to 0.5 $\mu$m.

32. The inkjet recording apparatus of claim 29, wherein when the conveyor conveys the recording medium through the heating and pressing device, the heating and pressing device comes in contact with the recording medium for a contact time of 3 to 15 seconds.

33. The inkjet recording apparatus of claim 4, wherein the heating and pressing device comprises a belt member stretched around at least two rollers and a roller coming in contact with the belt member so as to form a nip section therebetween where the recording medium passes through.

34. The inkjet recording apparatus of claim 33, wherein the belt member is provided so that the belt member comes in contact with the thermoplastic resin particles of the recording medium at the nip section and the recording medium is conveyed inside of the heating and pressing device with the state that the thermoplastic resin particles are in contact with the belt member.

35. An inkjet recording method of claim 34, wherein the void layer includes an inorganic fine particle.

36. The inkjet recording apparatus of claim 4, wherein the heating and pressing device comprises two belt members each stretched around at least two rollers and the two belt members come in contact with each other so as to form a nip section therebetween where the recording medium passes through.

37. The inkjet recording apparatus of claim 4, wherein the heating and pressing device has a recording medium contacting surface to contact the recording medium and comprises a cleaning member to clean the recording medium contacting surface.

* * * * *